United States Patent [19]

Schuller et al.

[11] Patent Number: 4,512,453

[45] Date of Patent: Apr. 23, 1985

[54] VENDOR ACCOUNTABILITY SYSTEM

[75] Inventors: James T. Schuller, St. Louis County; Paul K. Griner, St. Louis; Nai H. Mak, Maryland Heights, all of Mo.

[73] Assignee: UMC Industries, Inc., Stamford, Conn.

[21] Appl. No.: 423,073

[22] Filed: Sep. 24, 1982

[51] Int. Cl.[3] ..... G07F 9/08

[52] U.S. Cl. ..... 194/1 N; 194/97 R; 364/479

[58] Field of Search ..... 377/13; 364/479; 340/825.35, 825.33; 194/1 N, 10, 13; 235/381, 385; 346/33 A, 33 B

[56] References Cited

U.S. PATENT DOCUMENTS

| | | | |
|---|---|---|---|
| 4,216,461 | 8/1980 | Werth et al. | 340/149 R |
| 4,272,757 | 6/1981 | McLaughlin et al. | 340/152 R |
| 4,280,118 | 7/1981 | Brunken et al. | 340/147 MD |
| 4,280,181 | 2/1981 | Levasseur | 364/464 |
| 4,283,097 | 8/1981 | Lundblad | 312/223 |
| 4,283,710 | 8/1981 | Genest et al. | 340/149 R |
| 4,381,835 | 5/1983 | Shah et al. | 194/1 N |

*Primary Examiner*—Stanley H. Tollberg
*Attorney, Agent, or Firm*—Senniger, Powers, Leavitt and Roedel

[57] ABSTRACT

An accountability system for a vendor having a cash handler, change tubes and a cash box, the cash handler being adapted to accept deposited coins and deliver them to the change tubes if needed, otherwise to deliver them to the cash box. A memory stores data on the amount of cash which should be retained in the vendor out of cash deposited in the vendor, and also data on delivery of coin to and from the change tubes, for computation of the amount of cash which should be turned in from the vendor. A logic circuit controls input of data to and retrieval of data from the memory, the logic circuit being operable to update in the memory the data for the computation. The system uses a latched cash box and refunds, test vends, and adding change to the change tubes are all accomplished without opening the cash box. Access to the cash box and to data stored in the memory is limited to those possessing specially coded keys. The system itself is user programmable, using a special programming key and a secret code number, to restrict access to data and to restrict subsequent programming. A special key is used to clear the data in the system and another is provided to allow a list to be entered of keys to be locked out or rejected by the system. The system can be put in a mode to provide free deliveries to everyone or free deliveries just to employees.

122 Claims, 72 Drawing Figures

CREDIT AMOUNT=0
YES
FORCED TEST VEND FLAG SET
YES
NO
NO
CREDIT AMOUNT > PRICE
NO
DISPLAY "PRICE" AND PRICE AMOUNT
YES
ENOUGH CHANGE
NO
DISPLAY "NO CHANGE" FOR FOUR SECONDS
YES
IN TEST VEND MODE
NO
YES
ENOUGH CHANGE FOR THE PRICE AMOUNT
NO
YES

FIG. 17
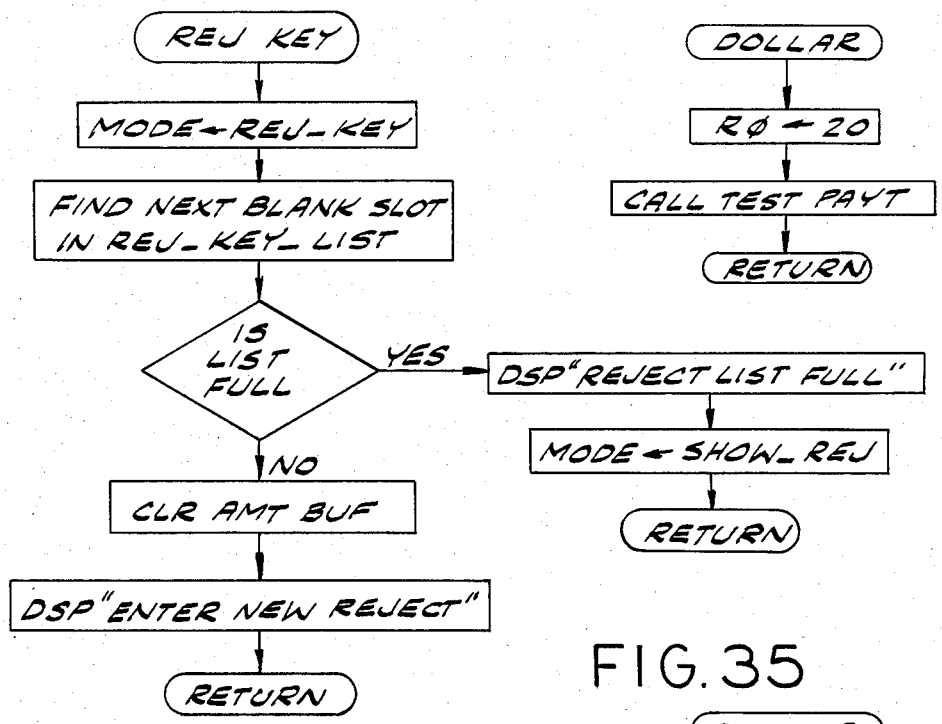
FIG. 36
FIG. 35
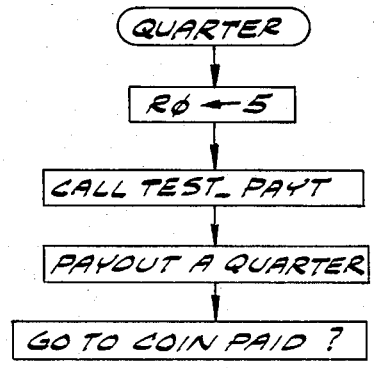
FIG. 32
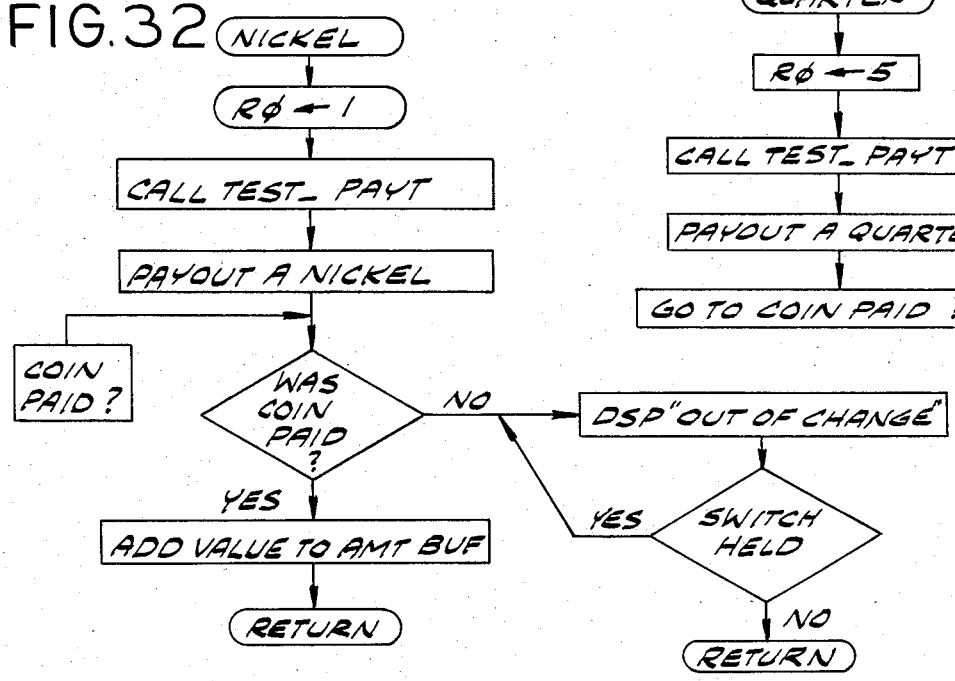

VENDOR ACCOUNTABILITY SYSTEM

BACKGROUND OF THE INVENTION

This invention relates to accountability systems for vendors and more particularly to systems for automatically providing sales and cash accountability for vendors.

A continuing concern of operators, e.g., owners, of vending machines (vendors) is losses resulting from skimming or theft of cash and items from vending machines. Manual accountability systems have been used to reduce the skimming and theft but these have not proved to be overly successful. Such manual systems involve mahually taken machine inventories and the use of refund slips and test vend slips which the route person is supposed to insert in the cash box whenever a refund or a test vend is made so that the amount of money which should be present in the cash box can be calculated. Unfortunately, the data collected using such systems is inaccurate, in part because refund and test vend slips are not always completed by the route person. Moreover, such systems are highly labor intensive and highly dependent upon the conscientiousness of the individual route person. As a result, there are wide variations in accuracy when such systems are used and generally this lack of accuracy prevents the detection of most skimming. Operators are not only concerned with detecting shortages in cash and merchandise, they are also interested in determining who was responsible for the shortages and in learning of such shortages as soon as possible after they occur. Neither of these goals are readily achievable with manual accountability systems.

Test vends are a troublesome product and cash accountability area. Some vending equipment, usually drink machines, have a test vend switch which allows the attendant to operate the machine's dispensing system without money. So long as these test vends are not counted as machine sales, such operation does not affect the machine cash accountability, but it does affect product accountability. Test vend slips are necessary for product accountability purposes. Test vend slips must also be prepared when these test vends are included in the total of machine sales because a record of such test vends is then necessary to determine how much money should be turned in from that particular machine.

Test vends also create cash and product accountability problems on machines not equipped with test vend switches or when it is desired to test the coin handling unit of a machine. Commonly money is taken from the vendor's cash box or change tubes and reinserted into the machine for test vends. Since this will be recorded as a sale by a machine with a sales meter, the service person is required to fill out test vend slips in order to accurately determine the amount of money which should be turned in from that machine. Unfortunately test vend slips are often incorrect and sometimes not collected.

Instead of allowing their employees to use change tube or cash box money for test vends, some operators loan their employees money which they can carry with them to make test vends and to replenish change tubes. The employee must turn in a record of his test vends, and is in turn reimbursed for them. This system eliminates the need to use machine money for test vends, but in order to have cash accountability for individual machines the test vend records must be broken down by machine serviced. This system, if done properly, requires considerable bookkeeping.

Another problem with test vends is that the test vend might be reported but never actually performed and the money pocketed by the route person. A large amount of skimming can be done in this manner with current systems without detection.

Many operators permit their employees to have free drinks or packaged products from the machines they service or tend. On a drink machine employees use the test vend button provided on earlier machines to obtain free drinks and the vended item is recorded as a test vend. In the case of packaged products, i.e. non-drink items, the items are merely removed from the machine by the employee and consumed. Of course, records of these transactions are needed for product accountability purposes, but they may not be accurately kept or turned in, and even if they are the process increases the amount of internal bookkeeping required.

A related cash and product accountability problem occurs when customers take packaged product from the route person's trays before or while the product is loaded into the machine. Using present systems, the route person usually puts the money received from the customer in the cash box. As a result the vend price of the item is not counted as a sale in conventional systems and the cash box money does not check out. Of course, instead of putting the money in the cash box, the route person can merely pocket it or otherwise prevent shortages from being detected.

Product in a food machine sometimes spoils before it is sold and must be removed. For adequate product accountability, a record must be kept of these removed products, called pulls. Manual record keeping of this sort, even if attempted, would also suffer from the inaccuracies mentioned above in connection with test vend slips.

At least two semi-automated accountability systems have been devised to address some of the concerns of the vendor operators, but these systems could be improved. For example, although both of these systems provide for automatic recording of total sales figures and for retrieval of these figures using a data interrogator or probe, neither can adequately determine the amount of money which should be collected from the vending machines because, in part, they require manual recording of refunds and collection of refund slips and they do not provide true accountability of money in the change tubes. These systems also lack means for automatically recording test vends and for recording information useful in identifying the person or persons responsible for any shortages.

SUMMARY OF THE INVENTION

Among the several objects of this invention may be noted the provision of an accountability system for a vendor which provides an accurate account of machine sales and monies which enables operators to detect significant skimming and theft; the provision of such a system which provides accurate data to determine whether the amount turned in from machine collections is the amount that should be turned in from each machine, location and vending route; the provision of such a system which reduces the time and errors inherent with manual accountability systems; the provision of such a system which not only detects shortages but also helps determine how they come about and who may have been responsible for them; the provision of such a system which enables vending operators to integrate a sales and cash accountability system into an ongoing business with ease and at minimal cost; the provision of such a system which is flexible enough to provide varying degrees of sales and cash accountability data for small, medium and large businesses; the provision of such a system which can be used to provide a location or route with worthwhile sales and cash accountability without immediately installing new equipment in all machines at that location or on that route; the provision of such a system that can be retrofitted into existing vending machines; the provision of such a system that can reduce the time spent by route persons on bookkeeping chores, thereby enabling them to more efficiently service the vending machines; the provision of such a system that is useful for operators having computers and for those who do not; the provision of such a system which provides accurate accounting and control of the money in change tubes; the provision of such a system which eliminates the need for refund slips and test vend slips; the provision of such a system which eliminates the need to open the cash box in a vendor except to collect the money; the provision of such a system which can be used to selectively control access to sales and cash accountability data; the provision of such a system which can be used to control access to various machine functions; and the provision of such a system which is reliable, relatively inexpensive and relatively easy to maintain.

Briefly, the vendor accountability system of the present invention in one aspect includes a memory for storing data on the amount of cash which should be retained in the vendor out of cash deposited in the vendor, and also data on the amount of coin delivered to and from coin holding means in the vendor. The coin holding means holds coins for delivery in change to a customer. The data stored is for computation of the amount of cash which should be turned in by one who collects cash from the vendor. The system also includes logic means for controlling input of data to and retrieval of data from the memory, the logic means being operable to update in the memory the data for the computation. The system is designed for a vendor having means for handling cash deposited, which means is adapted to accept the coins and deliver them to the coin holding means if needed and otherwise to deliver them to a cash box.

In a second aspect, the vendor accountability system of this invention includes means including a set of function selectors for selecting one of a plurality of cash accountability functions to be carried out, a memory for storing data as to the functions, logic means for controlling input of data to and retrieval of data from the memory, and means for effecting programming of the system for controlling retrieval of data from the memory. The logic means is adapted for operation in response to operation of a function selector to enable carrying out the respective function. The logic means is operable upon carrying out of a function to effect storage in the memory of data on that function for subsequent retrieval.

In a third aspect the vendor accountability system of this invention includes means including a set of function selectors for selecting one of a plurality of cash accountability functions to be carried out, a memory for storing data as to the functions, and logic means for controlling input of data to and retrieval of data from the memory. The logic means is adapted for operation in response to operation of a function selector to enable carrying out of a respective function and is operable upon carrying out of a function to effect storage in the memory of data on that function for subsequent retrieval. The logic means is programmable to block the carrying out of one or more of the functions. The system further includes means for supplying a code to the logic means to unblock the carrying out of one or more of the otherwise blocked functions.

In a fourth aspect of this invention, the accountability system for a vendor having means for handling cash deposited, means for holding coins for delivery in change to a customer, and a cash box, includes a memory for storing data for an accounting for cash which should be turned in by one who collects cash from the cash box. The system also includes logic means for controlling input of data to and retrieval of data from the memory and means operable via the logic means to effect delivery of coin from the coin holding means for making refunds, the memory being adapted to store data as to the amount of such refunds as part of the data needed to determine the amount of cash which should be in the cash box. The logic means is responsive to operation of the refund means to update the refund data in the memory and is operable to retrieve data from the memory, whereby the amount of refunds made since the last collection may be determined and factored into the accounting to determine the cash which should be turned in.

In a fifth aspect of this invention, an accountability system for a vendor having means for handling cash deposited, means for holding coins for delivery in change to a customer, and a cash box, includes a memory for storing data for an accounting for cash which should be turned in by one who collects cash from the cash box and logic means for controlling input of data to and retrieval of data from the memory. The system further includes means operable via the logic means for testing by a service person of the cash handling means and a delivery means of the vendor. The service person deposits an appropriate amount of cash for the testing. The memory is adapted to store data as to the monetary amount of a delivery if the delivery means is tested. The logic means is responsive to the testing to effect delivery of coin from the coin holding means to reimburse the service person for the amount deposited, and to update in the memory the monetary amount of test deliveries.

In a sixth aspect of this invention, an accountability system for a vendor having means for handling cash deposited, means for holding coins for delivery in change to a customer, and a cash box, includes a memory for storing data for an accounting for cash which should be turned in by one who collects cash from the cash box and logic means for controlling input of data to and retrieval of data from the memory. The system also includes means for preventing unauthorized access to cash in the cash box and means operable via the logic means to enable access to the cash box. The memory is adapted to store data as to access to the cash box and operation of the access means via the logic means results in data as to the access being stored in the memory.

In a seventh aspect of this invention, an accountability system is disclosed for a vendor having means for handling cash deposited, means for holding coins for delivery in change to a customer, and a cash box. The system includes a memory for storing data for an accounting for cash which should be turned in by one who collects cash from the cash box and logic means for controlling input of data to and retrieval of data from the means. Means operable via the logic means enable free deliveries by the vendor. The memory is adapted to store data on the monetary amount of free deliveries. The logic means is responsive to a free delivery to update in the memory the data on the monetary amount of free deliveries.

In an eighth aspect of this invention, an accountability system for a vendor having means for handling cash deposited, means for holding coins for delivery in change to a customer, and a cash box, includes a memory and logic means. The memory stores data for an accounting for cash which should be turned in by one who collects cash from the cash box while the logic means controls input of data to and retrieval of data from the memory. The system also includes first means operable via the logic means for enabling free deliveries by the vendor to service persons and second means operable via the logic means for enabling free deliveries by the vendor to anyone. The memory is adapted to separately store data on the respective monetary amounts of each of the first and second types of free deliveries. The logic means is responsive to each free delivery to update in the memory the respective data on the respective monetary amounts of free deliveries of the first and second types.

In a ninth aspect of this invention, an accountability system for a vendor having means for handling cash deposited, means for holding coins for delivery in change to a customer, and a cash box, includes a memory, logic means and a payout means. The memory stores data for an accounting for cash which should be turned in by one who collects cash from the cash box. The logic means controls input of data to and retrieval of data from the memory. And the payout means is operable via the logic means to effect payout of coins from the coin handling means. The memory is adapted to store data as to the amount of payout and the logic means is responsive to operation of the payout means to update the payout data in the memory.

In another aspect of this invention, an accountability system for a vendor having means for handling cash deposited, means for holding coins for delivery in change to a customer, and a cash box, includes a memory, logic means and storing means. The memory stores data for an accounting for cash which should be turned in by one who collects cash from the cash box. The logic means controls input of data to and retrieval of data from the memory. And the storing means is operable via the logic means to store in the memory data as to the monetary amount of pulls from the vendor.

Other objects and features will be in part apparent and in part pointed out hereinafter.

BRIEF DESCRIPTION OF THE DRAWINGS

FIGS. 5A–5M are electrical schematics of the circuitry of the cash accountability system of this invention;

FIG. 17 is a flowchart for a routine of the microcomputer used in this invention in which it handles the presence of a reject or lockout type key;

FIG. 32 is the flowchart for a routine of the microcomputer used in this invention in which it responds to the actuation of a nickel switch;

FIG. 35 is the flowchart for a routine of the microcomputer used in this invention in which it responds to the actuation of the quarter switch; and FIG. 36 is the flowchart for a routine of the microcomputer used in this invention in which it responds to the actuation of the dollar switch.

Corresponding reference characters indicate corresponding parts throughout the several views of the drawings.

DESCRIPTION OF THE PREFERRED EMBODIMENT

Figure 1:
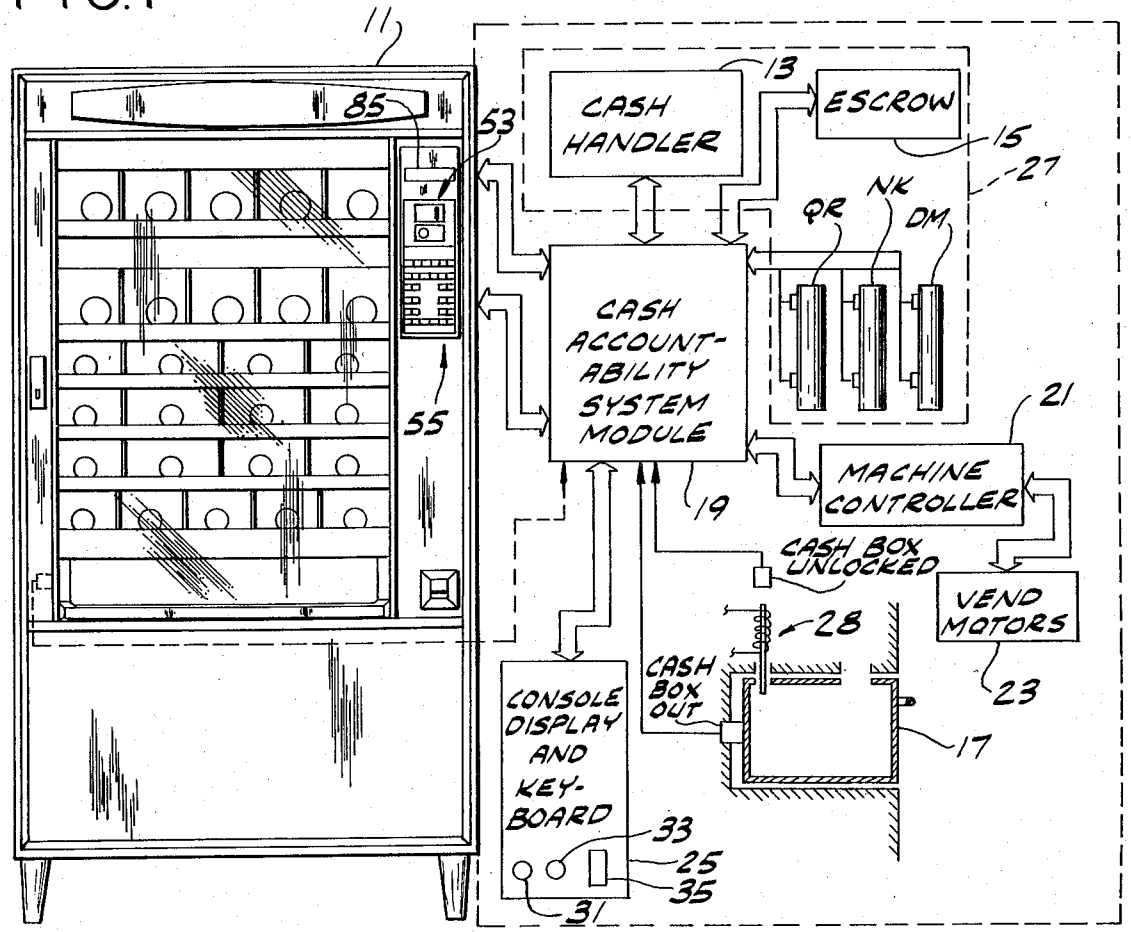
FIG. 1 is a front elevation of a vendor with internal detail and the cash accountability system of the present invention shown in block diagrammatic form adjacent thereto.
Figure 2:
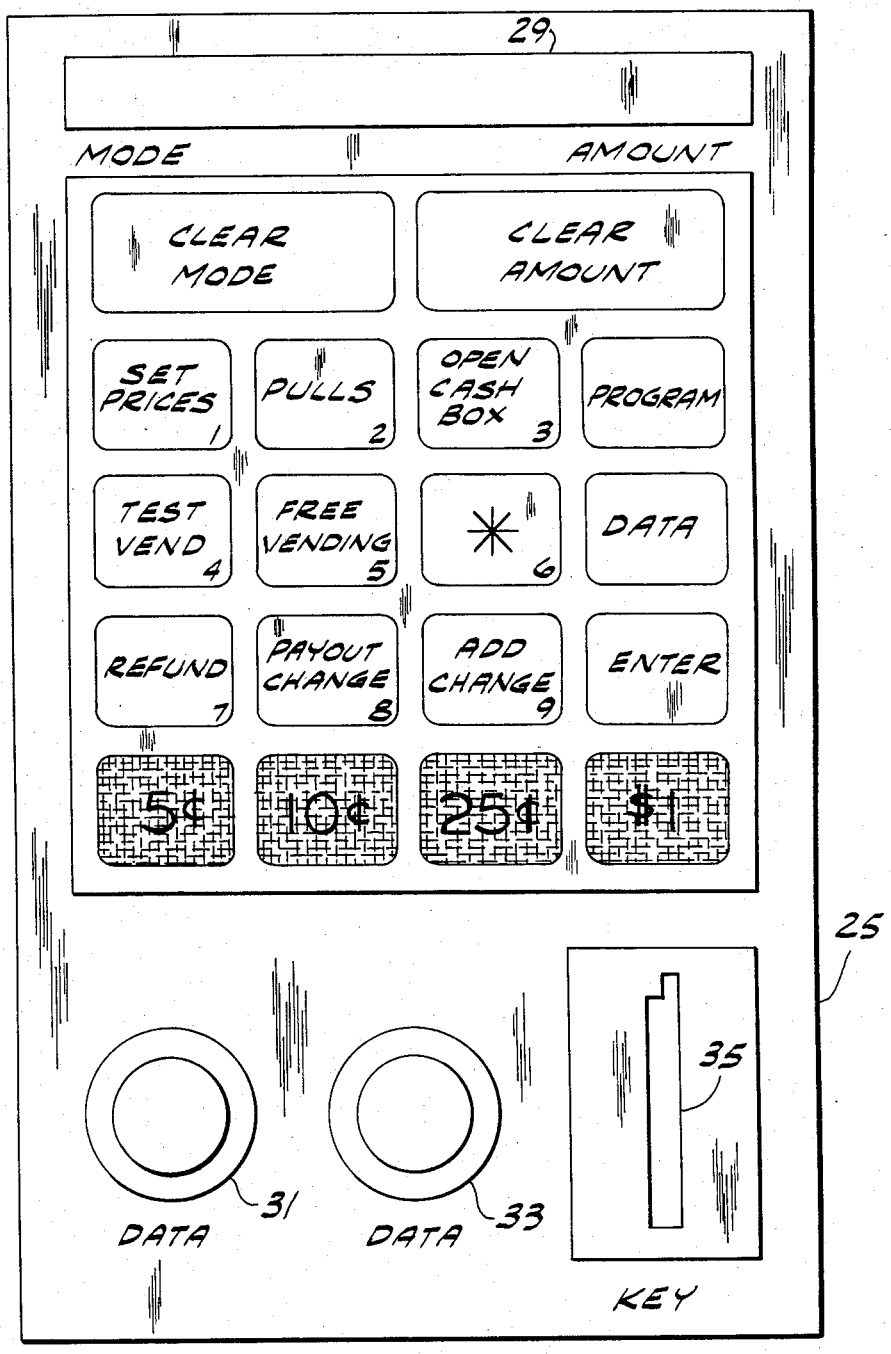
FIG. 2 is a front elevation of a keyboard console which is part of the cash accountability system of this invention.

Turning now to the drawings, there is shown in FIG. 1 a vendor 11 (shown as a multi-price spiral snack vendor) having a cash handler 13 constituting means for handling cash deposited in vendor 11, a set of nickel, dime and quarter change tubes NK, DM and QR constituting means for holding coins for delivery in change to a customer, an escrow 15 for temporarily holding deposited cash, and a cash box 17. The cash handler is adapted to accept coins and deliver them to the change tubes if needed and otherwise to deliver them to the escrow or the cash box. A cash accountability system module 19 of this invention is connected to the cash handler, escrow 15, the change tubes, and the cash box to control and record the movement of cash into and within the vendor. Cash accountability system module 19 is also connected to a machine controller 21 which is responsive to signals from the module to control the vend motors 23 of the vendor to vend items to customers. Although machine controller 21 is shown separately for purposes of illustration, it should be understood that module 19 and controller 21 can both be implemented in a single processor. That is, cash accountability system module 19 signals machine controller 21 whenever a vend is called for, such as whenever sufficient credit has been deposited to purchase an item. Machine controller 21 is not part of the present invention and will not be further described. Cash accountability system module 19 is also connected to a console display and keyboard 25 (shown in more detail in FIG. 2) which the service or route person uses to initiate various functions performable by the vendor. Although cash handler 13, escrow 15 and the change tubes are shown separately in FIG. 1, together they constitute a coin rejector/changer 27 of the vendor. Although the cash accountability system module and connected parts or systems are shown outside vendor 11 for clarity, in actuality they are all contained within vendor 11, which fact is indicated by the dashed line.

Means indicated generally at 28 in FIG. 1 is provided for preventing unauthorized access to cash in the cash box 17, provision being made as will appear for storing data pertaining to access to the cash box. As diagramatically illustrated in FIG. 1, this means comprises a solenoid-operated latch for latching the cash box in place in a cash box compartment in the vendor for receiving cash, the arrangement being such that access to cash in the box is blocked while the box is so latched in place. The latch is retracted on energization of its solenoid to enable it to be taken out of the vendor for access to cash in the box.

The console display and keyboard (see FIG. 2) includes a mode/amount display 29 for displaying to the service or route person the vendor's mode and a corresponding amount, a CLEAR MODE switch, a CLEAR AMOUNT switch, and a matrix of switches labelled SET PRICES, PULLS, OPEN CASH BOX, PROGRAM, TEST VEND, FREE VENDING, *. DATA, REFUND, PAYOUT CHANGE, ADD CHANGE, ENTER, 5¢, 10¢, 25¢, and $1. As will become apparent these switches are used by the service or route person to initiate vendor actions or the placement of the vendor in given modes. At the bottom of console display and keyboard 25 are two data ports 31 and 33 over which data from the cash accountability system can be supplied to infrared or magnetic probes for collection and subsequent analysis. To the right of the data ports is a key hole or slot 35 for receiving a number of different types of keys 37 (see FIG. 3).

There are four general types of keys 37 usable with the cash accountability system of this invention—a data key, a programming key, a clearing key, and a reject or lockout key. These keys all have the same general configuration shown in FIG. 3, namely three rows 39A, 39B and 39C, each having a plurality (for example, eleven or twelve) of codable positions. Each position is made transparent or opaque to infrared radiation as desired so that binary information is encoded into each position. For example, on the data key the first ten positions of row 39A from the bottom of the key can be encoded to provide up to 1023 different key series numbers. The cash accountability system for each operator (i.e., owner of vending machines) can be programmed to accept only keys of the series belonging to that operator so that an employee of one operator will not have access to the data from another operator's vendor. The topmost position in row 39A is always encoded (which is why it is represented by a solid dot) to represent whether or not the holder of that particular key is authorized access to the cash box. As will become apparent, only a person with a suitably encoded key is able to unlatch the cash box and thereby gain access to it. Similarly the lowermost eight positions of row 39C of a data key may be coded to represent up to 254 different key identification codes, thereby enabling operators to issue each employee a key with a unique identification code or number. This permits the cash accountability system to uniquely identify the key used to initiate various functions. For example, the cash accountability system of this invention can record in recallable memory the identification number of a data key used to gain access to the cash box so that the responsibility for any shortages in the cash box can be determined. The next three positions of row 39C are coded to verify the key identification code, using one of a number of well-known validation schemes. If the verification code of a data key does not correspond to the identification number on that key, the key has been tampered with and the cash accountability system will not recognize it as a valid key. The topmost position of row 39C is used to determine whether a key provides access to the display of sales and cash data held in the cash accountability system memory. For example, if the operator does not want the sales and cash data to be visually displayed on display 29 to the user of a given key, he simply encodes the topmost position of row 39C to prohibit access to that data. Such a user can retrieve this data using a probe, but he or she will have no way of seeing the data being retrieved. The provision of separate coding positions for allowing access to the cash box and to the sales and cash data permits an operator to issue keys to many employees who can have access to different machine functions while at the same time limiting access to the cash box and/or stored sales and cash data to only a few, authorized persons.

Row 39B of the data key is used to synchronize reading of the key by the system. For example, once the first position in row 39B is detected, the system then reads the corresponding position in rows 39A and 39C to detect the information encoded there. As the key is inserted into slot 37, the system sequentially reads the information in rows 39A and 39C as the corresponding positions in row 39B are detected.

Figure 3:
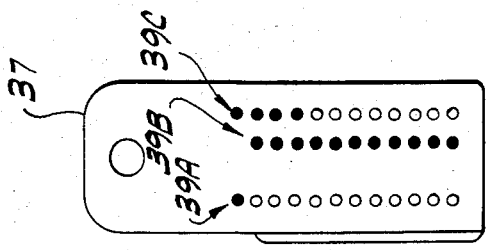
FIG. 3 is an elevation of a coded key for use with the cash accountability system of this invention.

Although a number of different coding systems could be used in key 37, a simple binary coding scheme provides a great deal of versatility. In one such scheme, the least significant binary digit is at the bottom of each row as shown in FIG. 3 and the significance of the digits increases within each field as the top of the key is approached. For example, if the lowermost position of row 39A is coded, e.g., is transparent to some detecting radiation, that position represents a 1 (decimal). The next position if coded represents a 2 (decimal), the third a 4 (decimal), and so on. Of course if the position being read is not coded, the corresponding number is a zero. It can be seen that the lowermost 10 codable positions when read supply to the system a binary representation of a key series code number which can be from 0 to 1023 (decimal) depending upon the number and location of coded positions. For a key with coding in row 39A at the second, fifth, eighth and tenth positions the key series number is $2+16+128+512=658$. This number must correspond to the key series number programmed into a specific operator's cash accountability system in order for the data key to be accepted by the system as a valid key. The same coding scheme is used to code the key identification number in row 39C.

The coding scheme of the key identification number verification code in positions 9–11 of row 39C is also binary but does differ in some respects from the coding scheme described above. In reading these positions the system registers a count of 1 if no coding is present in the ninth position, a count of 2 if no coding is present in the tenth position, and a count of 4 if no coding is present in the eleventh position. The system totals these counts and compares the total with the number of coded positions in positions one through eight of row 39C. If the total equals the number of coded positions, the identification number is verified. Otherwise the key has been tampered with and it is rejected.

It is anticipated that some service persons might attempt to circumvent the codes built into the data keys by, for example, blocking out one of the key identification number coded positions to change the number. But to have a valid key, that person would also have to code one of the verification code positions to correspond to the new number of coded identification number positions and this coding of the verification code position would deface the key. Should an operator suspect a key identification code has been altered, he can determine this simply by recalling the key and seeing if it has been defaced. It should be appreciated that other attempts to circumvent the codes would also be detectable either by the operator or the cash accountability system itself. Although one particular coding arrangement of key 37 has been described, other arrangements could also be used, additional numbers of coded positions could be added to provide larger numbers of key series and identification numbers, and other coding schemes could be used.

Data keys are distinguished from programming keys, clearing keys and reject or lockout keys by the key series number. As an example, operators can be supplied with keys having series numbers from one through 800. All programming keys have a unique key series code outside that range, e.g., 1001, and clearing keys and reject or lockout keys also have their own, unique key series numbers outside that range. A programming key is used by operators, regardless of the key series code programmed into the cash accountability system for data keys, to program the cash accountability system. The clearing key is used in connection with a number code entered via the keyboard to clear all data out of a machine when it is being sold to another to prevent the buyer from giving access to that data. And the reject or lockout key is used to disable the key of an ex-employee. For example, if an employee leaves taking key 120 with him, the operator simply inserts the lockout key in slot 35, enters 120 via the keyboard and subsequently the cash accountability system in that vendor will not accept key 120 as a valid key.

A number of different constructions of key 37 are possible. In one, these keys consist of three parts: a front key blank fabricated from a material which is transparent to infrared light from a light-emitting diode (LED), a rear key blank fabricated from the same material, and a codable insert fabricated from a material which is opaque to the infrared light. The codable insert has holes therein at the positions in rows 39A, B and C corresponding to the desired codes and numbers for the key being constructed. Once the holes are in the insert, it is placed between the front and rear key blanks and the assembly is welded or otherwise suitably secured together to form a key. Note that if the front and rear blank material is suitably selected to be transparent to the infrared light, or whatever radiation is being used to detect the coded positions, but is opaque to visible light, the coding on the key will be unknown to its user unless he or she defaces the key by breaking it apart to view the coded insert. A second possible construction of key 37 is simpler but somewhat less secure. In this construction, the key consists of a single blank fabricated from a material opaque to the sensing radiation, which blank has holes added at the desired codable positions. Other constructions are of course possible.

Figure 4:
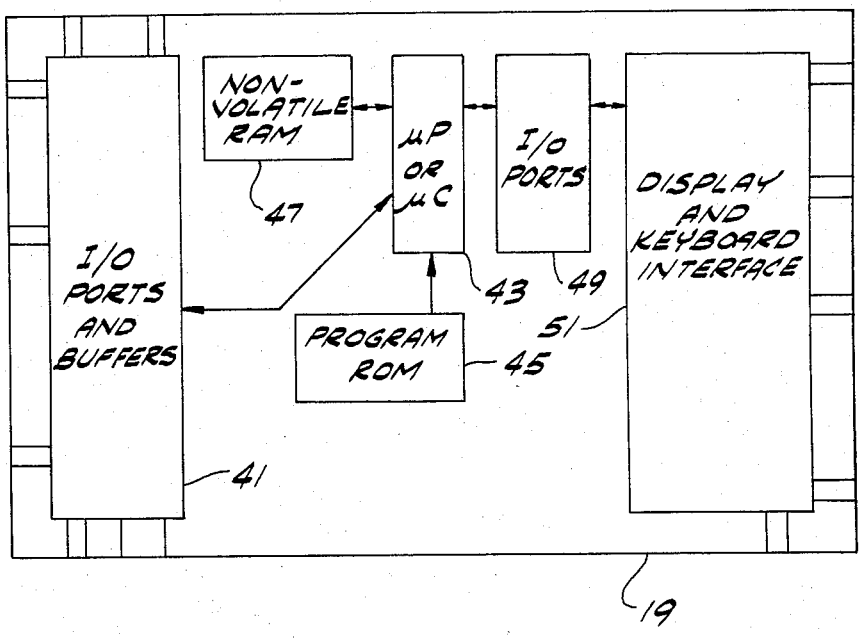
FIG. 4 is a block diagram of the cash accountability module portion of the present invention.

Cash accountability module 19 (see FIG. 4) includes input/output ports and buffers 41 for interfacing with coin rejector/changer 27, any bill acceptors (not shown), the machine controller 21, and the cash box solenoid. The coin rejector/changer is preferably a "dumb" type unit such as the unit sold under the trade name Series 710 by Mars, Inc., of McLean, Va. or the unit disclosed in coassigned application Ser. No. 316,078, filed Oct. 29, 1981. Basically, these dumb units are controlled by module 19. They send signals to the module representing the validity and denomination of coins inserted as well as the status of the change tubes and the module in response instructs the dumb unit whether to accept the coin or not and where to route the coin if accepted.

Module 19 also includes a microprocessor or microcomputer 43, a read-only-memory (ROM) 45 for holding the program for microprocessor 43, and a non-volatile random-access memory (RAM) 47 for storing data on the amount of cash retained in the vendor and delivery of coin to and from the coin holding means (i.e., the change tubes) for computation of the amount of cash which should be turned in by one who collects cash from cash box 17. Microcomputer 43 constitutes means for controlling input of data to and retrieval of data from RAM 47, which microprocessor is responsive to the amount retained and delivery of coin to and from the change tubes to update in RAM 47 the data for the computation of cash to be turned in. Microcomputer 43 is also connected through a second set of input/output ports 49 to a display and keyboard interface 51 which in turn is connected to console display and keyboard 25, various customer displays 53 (see FIG. 1) located on the front of the vendor, and a product selection keyboard 55 (see FIG. 1) by which the customer selects items to be vended. Although a number of different microprocessors or microcomputers could be used, excellent results have been achieved with a microcomputer sold under the trade designation 8031 by Intel Corporation.

The circuitry of cash accountability module 19 is shown in more detail in FIGS. 5A–5M. Microcomputer 43 (see FIGS. 5A and 5B) is connected via a line L1 to one input of an AND gate G1, the other input of which is connected to the output of a 2.4 KHz oscillator 59. When microcomputer 43 causes line L1 to be at +5 V or so (a logic High) the AND gate is enabled and the oscillator output is allowed to pass from AND gate G1 over a line L3 to a plug P1 (see FIG. 5D) connected to a beeper (not shown) which audibly indicates to the service person or other user that some operation, function or task has been accomplished or as a warning.

One interrupt pin INT1 of microcomputer 43 is connected via a line L5 to the circuitry labeled 61 for accepting signals from a magnetic data probe and via a line L7 to circuitry labeled 63 (see FIG. 5F) for reading key 37. When either a magnetic data probe starts signalling module 19 via port 33 (see FIG. 2) or the key reader begins reading a key, that fact is supplied to microcomputer 43 via interrupt pin INT1 and the appropriate interrupt sequence is initiated. The signal from the magnetic data probe is also supplied from circuitry 61 via line L5 to interrupt pin INT1. Data from the magnetic probe, therefore, passes from circuitry 61 over line L5 to microcomputer 43. Microcomputer 43 in turn supplies data from a serial output pin TXD, via a line L9 and circuitry 61, to the magnetic probe. Thus, it can be seen that communication between a magnetic data probe and microcomputer 43 is accomplished over circuitry 61 and pins TXD and INT1.

Pin TXD also has another function, namely transmitting data to infrared probe port 31. More particularly data to be sent to an infrared data probe is supplied via pin TXD to an inverter 63, the output of which is connected to an input of an AND gate G3. The other input of gate G3 is connected to a 30 KHz oscillator 65. When the output of gate G3 goes High, as controlled by microcomputer 43, the outputs of two inverters 67, 69 connected thereto go Low, causing an infrared-emitting LED to light, which light is supplied over port 31 to the infrared data probe.

Data from the infrared data probe passes through port 31 to a phototransister Q1 (see FIG. 5B) connected through a comparator 71 to an LS123 type one-shot configured as a demodulator 73. The output of demodulator 73 is buffered and supplied to a serial input pin RXD of microcomputer 43. Thus, microcomputer 43 uses pins TXD and RXD to communicate with infrared data probes. Two pins of the microcomputer labelled XTAL1 and XTAL2 are connected to a 11.52 MHz crystal to provide synchronizing signals for the microcomputer.

A reset pin RST of microcomputer 43 is connected via an inverter 75 to a circuit 77 which protects RAM 47 and a circuit 79 which causes a reset of the system whenever the power drops unacceptably. A watchdog circuit 81, including an LS123 type one-shot chip 83, is connected to power reset circuit 79 to cause a reset if the watchdog circuit does not receive a pulse over a line L13 every 500 ms.

Microcomputer 43 includes a set of output pins P12–P17 connected via buffers to a plug P3 (see FIG. 5C) and a pin P11 connected to a circuit 83 (see FIG. 5D) which controls the supply of power to a customer display 85 of vendor 11, which display is one of external customer displays 53 (see FIG. 1). For clarity, the pin numbers of these pins are used to label the lines connected thereto. The signals on pins P12–P17 are to the dumb coin unit and control acceptance of coins by the unit, sending coins to the cash box, resetting the unit, and the dispensing of nickels, dimes and quarters, respectively.

A second interrupt pin INT0 is connected to plug P3 via two lines PF1 and PF2 and suitable buffers to accept a power failure interrupt signal from the power supply and to suppress such an interrupt respectively.

Figure 5A:
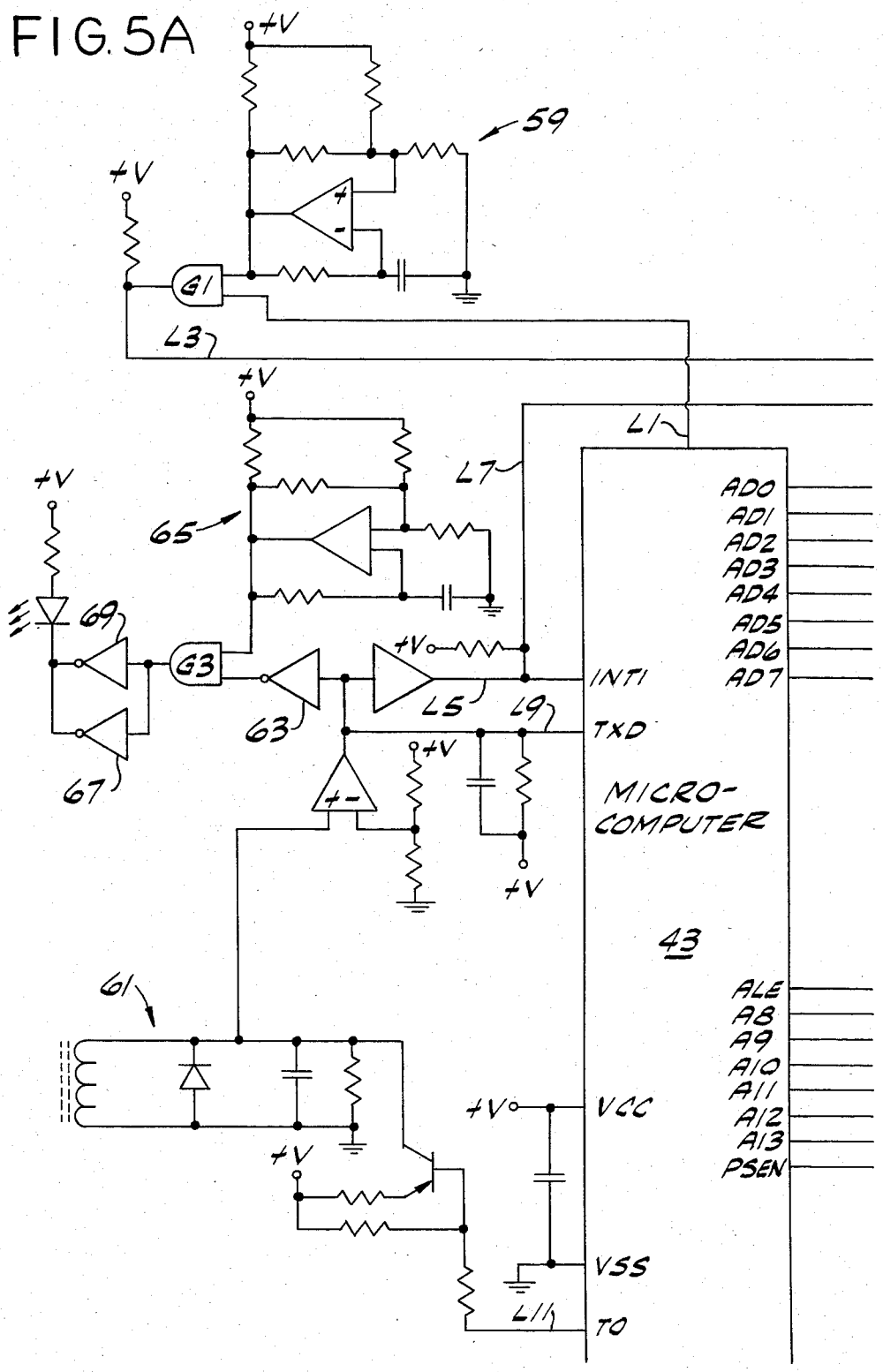
Figure 5B:
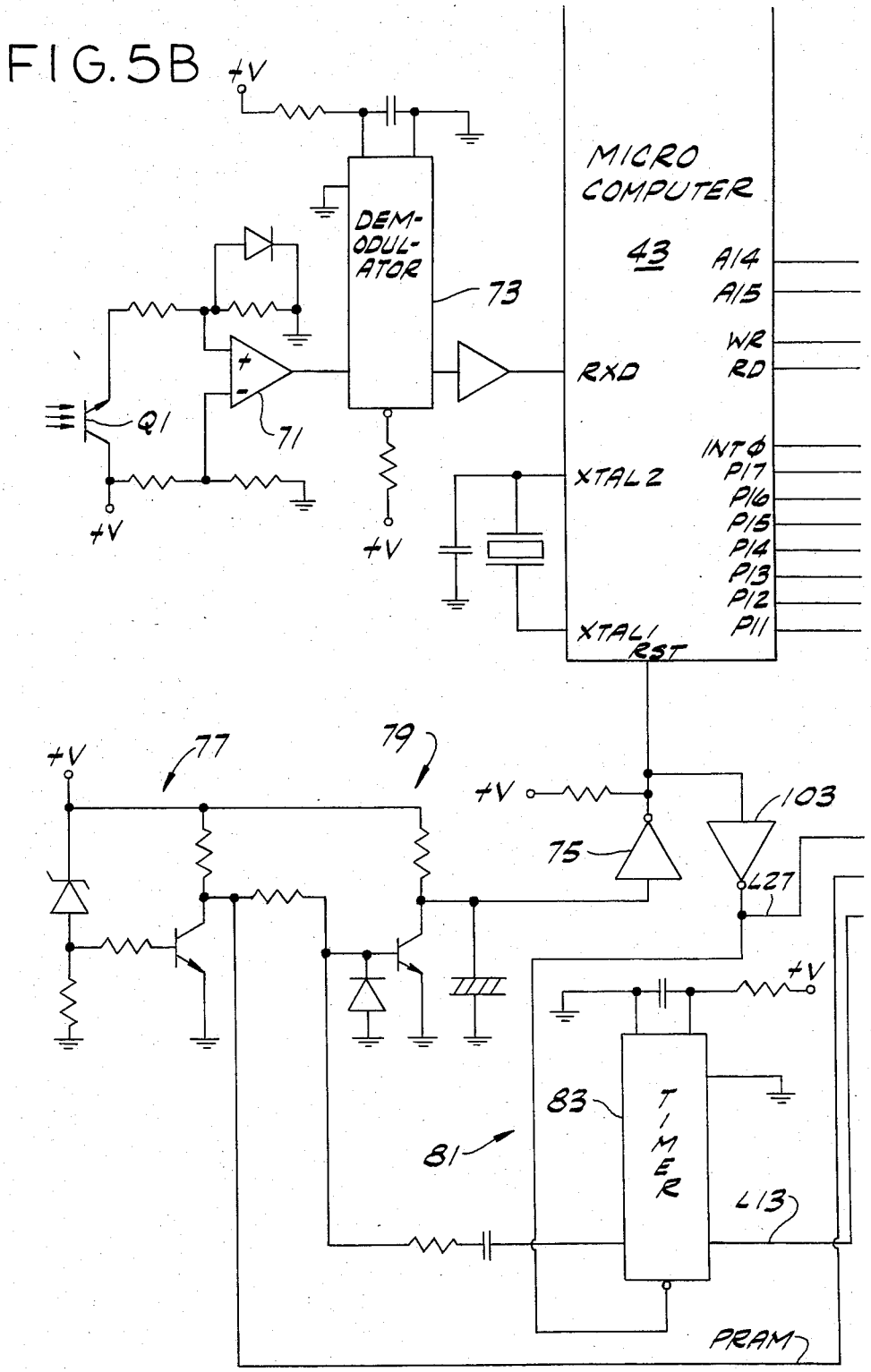

The read and write control pins, labelled RD and WR, of microcomputer 43 are connected to the inputs of an AND gate G7 (FIG. 5C) whose output controls the enabling of a 3-to-8 decoder 85, which for example is an LS-138 type decoder. Address pins A14 and A15 of the microcomputer are connected to the inputs of another AND gate G9 whose output is connected to pin 4 of decoder 85. The three inputs to decoder 85 which are to be decoded come from address pins A11, A12 and A13 of microcomputer 43 (FIG. 5A).

Figure 5C:
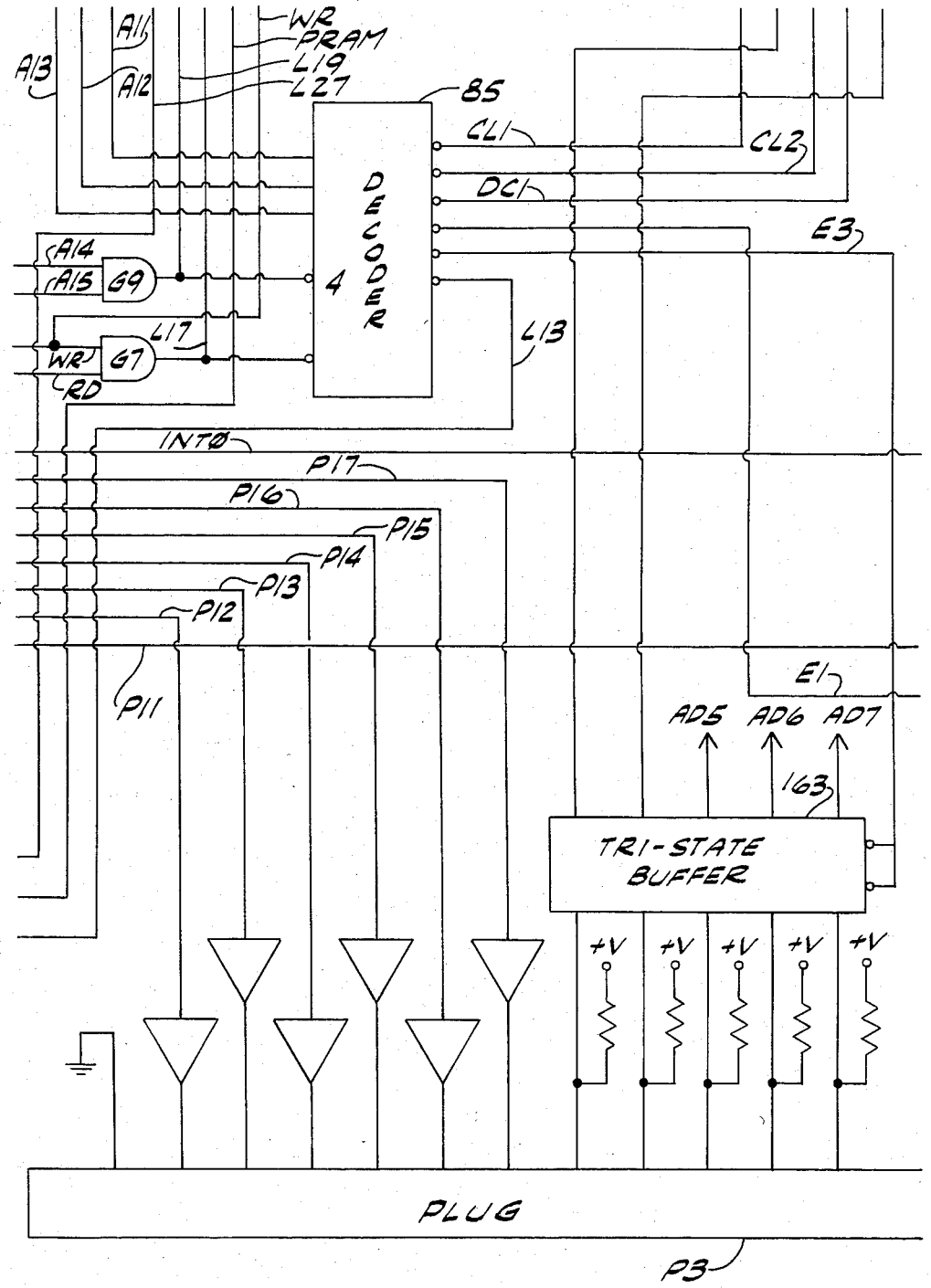
Figure 5D:
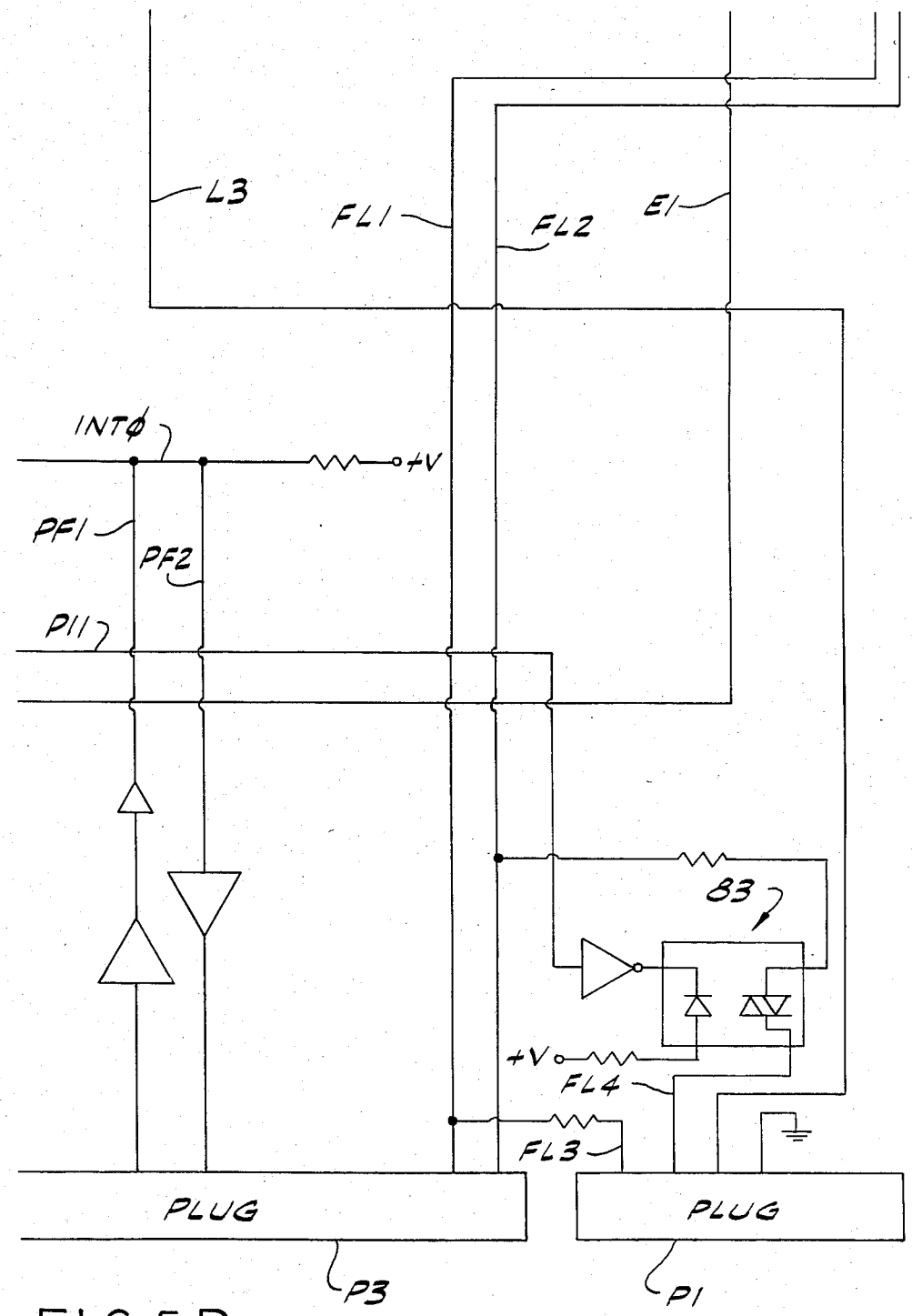
Figure 5E:
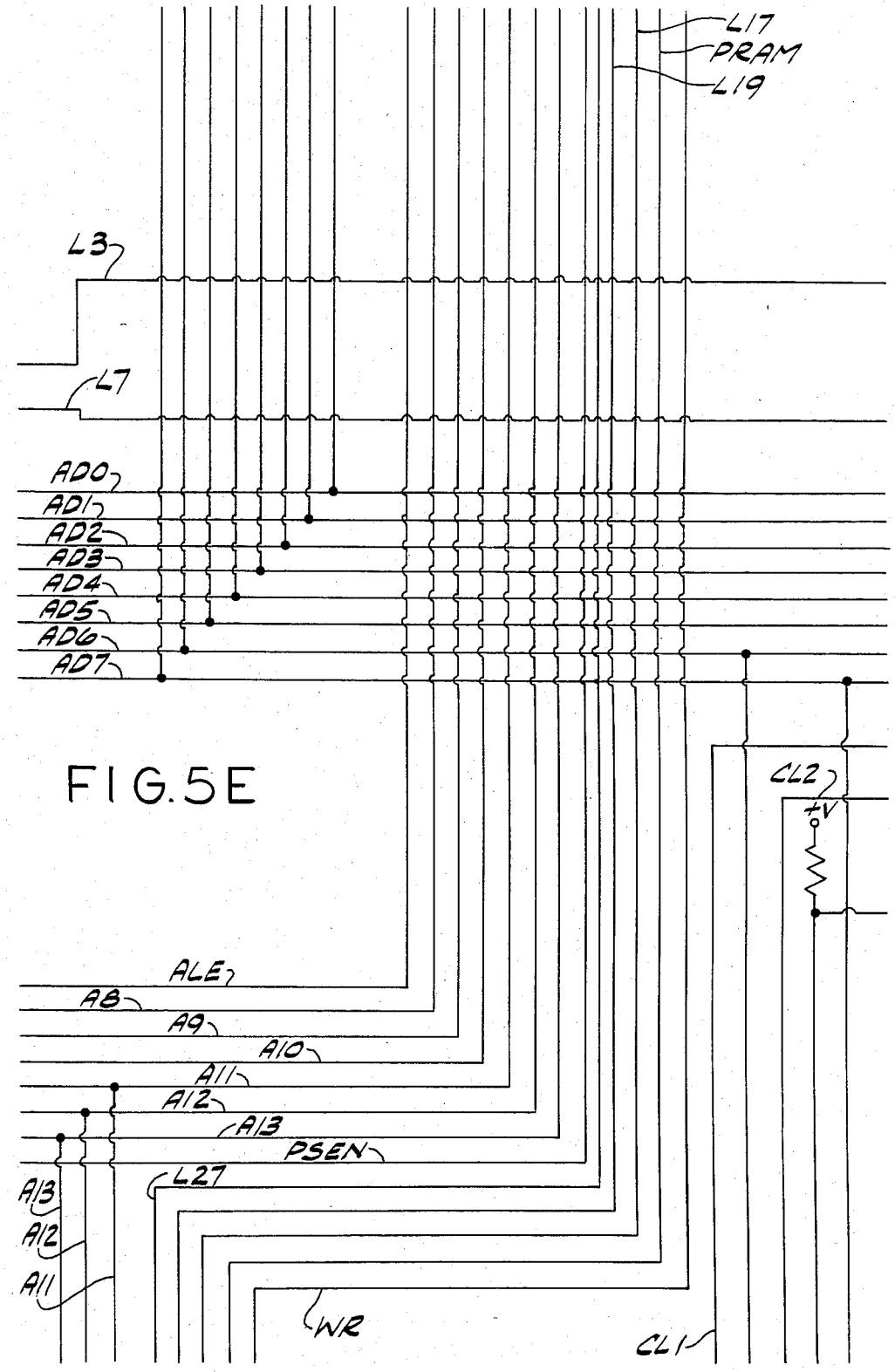

Microcomputer 43 also includes a program store enable pin PSEN which provides control signals to enable external program memory during normal fetch operations. This pin is connected through a plug P5 (FIG. 5H) to program ROM 45 (FIG. 5I). Address pins A8–A12 are all also connected via plug P5 to ROM 45. Pins A8–A11 are connected to the corresponding address pins on ROM 45, which is shown as two 2732A-type 4K by 8 memory chips 87 and 89. Address pin A12 is connected to the chip select pin of chip 87 and, through an inverter 91, to the chip select pin of chip 89. Because of the inverter in the circuit, address line A12 is used to simultaneously select one of the ROM chips while deselecting the other. Microcomputer 43 also icludes an address latch enable pin ALE which is connected through plug P5 to the enable pin of a 74LS373-type latch 91 (FIG. 5I). The latch takes an eight-bit address (supplied from eight address/data pins AD-0–AD7 of the microcomputer via plug P5) and latches it, with its output being supplied over eight lines LA0--LA7 to ROM 45 and RAM 47. More specifically lines LA0–LA7 are connected to the A0–A7 address pins of ROM chips 87 and 89 (FIG. 5I) and to the A0–A7 address pins of a 6514-type RAM chip 93 (FIG. 5L).

Write pin WR, mentioned above, is also connected through plug P5 to an inverter 95 connected through a resistor to the base of an NPN transistor Q5 (FIG. 5I). The emitter of transistor Q5 is connected via a line L20 to the write enable pin of RAM chip 93 (FIG. 5L) and its collector is connected to a line PRAM which is normally Low. The signal on write pin WR is supplied to the write enable pin whenever it is desired to write data to RAM chip 93. Line PRAM is connected to power out reset circuitry 77 (FIG. 5B) and is used in the process of protecting the RAM during power down.

On FIG. 5I, address/data pins or lines A0–A7 and address lines A10–A12 are shown for clarity as joined together in a single bus structure B1. At the top of FIG. 5I, the bus splits into eight individual lines labelled D0–D7, which are connected to the data pins of ROM chips 87 and 89. Pins D0–D7 are connected to microcomputer pins AD0–AD7, so the program stored in these chips is supplied to the microcomputer from data pins D0–D7 of the ROM chips.

Address lines A10–A12 are shown near the bottom of FIG. 5I splitting off from bus B1 to connect to the address input pins of a 74LS138-type decoder 97. The enable pins of decoder 97 are connected by way of plug P5 to a line L17 (whose signal level represents the logic AND of the write pin WR and the read pin RD of microcomputer 43), to address line A13, and to a line L19 (whose signal level represents the logic AND of the signals on address pins A14 and A15).

The topmost output of decoder 97 is used to select RAM chip 93. This output is inverted by an inverter 99 and thereafter supplied to the base of an NPN transistor Q7 whose collector is conncted via a line L21 to the chip select pin of RAM chip 93 (see FIG. 5L). The emitter of transistor Q7 is connected to line PRAM. The next output of decoder 97 from the top is used to clock a 74LS273-type latch 99 (FIG. 5J). This output is supplied via a line L23 to the clock input of latch 99. Likewise the third output of decoder 97 from the top is supplied over a line L25 to the clock input of a latch 101 (FIG. 5J). Latches 99 and 101 have their clear pins connected via a line L27, plug P5 and an inverter 103 to the reset pin of the microcomputer. The lowermost output of decoder 97 enables a four-output tri-state buffer 105.

The four outputs of tri-state buffer 105 are connected to lines AD0–AD3 of bus B1. Bus B1 also has lines, namely AD0–AD7, connected to the data inputs of latches 99 and 101. The outputs of latches 99 and 101 control the energization of vend motors 23. These vend motors are arranged, for example, in a matrix configuration, so latches 99 and 101 control the completion of circuits through the rows and columns of the vend motor matrix. The outputs of latch 99 and the three leftmost outputs of latch 101 are connected to the inputs of current sinks, generally labelled 109 (FIGS. 5J and 5K), whose outputs C0–C10 are conected to the columns of the vend motor matrix. The solenoid for solenoid latch 28 is also shown on FIG. 5K and can be considered as part of the vend motor matrix. Of course, the position of the solenoid in the matrix can be varied at will by the designer, or it can be energized in some other manner independent of the vend motor matrix. When the output of a current sink is Low, it completes a circuit through the vend motor or (solenoid) in its respective column which is in the row of vend motors being energized. Energization of a row of the vend motor matrix is accomplished using the remaining five outputs of latch 101. These outputs are connected via five lines R0–R4 to MC 1413-type current sinks 111 (FIG. 5K) whose outputs are connected to the bases of five row-driving PNP transistors Q11. The emitters of these transistors are connected to line L31 which is at a predetermined voltage sufficient to energize the vend motors, while the collectors of transistors Q11 are connected through a plug P7 to the corresponding rows of the vend motor matrix. Also shown on FIG. 5K is a circuit 113 for sensing the current drawn by the rows in the vend circuit matrix. The output of this sensor circuit is supplied via a line L31 to the inverting input of an op amp 115 (FIG. 5I) whose output is supplied to tri-state buffer 105. The current for the columns of the vend motor matrix is also sensed, by a sensor circuit 117 (FIG. 5I), and the output of this sensor circuit is also supplied to tri-state buffer 105. The other two inputs to tri-state buffer 105 are the outputs of an op amp 119, whose input on a line L32 represents the status of the sold-out sensor for that selection, and the output, via a line L33, of a low battery sensor circuit 120 (FIG. 5L).

Lines AD0–AD3 of bus B1 are also connected to the data input pins of RAM chip 93 (FIG. 5L). Data is written to and read from chip 93 over these lines of bus B1 and the particular memory location to be read or written to is selected by the address on lines LA0–LA7, A8 and A9. Also shown on FIG. 5L is a power-circuit 121 for RAM chip 93 including a lithium backup battery 123 (connections for two are shown) which keep data from being lost out of RAM when power is out.

Key reading circuitry 63 (FIG. 5F) includes three optoelectronic sensors 63A, 63B, 63C each consisting of a light-emitting diode (LED) D3 and an NPN phototransistor Q15. Each sensor reads the corresponding row of key 37 as the key is inserted in slot 35. The output of sensors 63A and 63B is supplied via inverters 125, 127 to two buffers 129, 131 and to a tri-state buffer 133. The output of sensor 63C is also supplied to buffer 133 but not to buffers 129 or 131. The outputs of buffers 129 and 131 are tied together to line L7 and are connected thereby to interrupt pin INT1 of microcomputer 43. The outputs of tri-state buffer 133 are supplied to pins AD0–AD2 of microcomputer 43.

Figure 5F:
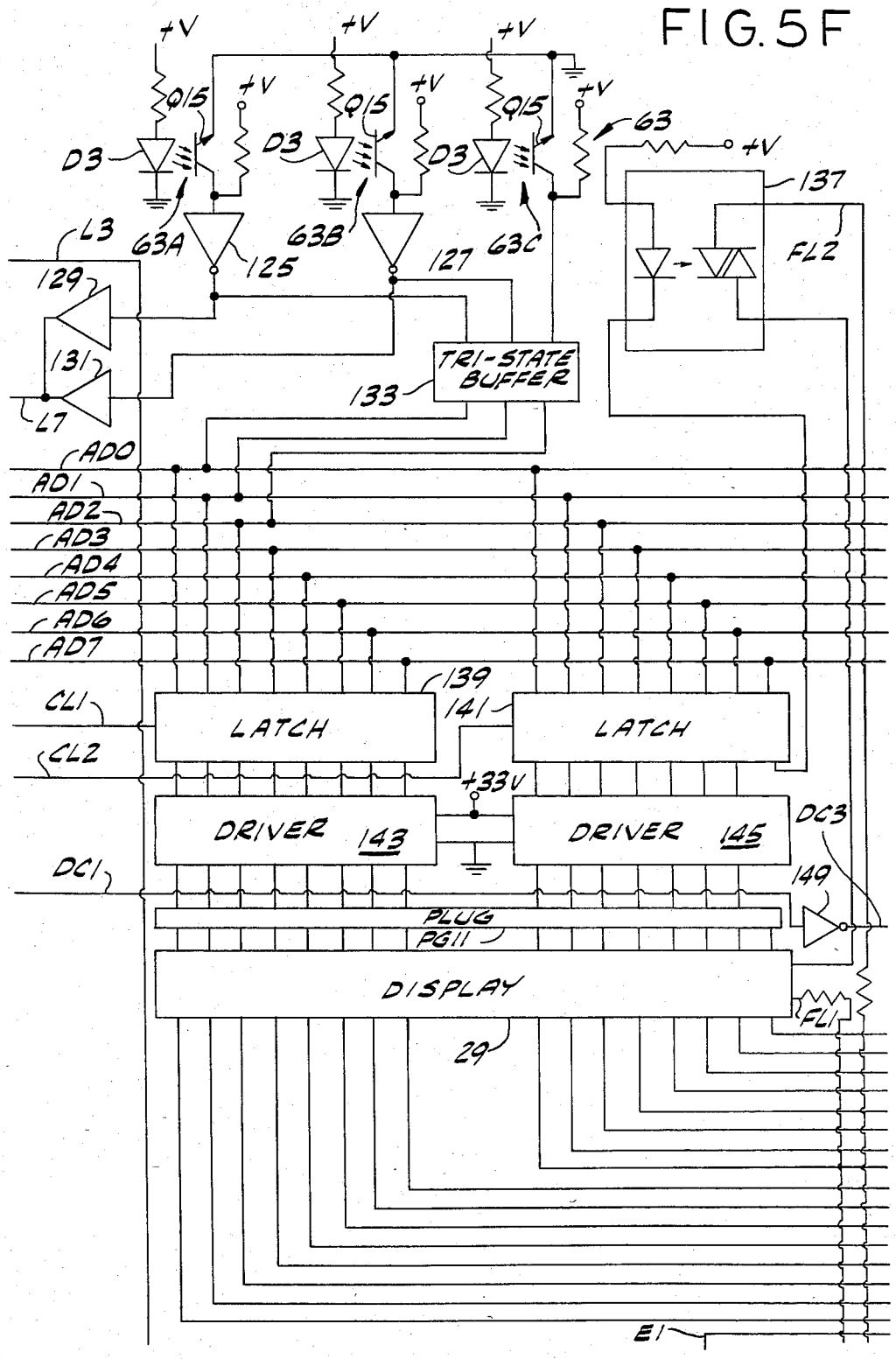

Also shown on FIG. 5F is a circuit 137 used for cutting off power to internal display 29, a pair of LS273-type latches 139, 141 for latching in the data to be displayed on internal display 29 and external display 85, two 6118-type drivers 143, 145 for the displays, a plug PG11 for connecting the output of drivers 143 and 145 to both displays (only the connection to the internal display is shown), and display 29 itself (preferaby a FIP 16A5R-type vacuum fluorescent display). The data to be displayed is supplied to latches 139 and 141 over lines AD0–AD7 from microcomputer 43 and the latches are clocked as needed over lines CL1 and CL2 respectively from decoder 85 (FIG. 5C). The outputs of latches 139 and 141 are supplied to drivers 143 and 145 respectively, except for the rightmost output of latch 141 which is connected to power-cut-off circuit 137. Drivers 143 and 145 in turn supply the data to display 29, and via plug PG11 to the external display. The displays are selected or not by means of circuits 83 (FIG. 5D) and 137 (FIG. 5F) which control the supplying of power to the displays over a pair of lines FL1, FL2 (for display 29) and FL3, FL4 (for the external display).

Figure 5G:
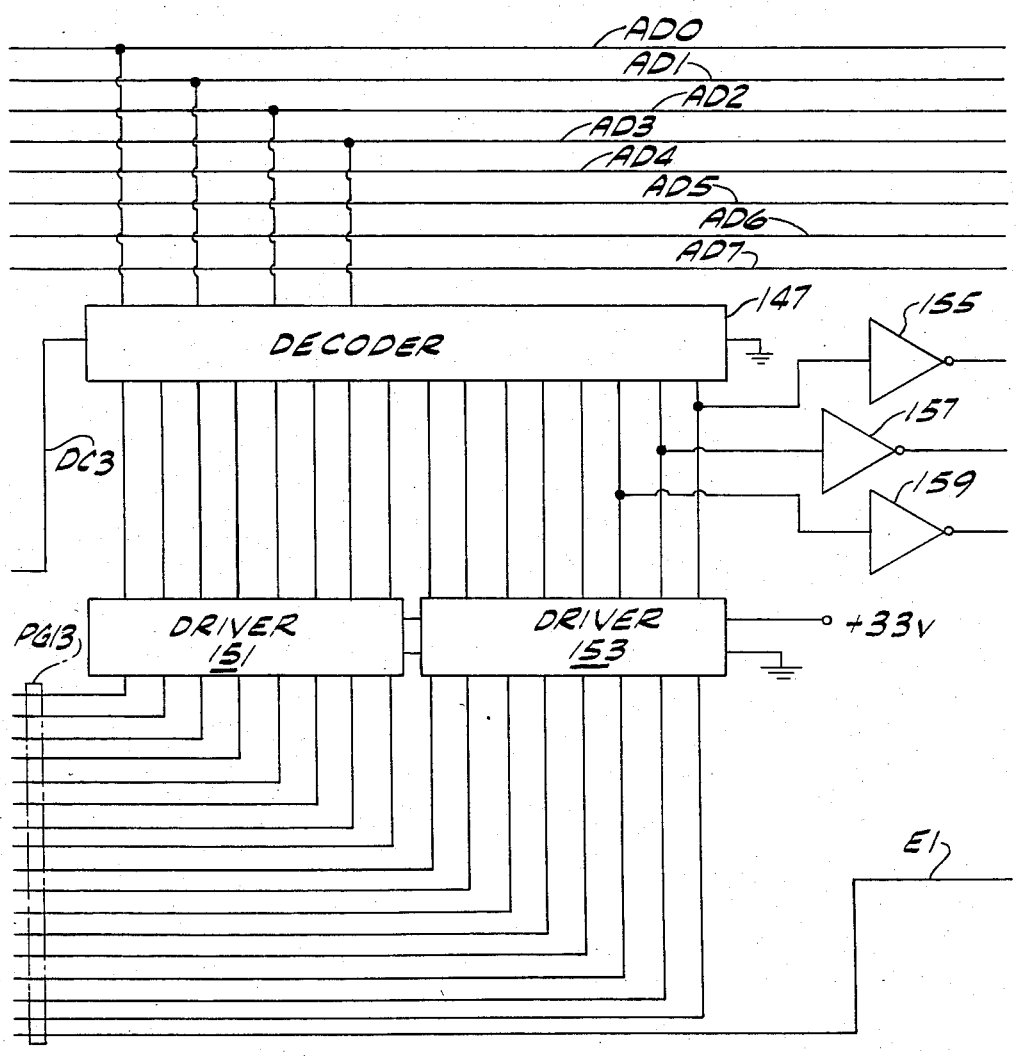
Figure 5H:
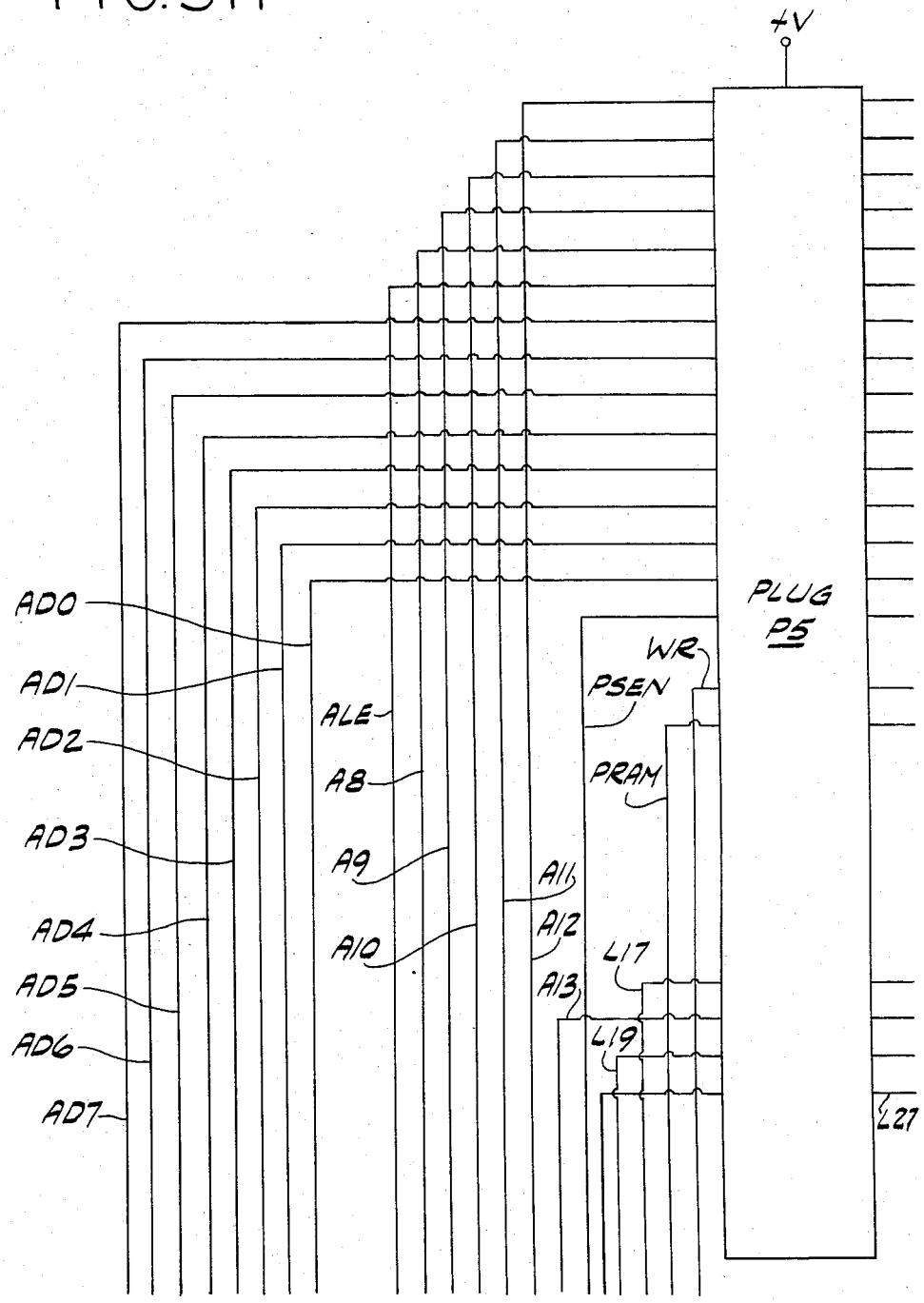
Figure 51:
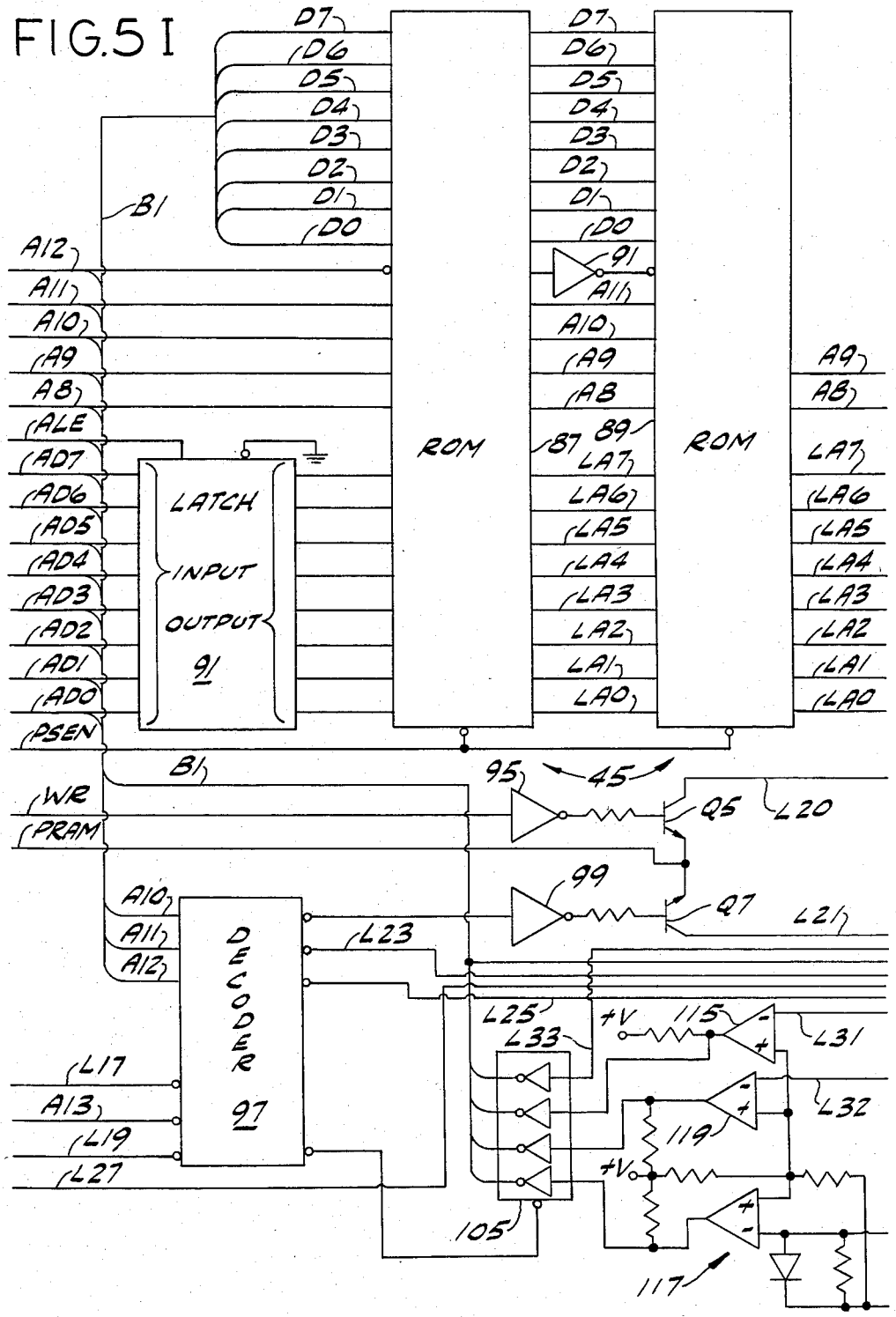
Figure 5J:
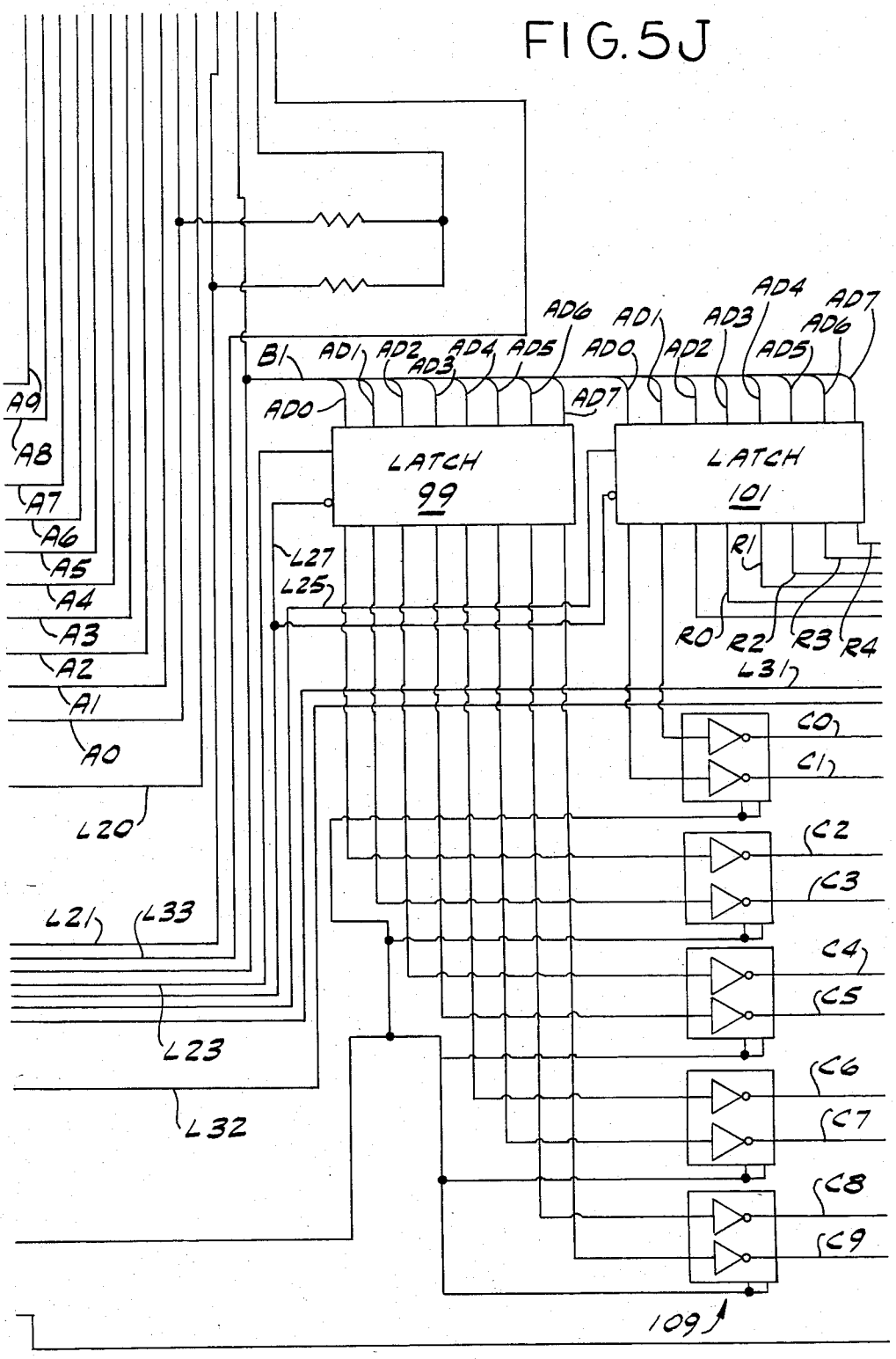
Figure 5K:
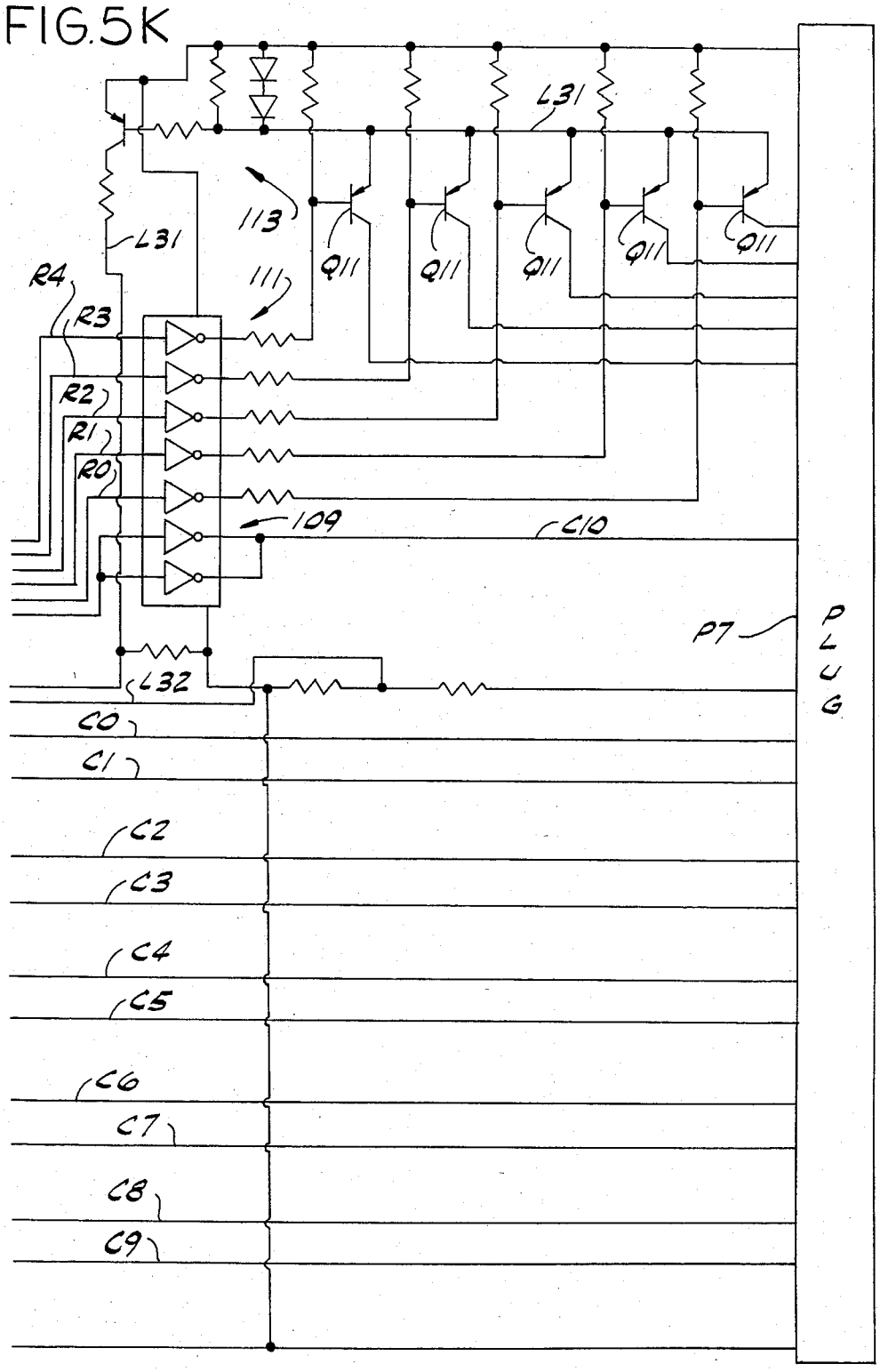
Figure 5L:
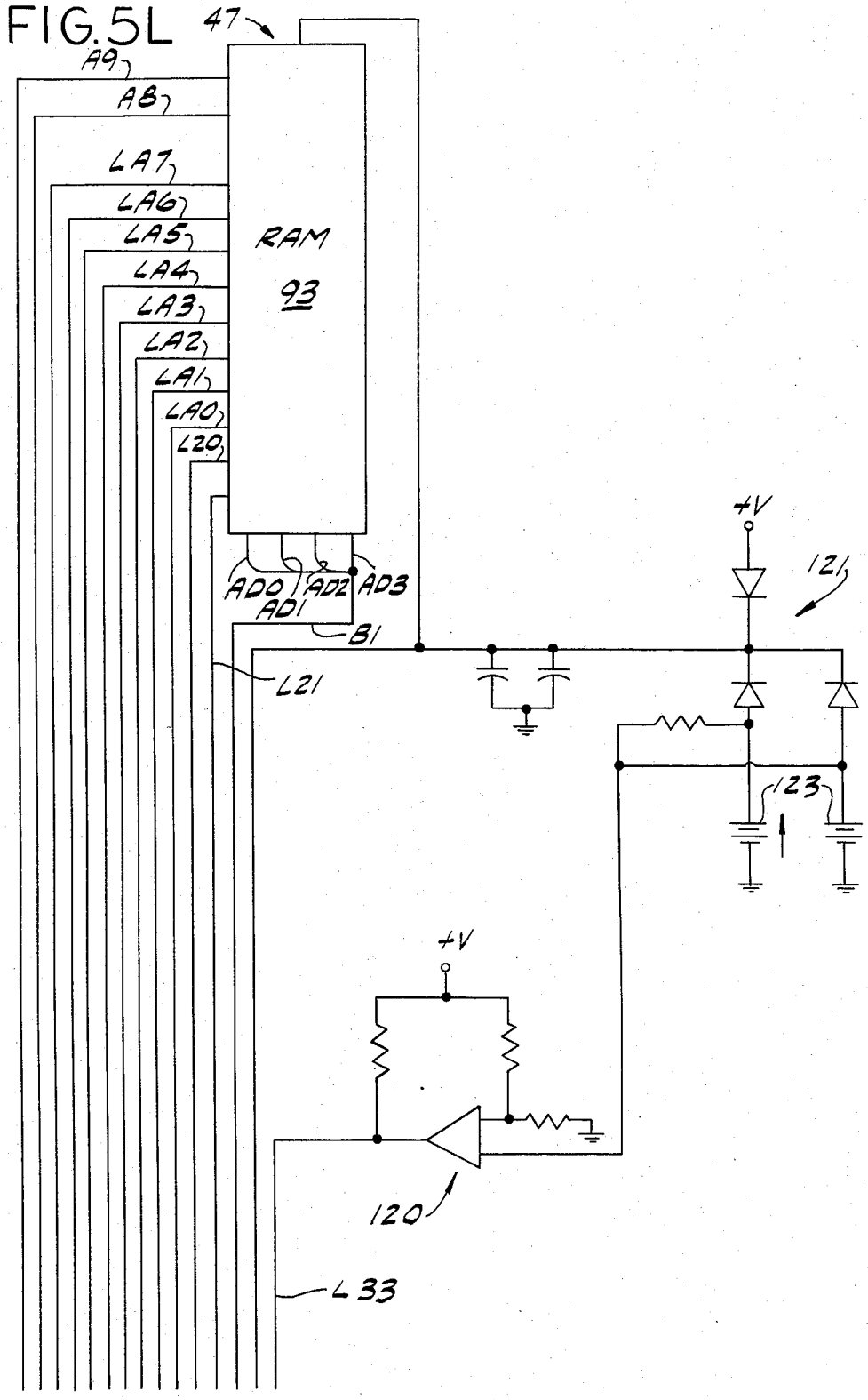
Figure 5M:
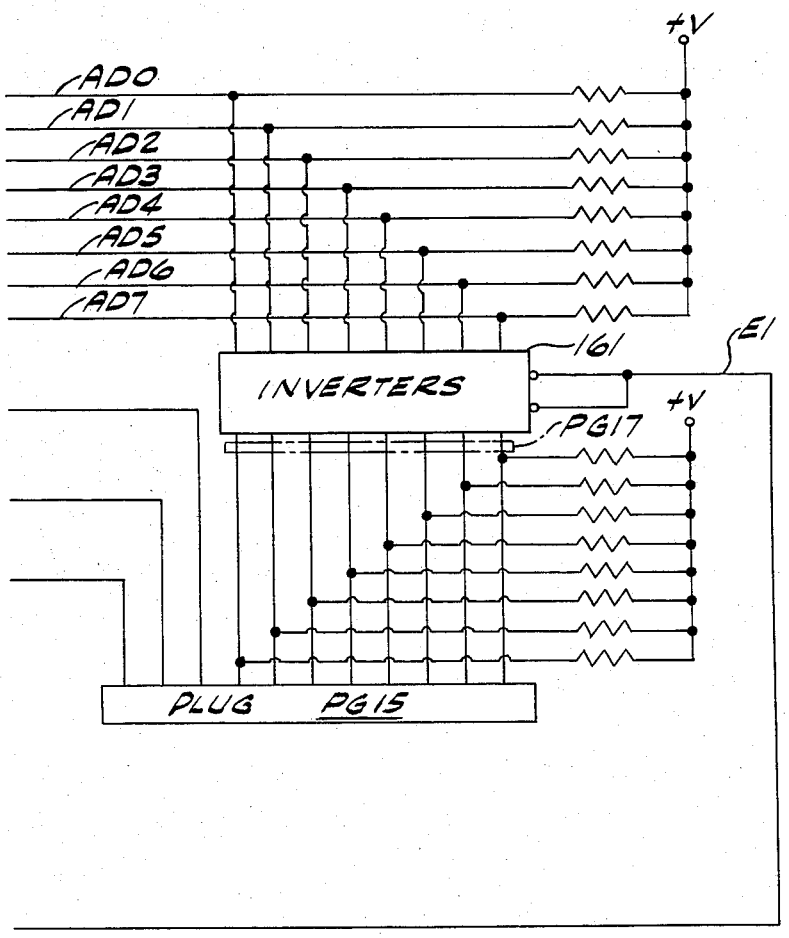

The particular digit of displays 29 and 85 to be refreshed is selected by microcomputer 43 by sending a four bit code corresponding to the desired digit over lines AD0–AD3 to an MC14514-type 4-to-16 decoder 147 (FIG. 5G). Decoder 147 is selected by a line DC1 (see FIGS. 5C and 5F) from decoder 85 whose signal level is inverted by an inverter 149. The output of inverter 149 is supplied on a line DC3 to decoder 147. The outputs of decoder 147 are supplied to two 6118-type drivers 151, 153 whose outputs are connected to display 29 and, via a plug PG13 shown in phantom, to the external display. The rightmost three outputs of decoder 147 are also connected via three inverters 155, 157, 159 to a plug PG15 (FIG. 5M) which is connected to the switches of keyboard console 25. More specifically, these switches are arranged in a matrix configuration and plug PG15 is connected to the rows and columns of this matrix so that by strobing rows and reading columns (or vice versa) microcomputer 43 can determine which, if any, of the keyboard console switches are closed. The other pins of plug PG15 are connected through an LS244-type tri-state inverter chip 161 which is enabled via a line E1 from decoder 85. The outputs of inverter chip 161 are connected to lines AD0–AD7 to supply switch closure information to the microcomputer. A plug PG17 (shown in phantom in FIG. 5M) connects inverters 161 to product selection keyboard 55, which is also connected in a matrix configuration and is read similarly by the microcomputer.

The remaining output of decoder 85 (FIG. 5C) is a line E3 which is used to enable a tri-state buffer 163. The two leftmost bottom pins of buffer 163 are connected to the dumb coin unit and handle interrupt and data signals. The middle pin senses whether the vendor door is closed and supplies this information to microcomputer 43 via line AD5. The two rightmost pins sense whether the cash box is in place and whether the latch for the cash box is in place. This information is supplied to the microcomputer over lines AD6 and AD7.

Figure 6:
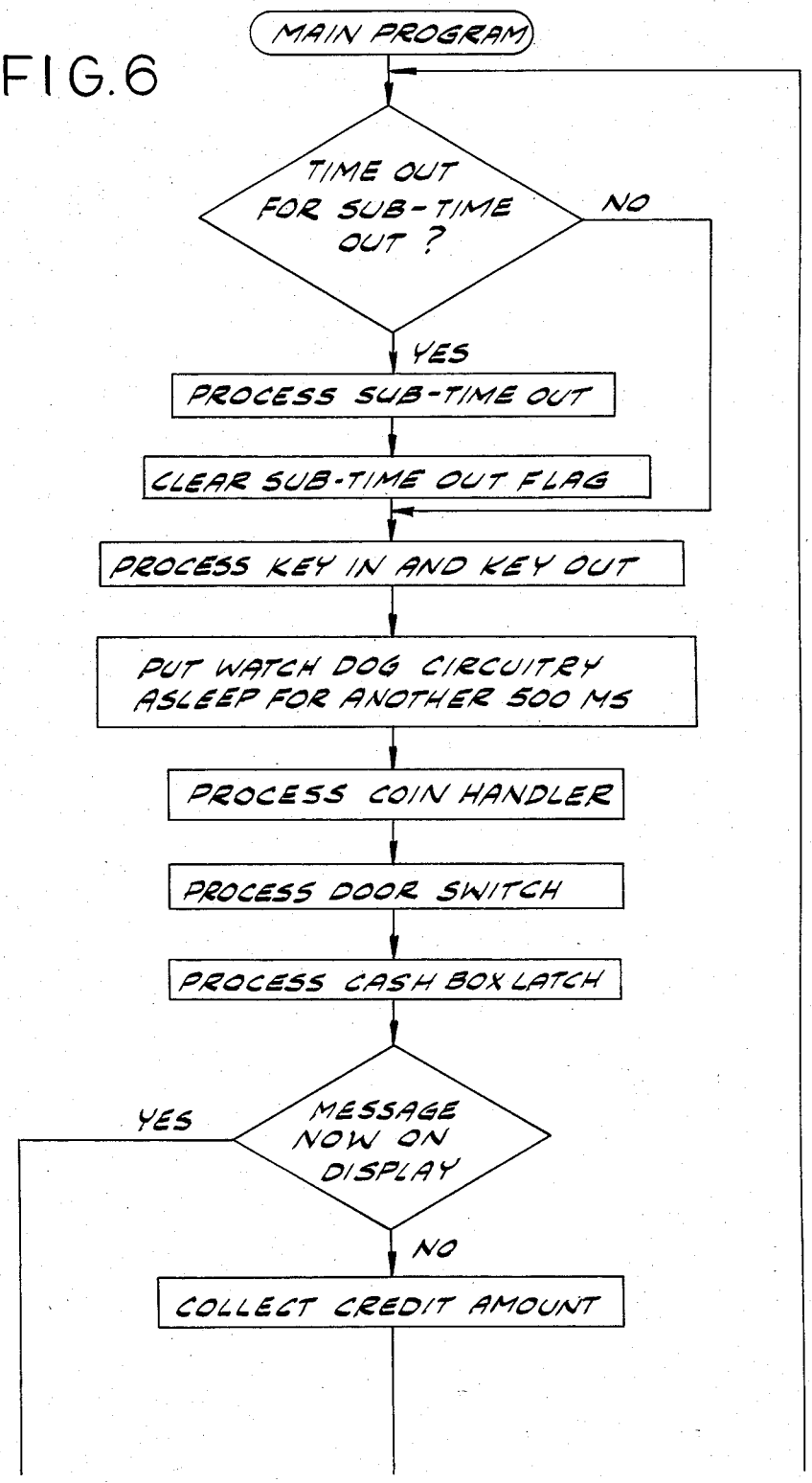
FIGS. 6–6E are flowcharts of the main program for a microcomputer used in the cash accountability system of this invention.
Figure 6A:
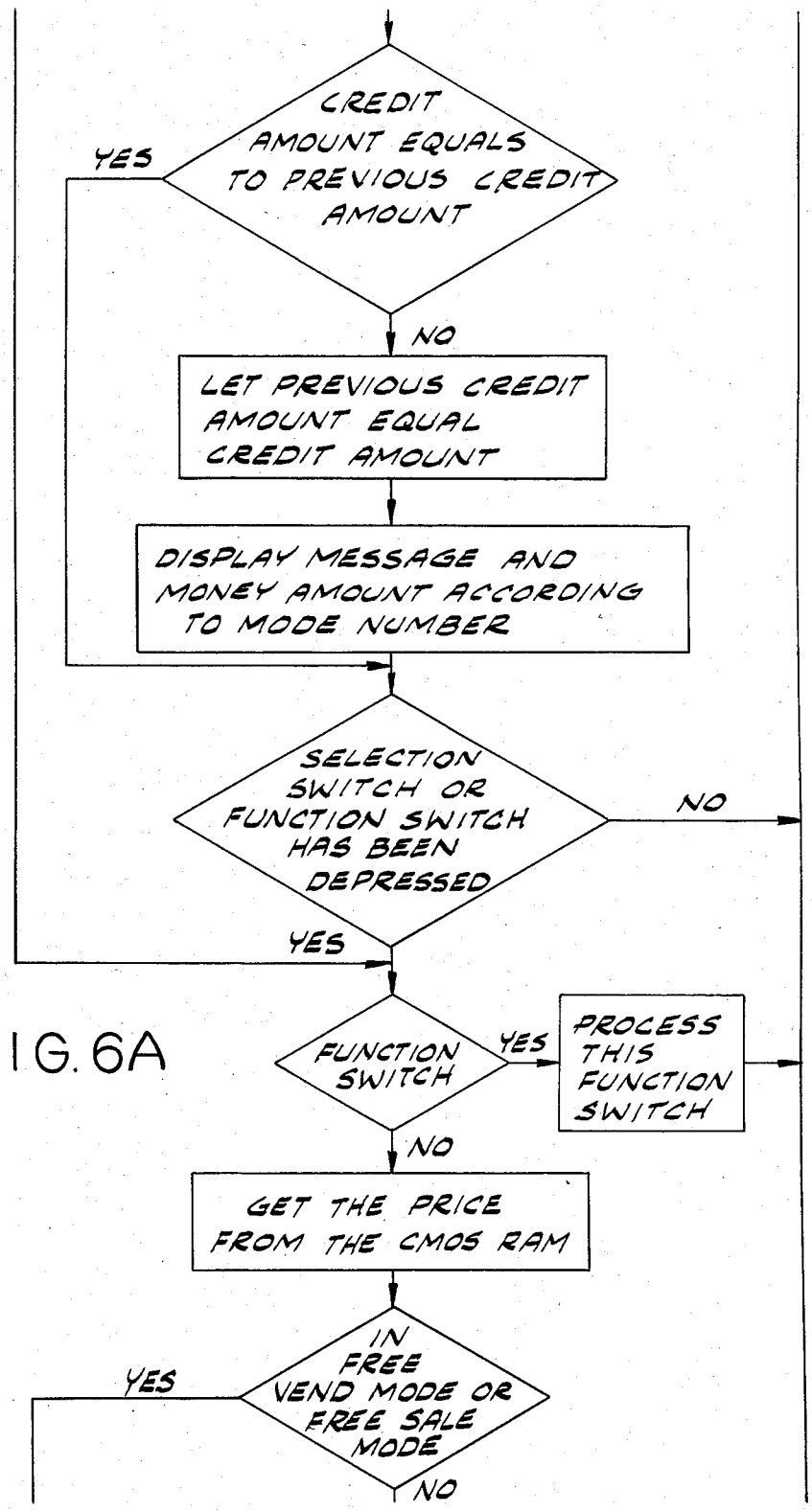
Figure 6B:
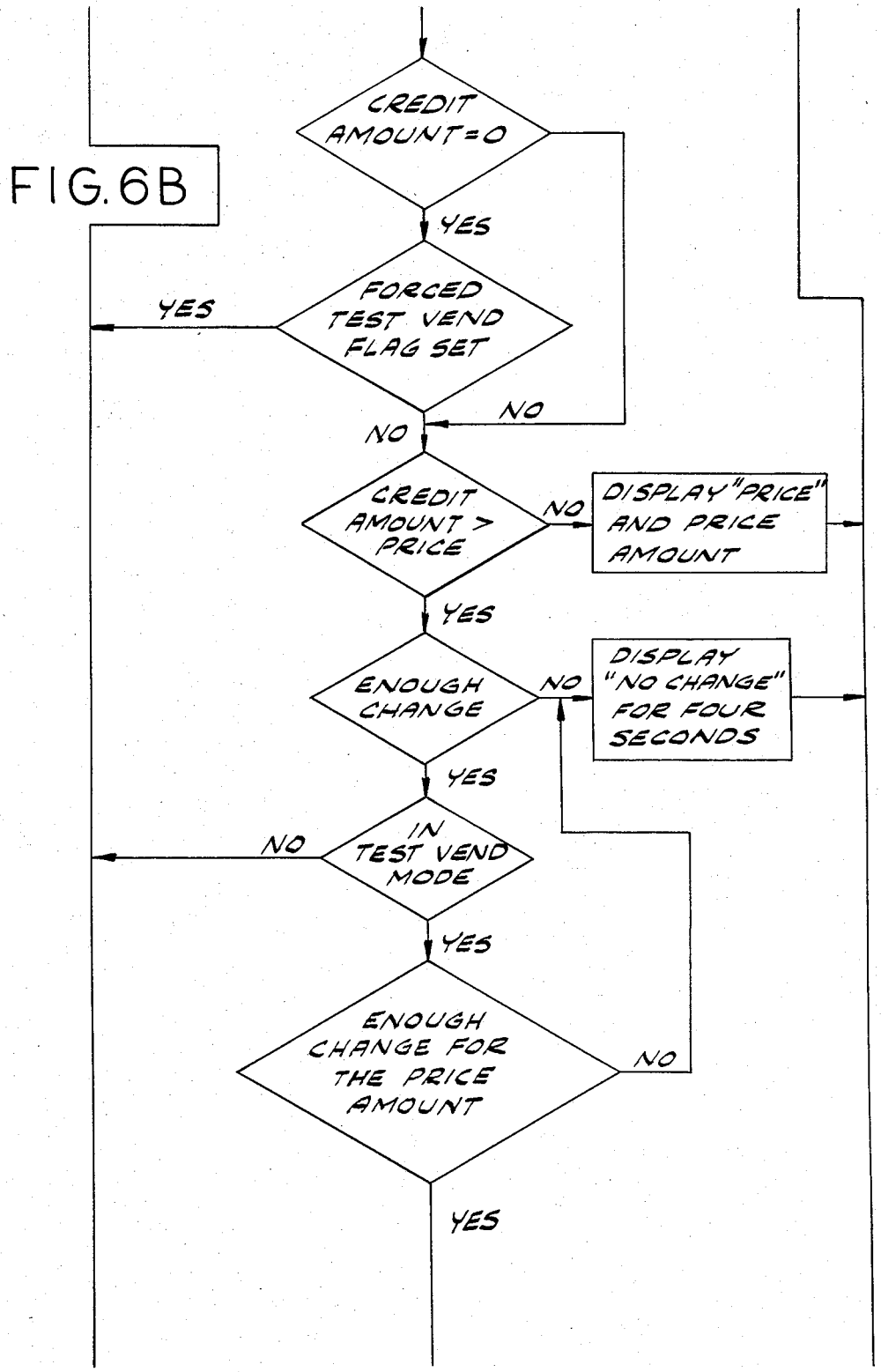
Figure 6C:
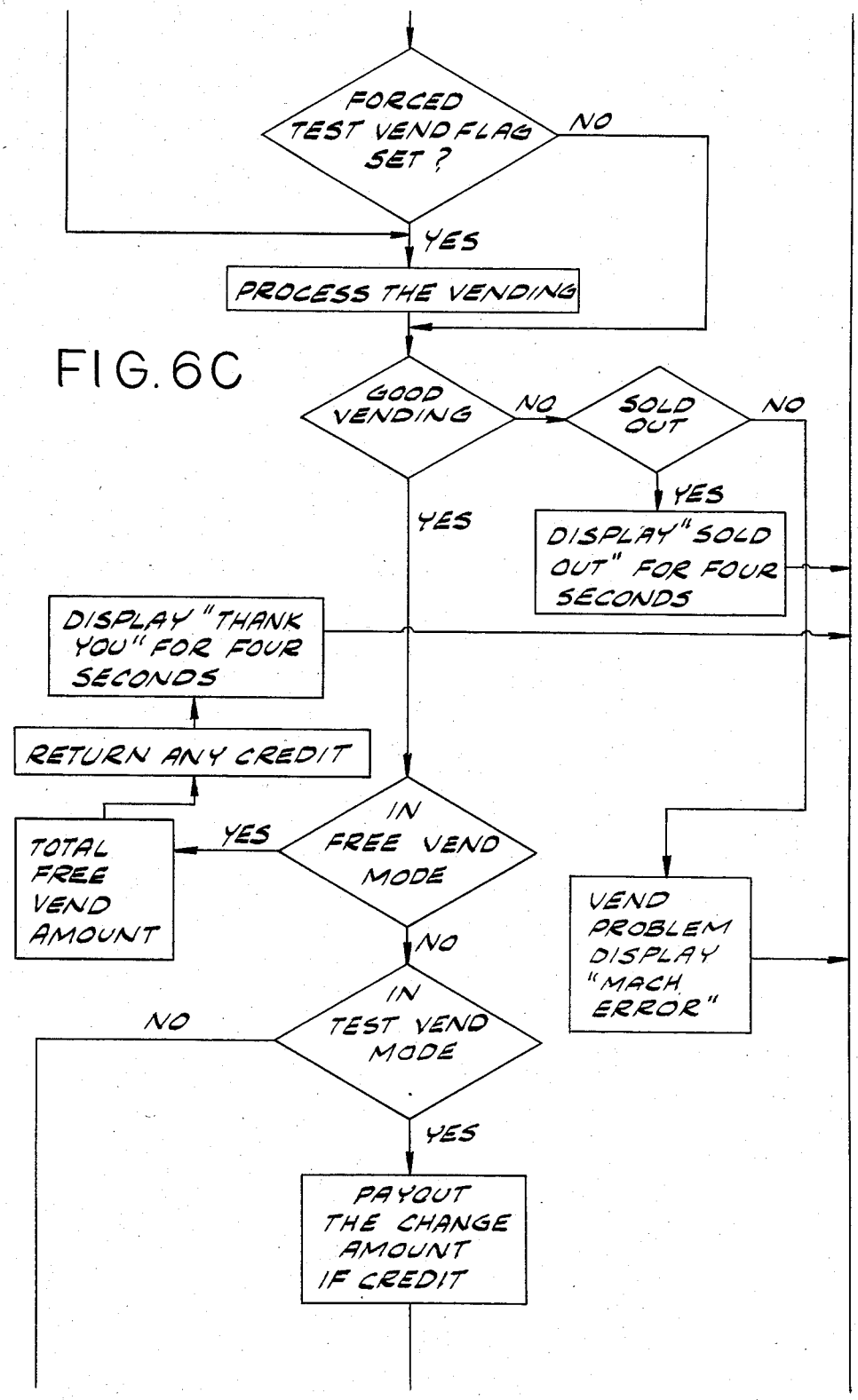
Figure 6D:
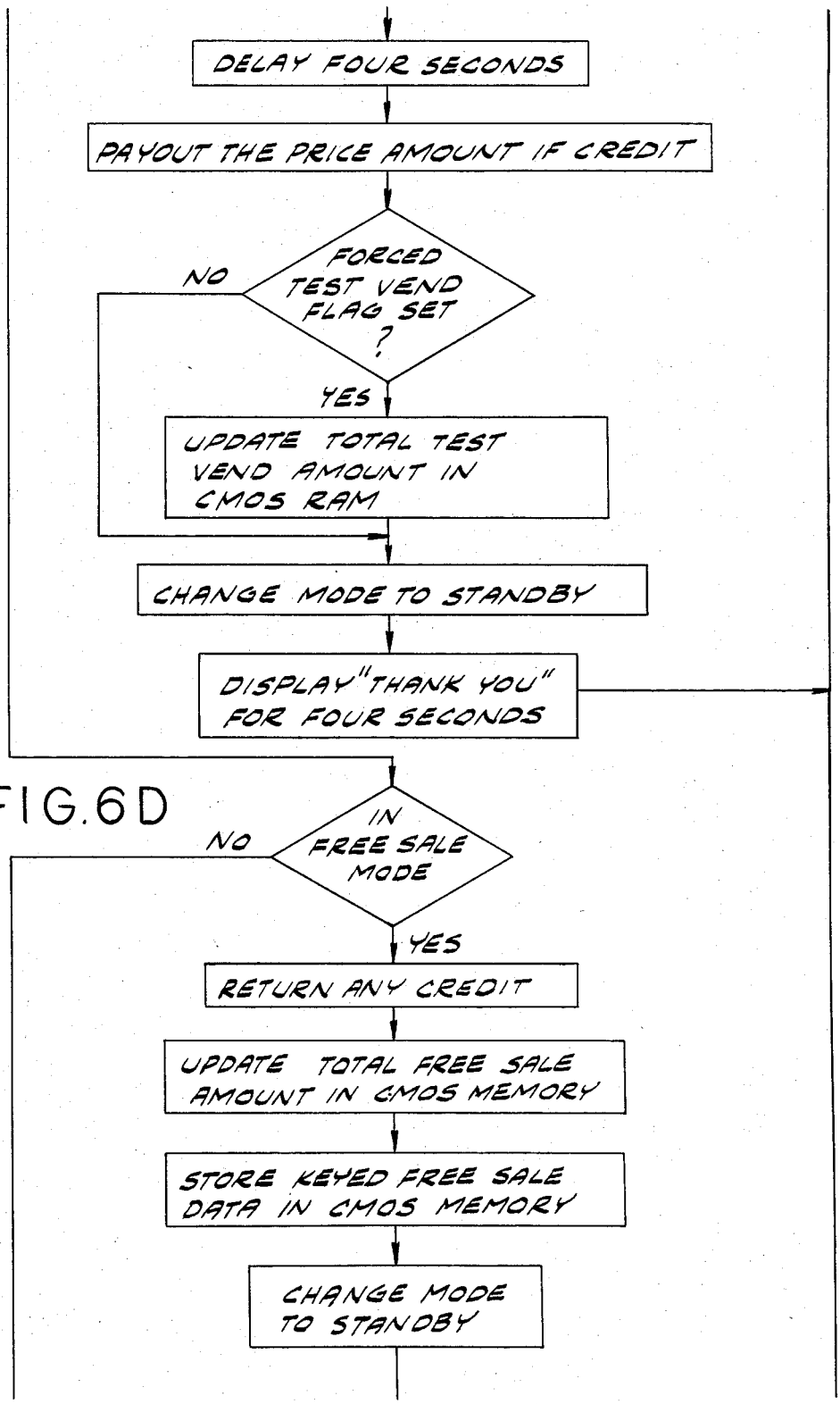
Figure 6E:
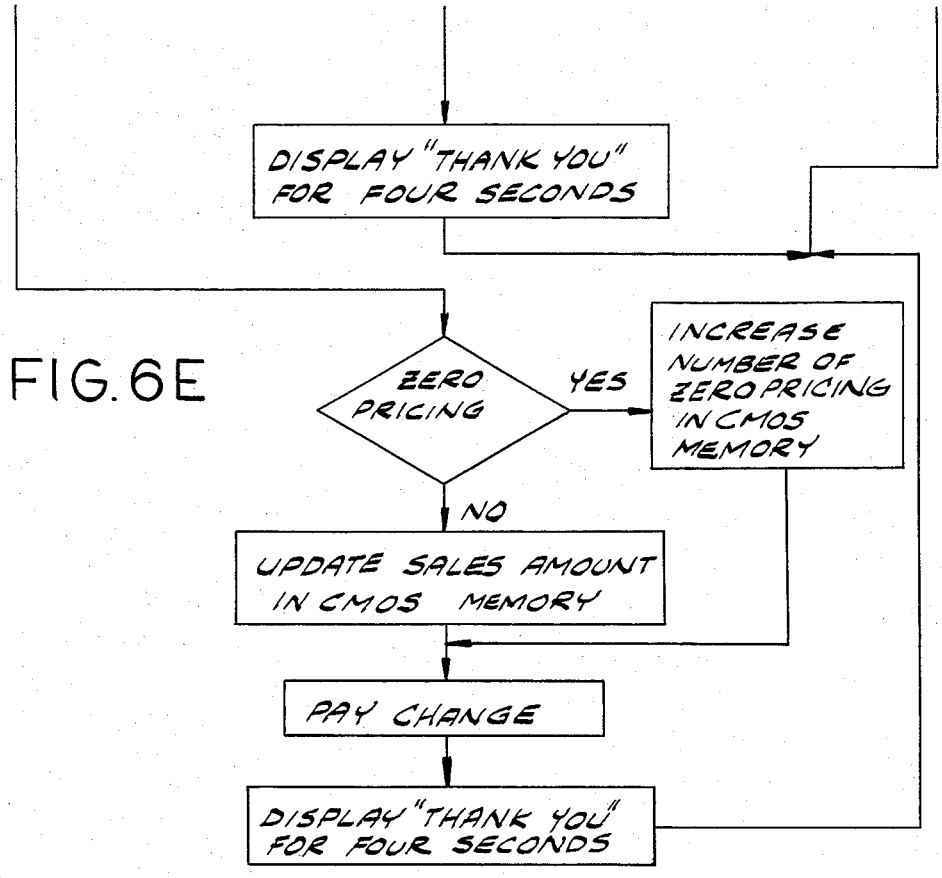
Figure 18:
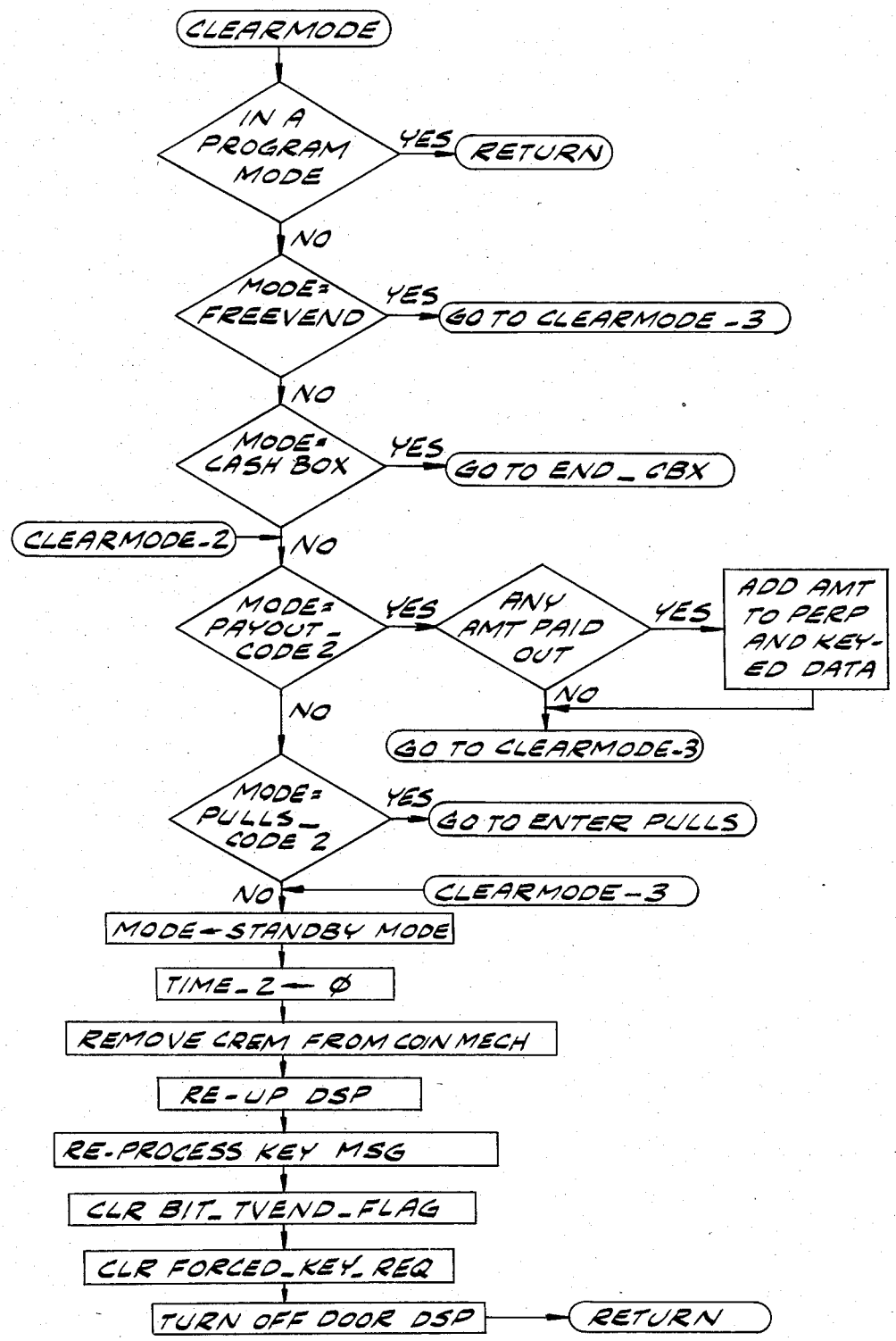
FIG. 18 is a flowchart for a routine of the microcomputer used in this invention in which it clears the system from various modes of operation.
Figure 19:
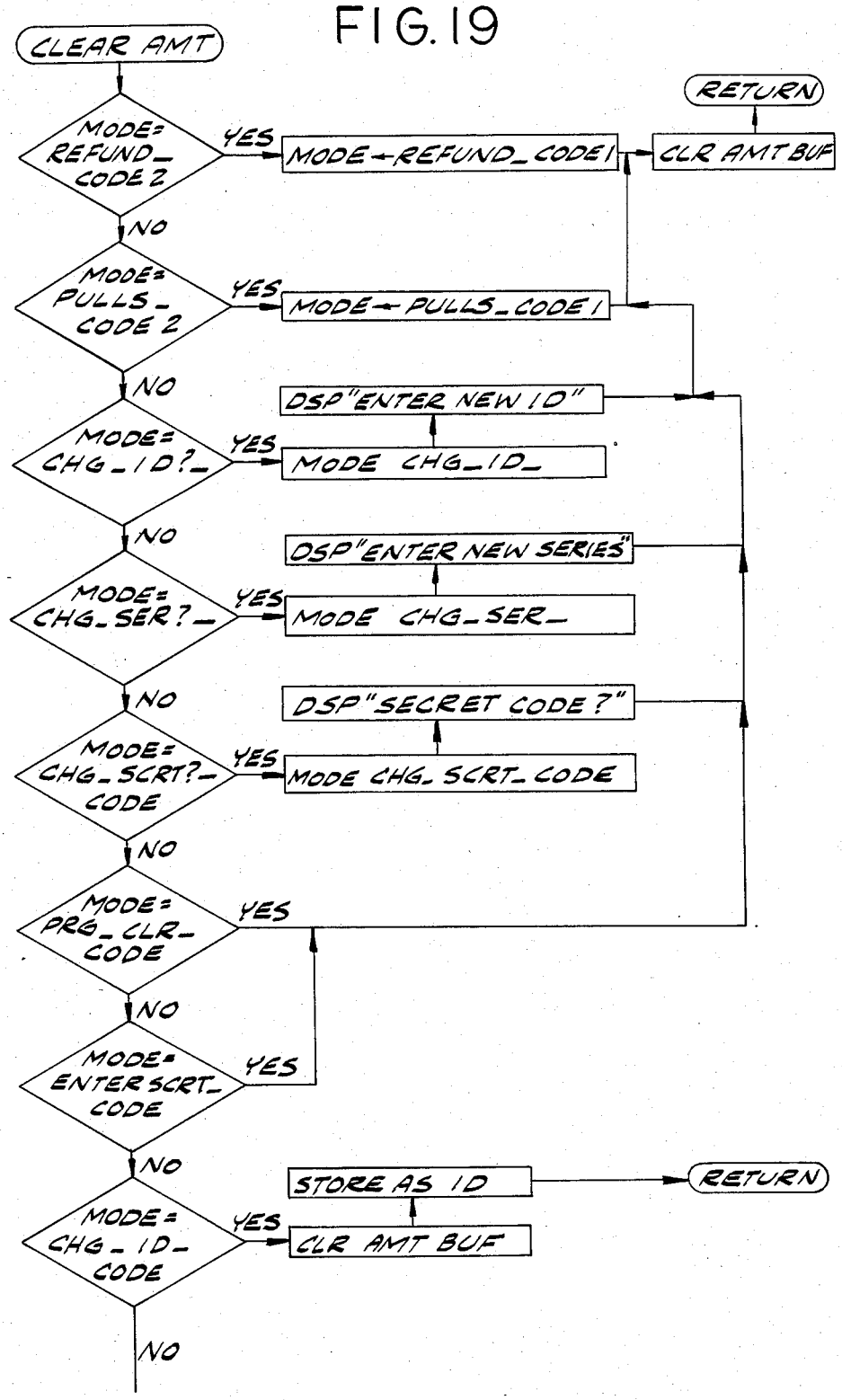

The program for microcomputer 43 is stored in ROM chips 87 and 89 and is represented by the flowcharts shown herein as FIGS. 6–36. The main routine or program of microcomputer 43 is shown in FIGS. 6–6E. In the main program microcomputer 43 first checks to see if a timer representing a time limit for a particular machine function, if any, has timed out. If it has, the microcomputer processes this condition, called Sub-Timeout, by checking to see if the system is in the cash box mode and if it is displaying for twenty-five seconds the following message in display 85: "CLOSE CASH BOX". If it is not in the cashbox mode, it clears the timer and goes to the Clearmode routine (see FIG. 18). The beeping is to prevent the service person from inadvertently leaving the cash box out of its in-place-and-latched position. As should be apparent, the above message is displayed by microcomputer 43 sending the necessary data signals out to latches 139 and 141 (FIG. 5F) over lines AD0–AD7 and the necessary digit selecting signals out over lines AD0–AD3 to decoder 147 (FIG. 5G). Energization of the beeper is controlled by line L1 from microcomputer 43.

After processing the Sub-Timeout condition, the microcomputer clears the flag representing that condition. Once the flag is cleared, or if the Sub-Timeout condition was not present, microcomputer 43 next processes the conditions of a key fully in slot 35 and a key fully out of the slot. The microcomputer's actions in processing these conditions is discussed below in connection with flowcharts shown in FIGS. 7–7B. Next the microcomputer resets watchdog circuit 81 (FIG. 5B) by means of a signal on line L13 from decoder 85 (FIG. 5C) which is supplied to that circuit. This means that the watchdog circuit will not time out (will remain "asleep") for another 500 ms. After resetting the watchdog circuit, the microcomputer processes any conditions having to do with the dumb coin unit or coin handler, which processing is described below in connection with the flowcharts shown in FIGS. 8 and 8A, and then processes the door switch condition and the cash box latch condition (see discussion in connection with flowcharts shown in FIGS. 9–9B and 10–10B respectively below). After completing any actions required by reason of the status of the cash box latch, microcomputer 43 checks to see if a forced message (e.g., "NO CHANGE" or "SOLD OUT") is currently being displayed on display 29 or external display 85. If no forced message is being displayed, any credit amount is collected. If this credit amount does not equal the credit amount previously stored by microcomputer 43, that previous credit amount is updated. Microcomputer 43 then displays the credit amount and a message. The message displayed is determined by the particular mode the system is in at that time. These modes, mode numbers for each, and the message displayed are set forth below:

MACHINE MODE AND ITS MEANING

| Mode | Mode Number | Message Shown on the Display |
|---|---|---|
| Standby | 0 | Credit |
| Price Set | 1 | Set Price |
| Pulls | 2(A) | . . . Pulls . . . Enter Amount By Pressing Yellow Buttons |
| | 2(B) | Pulls |
| Open Cashbox | 3(A) | Cash Box Unlocked |
| | 3(B) | Close Cash Box |
| Test Vend | 4 | Test Vend |
| Pre Free Vend | 5 | . . . For Continuous Free Vending . . . Press Enter Button |
| Free Sale | 6 | . . . Free Sale . . . Make Selection |
| Refund | 7(A) | . . . Refund . . . Enter Amount With Yellow Buttons |
| | (7B) | Refund |
| Payout | 8(A) | . . . To Payout Change . . . Press Yellow Buttons |
| | (B) | Payout |
| Add Change | 9(A) | Add Change Through Rejector |
| | 9(B) | Add Change |
| Free Vend | 10(A) | . . . Free Vending . . . To Exit Press Clear Mode |
| | 10(B) | Do Not Insert Money . . . Make Selection . . . |

These modes and the corresponding messages are described below. After displaying the proper message, or in those cases where the credit amount and the previous credit amount were the same, the microcomputer next checks to determine if one of selection switches 55 or one of the switches (called function switches) on keyboard console 25 have been pressed. As described above, this is determined by strobing the rows and reading the columns of the selection switch and function switch matrixes using decoder 147 (FIG. 5G), inverters 155, 157, 159, inverter chip 161 (FIG. 5M), and plugs PG15 and PG17. Microcomputer 43 receives switch closure information back on lines AD0–AD7. In those cases in which a switch is not depressed, microcomputer 43 returns to the start of the main program and resumes executing it from that point. If a selection switch or function switch is closed, on the other hand, further action of the microcomputer is required. This further action is also required in those cases where the answer to the message-now-on-display test mentioned above was yes and a selection or function switch has been pressed. In either case, the microcomputer next determines if the closed switch was a function switch. If it was, this condition is processed according to the particular function switch pressed. The particular function switch routines are discussed below. After processing the function switch condition, microcomputer 43 returns to the start of its main program.

If the closed switch was not a function switch it was a selection switch. The microcomputer next checks to see if the system is in the add change mode. If it is it returns to the start of its main program. If it is not, the microcomputer next retrieves the price of the selection corresponding to the actual switch from RAM chip 93. This is accomplished by sending out the address of the desired memory location over lines AD0–AD7, A8 and A9 (the first eight of which lines are connected to RAM chip 93 via latch 91 (FIG. 5I) and lines LA0–LA7); selecting the chip via decoder 97, inverter 99, transistor Q7 and line L21; and reading the data stored in the desired memory location over lines AD0–AD3 of bus B1. After getting the price, microcomputer 43 checks to see if the system is in the free vend or free sale mode (in which selections are vended for free) by examining flags which, as is described below, are set by means of the function switches. If the system is in the free vend or free sale mode, microcomputer 43 proceeds with the vend, as described below in connection with FIG. 6C. If the system is not in the free vend or free sale mode, the microcomputer checks to see if the credit amount equals zero (FIG. 6B). If it is, microcomputer 43 next checks to see if the forced test vend flag is set (which is also done by means of the function switches as is described below). If the forced test vend flag is set, the microcomputer proceeds with the vend. But if it is not, or if the credit amount did not equal zero, the microcomputer compares the credit amount with the price retrieved for the selected item. If the credit amount is insufficient to purchase the item, the microcomputer causes "PRICE" and the retrieved price for the item to be displayed in display 85 for four seconds by setting the forced message flag and forced message timer for four seconds, and returns to the start of the main program. On the other hand, when the amount of credit is sufficient to purchase the item, the microcomputer checks to see if the change tubes QR, NK and DM contain enough change to make change given the credit amount and the price of the item selected. This information on available change is acquired from the dumb coin unit via plug P3 and tri-state buffer 163 (FIG. 5C). When change cannot be made, the microcomputer causes display 85 to display "NO CHANGE" for four seconds by setting the forced message flag and it returns to the start of its main program. Otherwise the microcomputer next checks a flag, set by use of the function switches, to see if the system is in a test vend mode. If it is this means a service person is testing the vendor to see if it is vending properly or if the coin handler is functioning properly. In either case this person should be returned his entire credit. The microcomputer, therefore, when the system is in the test vend mode checks to see if there is enough change to return the entire price to the service person. If not "NO CHANGE" is again displayed for four seconds by setting the forced message flag and microcomputer 43 returns to the start of is main program. When sufficient change is present, the forced test vend flag is checked (FIG. 6C) and if it is set, the microcomputer proceeds with the vend. The microcomputer goes to this stage directly whenever the system is not in the test vend mode, because in that case an actual purchase is taking place and there is no need to check to see if the amount of change is sufficient to return the price of the selected item.

Processing of the vend is accomplished in the spiral vendor by energizing the desired vend motor in the motor matrix circuit by using latches 99 and 101 (FIG. 5J) to energize the appropriate row of the vend motor matrix via sinks 111 (FIG. 5K) and driver transistors Q11, while providing a sink for the driving current in the appropriate column using current sinks 109 (FIGS. 5J and 5K). Of course in other vendors with more complicated vend cycles the vending can be controlled by a separate machine controller 21 under command from microcomputer 43.

After proceeding with the vend, or in those cases in which the forced vend flag was not set but there was credit, microcomputer 43 then determines if the vend was good. If it was not, the microcomputer tests to see if the reason for the failure of the vend was a sold out condition. If the vendor was sold out of the selected item, microcomputer 43 displays "SOLD OUT" in display 85 for four seconds and returns to the start of the main program. On the other hand, when the vendor is not sold out of that item, there is a vend problem, so microcomputer 43 causes "MACH ERROR" to be displayed for four seconds and it returns to the start of the main program.

In those instances in which the vend was successful or not attempted because the forced test vend flag was not set, the microcomputer next checks to see if the system is in the free vend mode. If it is, the customer or service person is entitled to get back his money, but first a record is made of the price of the free vended item. This price is added to a running total of the free vend amounts and stored in RAM chip 93. Storage of this information in chip 93 is accomplished by supplying the write signal from pin WR of the microcomputer through plug P5 (FIG. 5H), inverter 95 (FIG. 5I), transistor Q5 , and line L20 to the read/write pin of RAM chip 93 while selecting the chip as described above and supplying the data to it over lines AD0–AD3. Once this cash and product accountability information is stored, the credit is returned by sending the appropriate signals to the dumb coin unit. For example, a nickel, a dime and a quarter could be returned to the customer by causing lines P15–P17 of the microcomputer to go Low. These signals are supplied by plug P3 to the dumb coin unit which in response returns the coins from the change tubes to the customer. The microcomputer also causes display 85 to display "THANK YOU" for four seconds and it returns to the start of the main program.

When the system is not in the free vend mode, the microcomputer next checks to see if the system is in the test vend mode. If it is not, the microcomputer tests to see if it is in the free sale mode (FIG. 6D) as described below. When the system is in the test vend mode, the microcomputer next pays back the amount of change due by appropriately signalling the dumb coin unit. It waits four seconds and then also pays back the price. This ensures that the service person receives back all the money he deposited to initiate the test. As a result, there is no need for the service person to carry around a great deal of change and no reason for him to need access to the cash box in order to perform test vends. This enables the operator to send out a service or route person to perform test vends with a data key which does not permit access to the cash box. After paying back the price to the service person, the microcomputer checks the forced test vend flag. If it is set, that means that an item has been vended, so the microcomputer then updates in RAM chip 93 a running total of test vend amounts. If it is not set, no item was dispensed so this test vend total, which is a product accountability feature of the system, is not changed. After updating the test vend total (if an item was vended) or after determining the forced test vend flag was not set (if an item was not vended) microcomputer 43 changes the system mode to standby, causes "THANK YOU" to be displayed for four seconds, and returns to the start of the main program.

On the other hand, when the system is not in the test vend mode, microcomputer 43 next checks (as mentioned above) to see if the system is in the free sale mode. If it is, the microcomputer returns any credit, updates in RAM chip 93 the free sale amount, stores data concerning keyed free sales in RAM chip 93, changes the system mode to standby, displays "THANK YOU" for four seconds, and returns to the start of the main program. If the system were not in the free sale mode, microcomputer would then have tested whether the item was sold at a zero price (FIG. 6E). A running total of zero price sales is stored in RAM chip 93 and this total is updated if the item was sold at a zero price. If the item was not sold at a zero price, another running total in RAM chip 93 is updated, namely the total sales figure for the vendor. After the total sales figure is updated, any change due is returned, "THANK YOU" is displayed for four seconds, and microcomputer 43 returns to the start of its main program.

Figure 7:
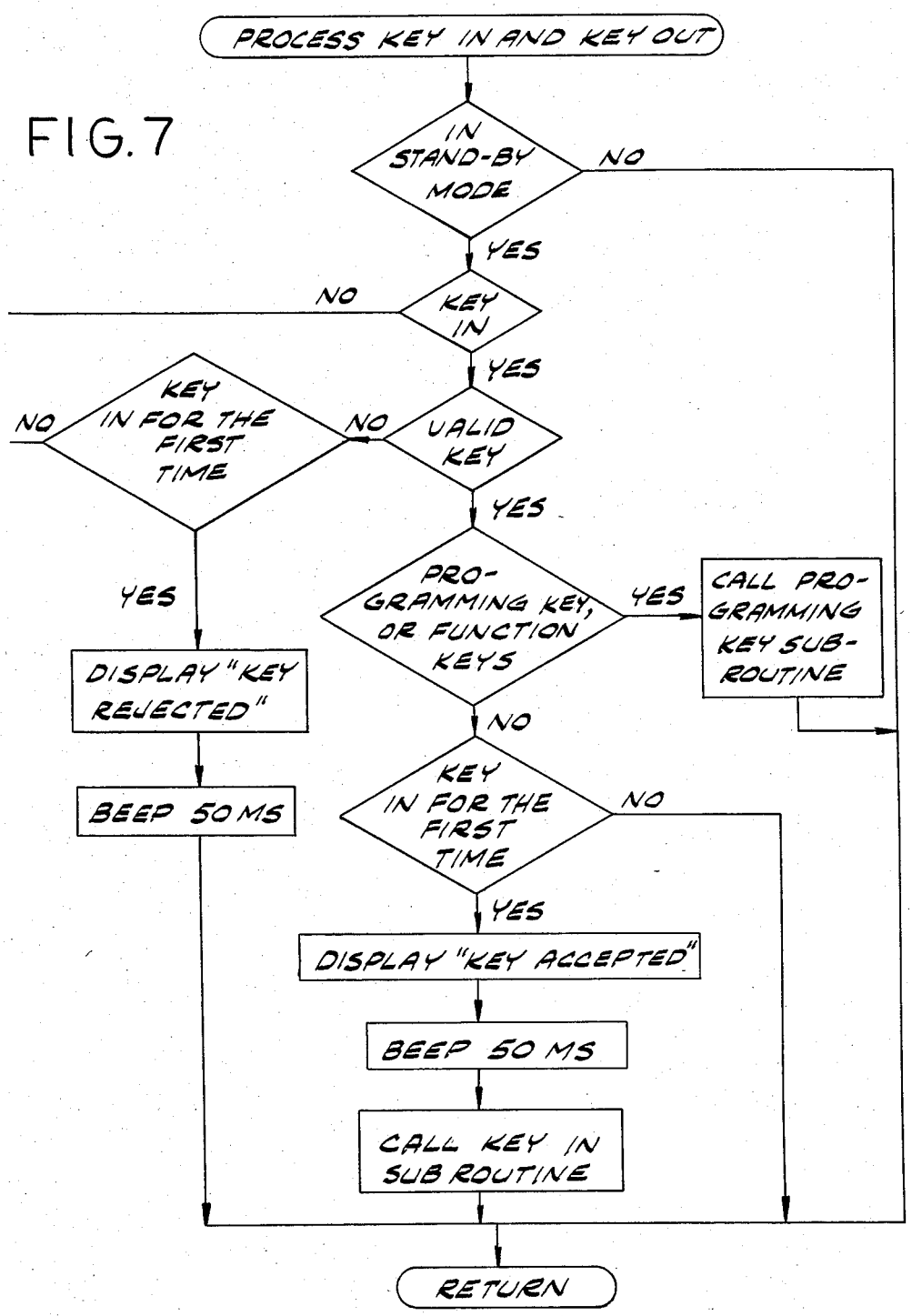
FIGS. 7–7B are flowcharts for a key handling routine of the microcomputer used in this invention.
Figure 7A:
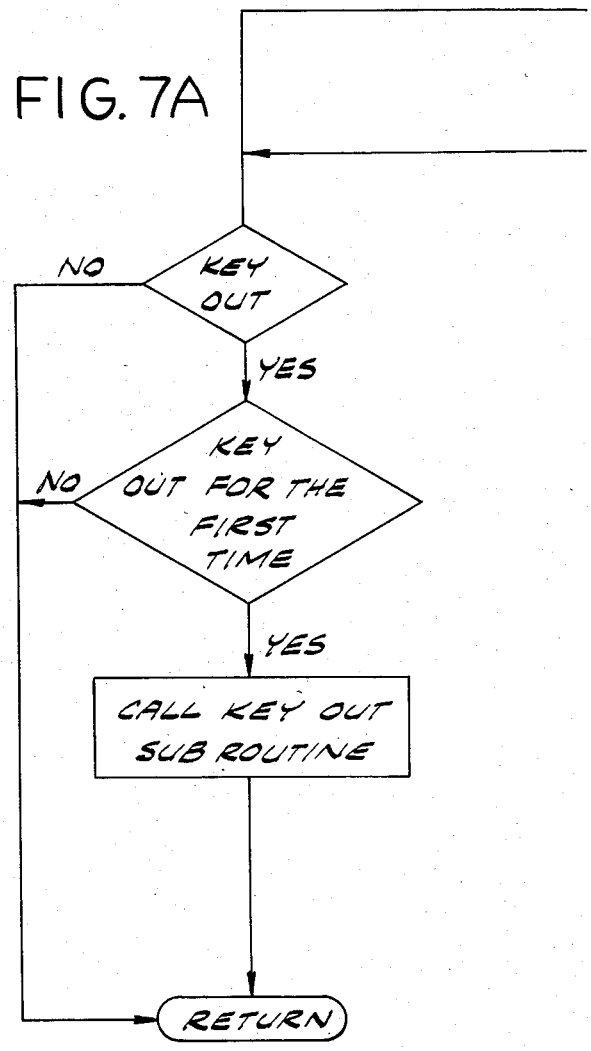

The flowchart for processing the key in and key out conditions referred to above is shown in FIGS. 7 and 7A. In this part of its program, microcomputer 43 first checks to see if the system is in the standby mode. If it is not the microcomputer immediately returns from the process key-in and key-out routine to the main program. If the system is in the standby mode, the microcomputer next determines if the key-in condition exists. If that condition does not exist, it then checks for the key-out condition (FIG. 7A). If the key-out condition does not exist, it returns from the process key-in and key-out subroutine. If the key-out condition does exist, the microcomputer checks to see if the key-out condition is encountered for the first time. If it is, it calls a key-out subroutine (FIG. 7B) and returns to the main program. If it is not, the microcomputer returns directly to the main program without calling the key-out subroutine. In the key-out subroutine, microcomputer 43 checks a flag representing the presence or absence of a key in slot 35 and if it is set clears the flag. Then it resets a timer to zero, reenergizes the display and returns from the key-out subroutine. If the flag was not set, the microcomputer checks to see if the system is in a programming mode. If it is not in a programming mode, the microcomputer returns from the key-out subroutine. If it is in a programming mode, microcomputer 43 goes to a routine labelled ClearMode-3, described below in connection with FIG. 18.

Referring back to FIG. 7, when the microcomputer tests for the key-in condition and the answer is yes instead of no, it next checks to see if the key is a valid key. Although this is shown as a single decision block in FIG. 7, the test for a valid key comprises many steps which are represented by the Check Valid Key flowchart (FIG. 15) discussed below. If the key is not valid, the microcomputer determines if this is the first time the key-in condition has been encountered. If it is, the message "KEY REJECTED" is displayed, the beeper is turned on for 50 ms, and the microcomputer returns from the process key-in and key-out routine. If the key-in condition has been encountered before, the microcomputer instead branches to the previously discussed flowchart shown in FIG. 7A.

In those cases where the key is a valid key, microcomputer 43 after determining that fact checks the key, by examining the series number for example, to see if it is a programming key or a special function key, such as a clear key or a lockout key. If the key is a programming or function key, the microcomputer calls a programming key subroutine (see discussion of FIGS. 16 and 17 below) and then returns to the main program. When the valid key is not a programming or special function key, it is a data key. In this instance the microcomputer checks to see if the key is in for the first time. If it is not, microcomputer returns to the main program. If it is, the message "KEY ACCEPTED" is displayed, the beeper is turned on for 50 ms., key data is stored in RAM and the microcomputer returns to the main program.

Figure 8:
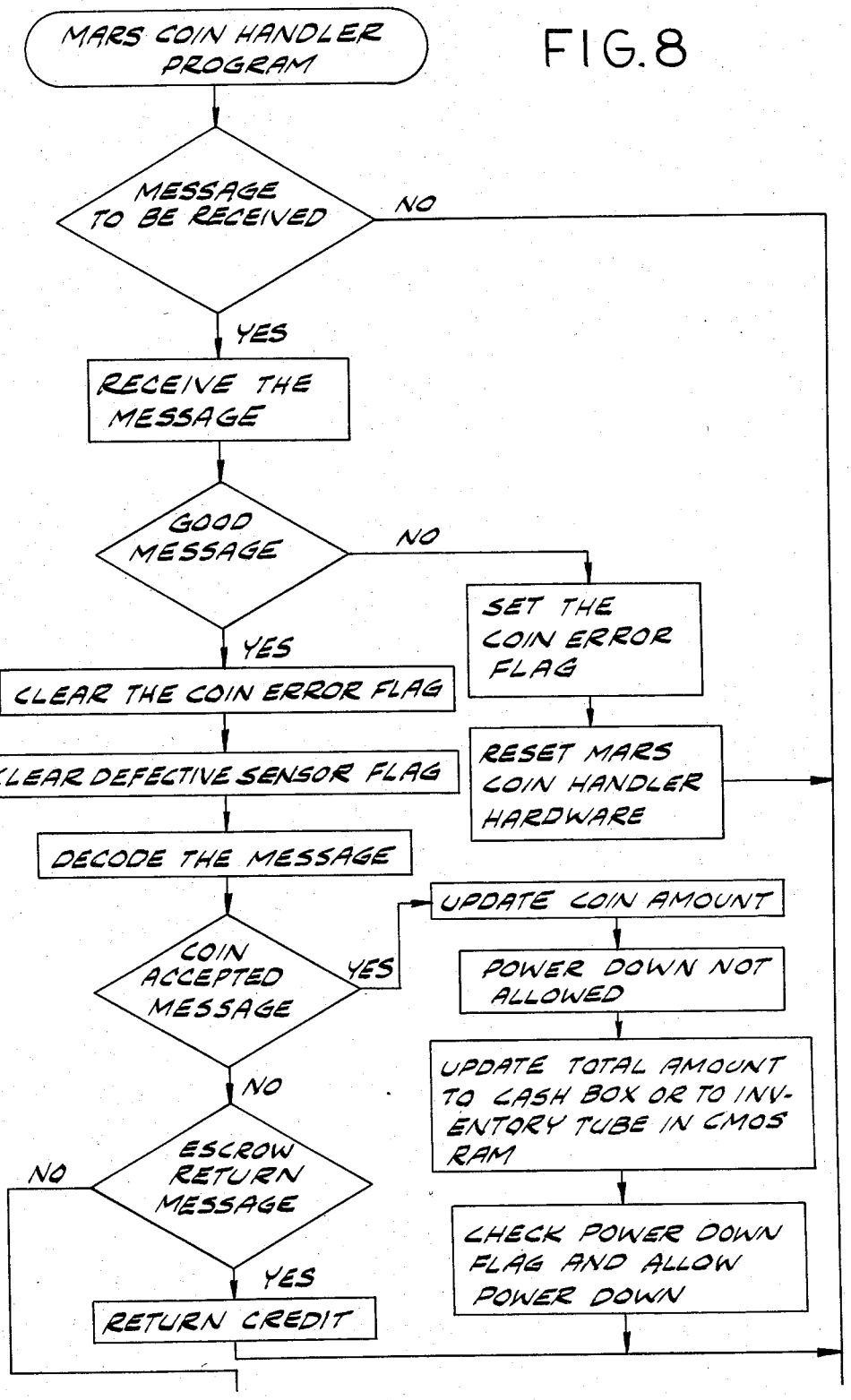
FIGS. 8–8A are flowcharts for the coin handler routine of the microcomputer used in this invention.
Figure 8A:
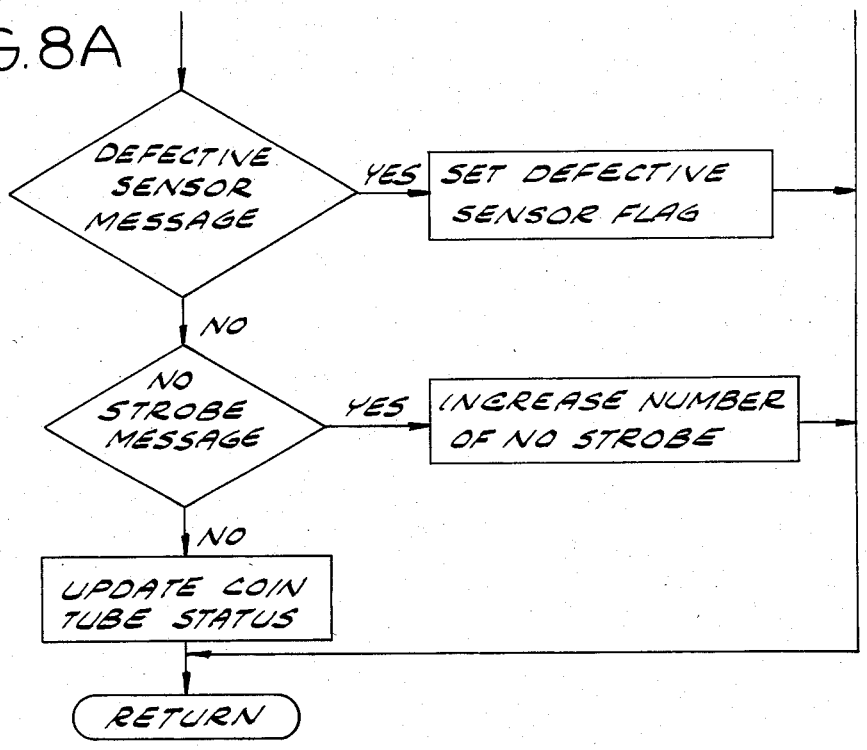

The routine for controlling the Mars coin handler, which is mentioned above in connection with the main program, is shown in FIGS. 8 and 8A. In this routine the microcomputer first determines if there is a message to be received from the coin handler. It does this by causing decoder 85 (FIG. 5C) to enable tri-state buffer 163 via line E3. Once the buffer is enabled, it reads line AD6, which is connected to the left-most output of the tri-state buffer. The left-most output of the buffer is a signal from the coin handler indicating whether it is ready to send the microcomputer a message. If there is no message to be received, the microcomputer returns directly to the main program. On the other hand if there is a message to be received, microcomputer 43 accepts the message by signalling the coin handler over line P13 and plug P3 to send the message. The message is sent through tri-state buffer 163, which the microcomputer must enable, to line AD7. Once the message is received, the microcomputer tests the message to see if it is a valid message. If the message is not valid, it sets an internal coin error flag, sends a reset signal to the coin handler over line P14 and plug P3, and returns to the main program. On the other hand, if the message was valid, the microcomputer clears the coin error flag, an internal defective sensor flag, and decodes the message. After decoding the message, it checks to see if the message was that the unit has accepted a coin. If that was the message, the microcomputer adds the amount of the coin to the customer or service person's credit. After adding to the credit amount, the microcomputer inhibits a power down sequence by sending out a signal on lines INT0 and PF2 to plug P3 (FIGS. 5C and 5D). This is done to ensure that the next action takes place. This next action is updating a running total of the amount sent to the cash box 17 or to the change tubes QR, NK and DM. This updated total is stored in RAM chip 93. Once the updated total is stored, microcomputer 43 changes the signal level on lines INT0 and PF2 to allow power down and then returns to the main program.

In those instances in which the valid message was not a coin-accepted message, the microcomputer checks to see if it was an escrow return message. If so, the system is checked to see if it is in the add change mode. If it is, the microcomputer returns to the main program. If it is not, the customer or service person's credit is returned by the dumb unit, as controlled by microcomputer 43 over lines P15–P17, and the microcomputer returns from the coin handler routine. If the message was not an escrow return message either, microcomputer 43 tests for a defective sensor message, which represents the fact that one or more of the sensors in the dumb coin unit is defective. If the message was a defective sensor message, the microcomputer sets a flag and returns to the main program. On the other hand, if the message was not a defective sensor message, the microcomputer checks for a no strobe message. With a no strobe message, a total of the no-strobe conditions is incremented and the microcomputer returns from this routine. Otherwise it updates a running record of the status of the coin tubes and then returns to main program.

Figure 9:
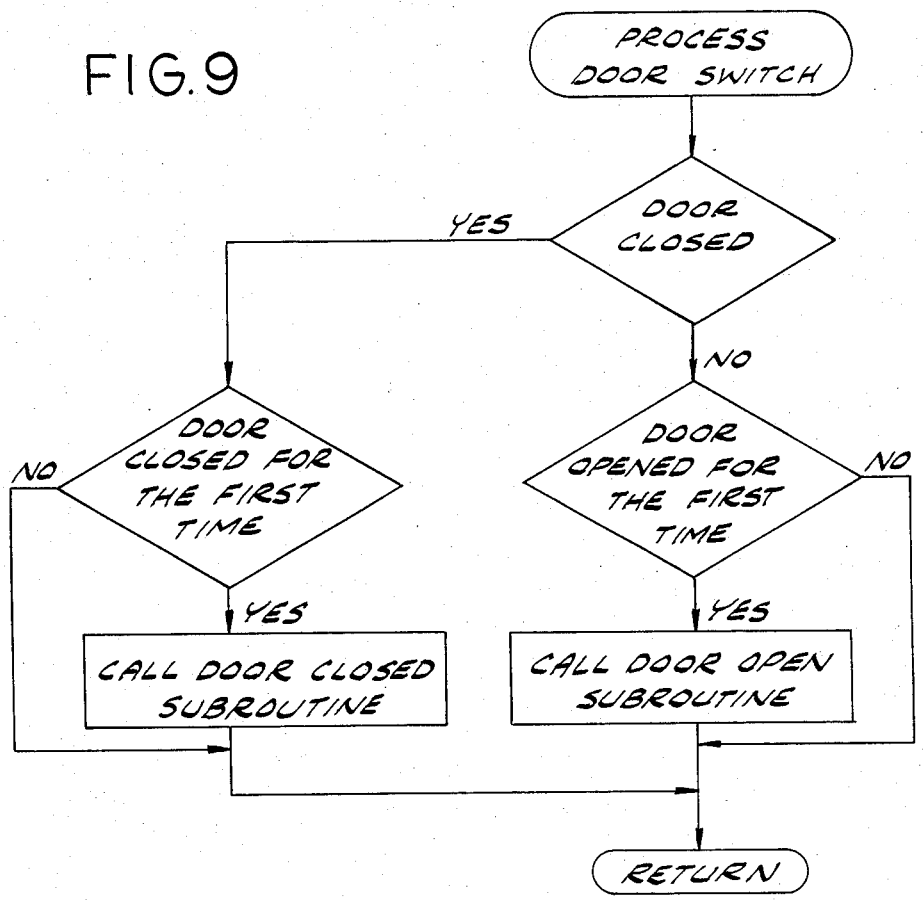
FIGS. 9–9B are flowcharts for the door routine of the microcomputer used in this invention.
Figure 9A:
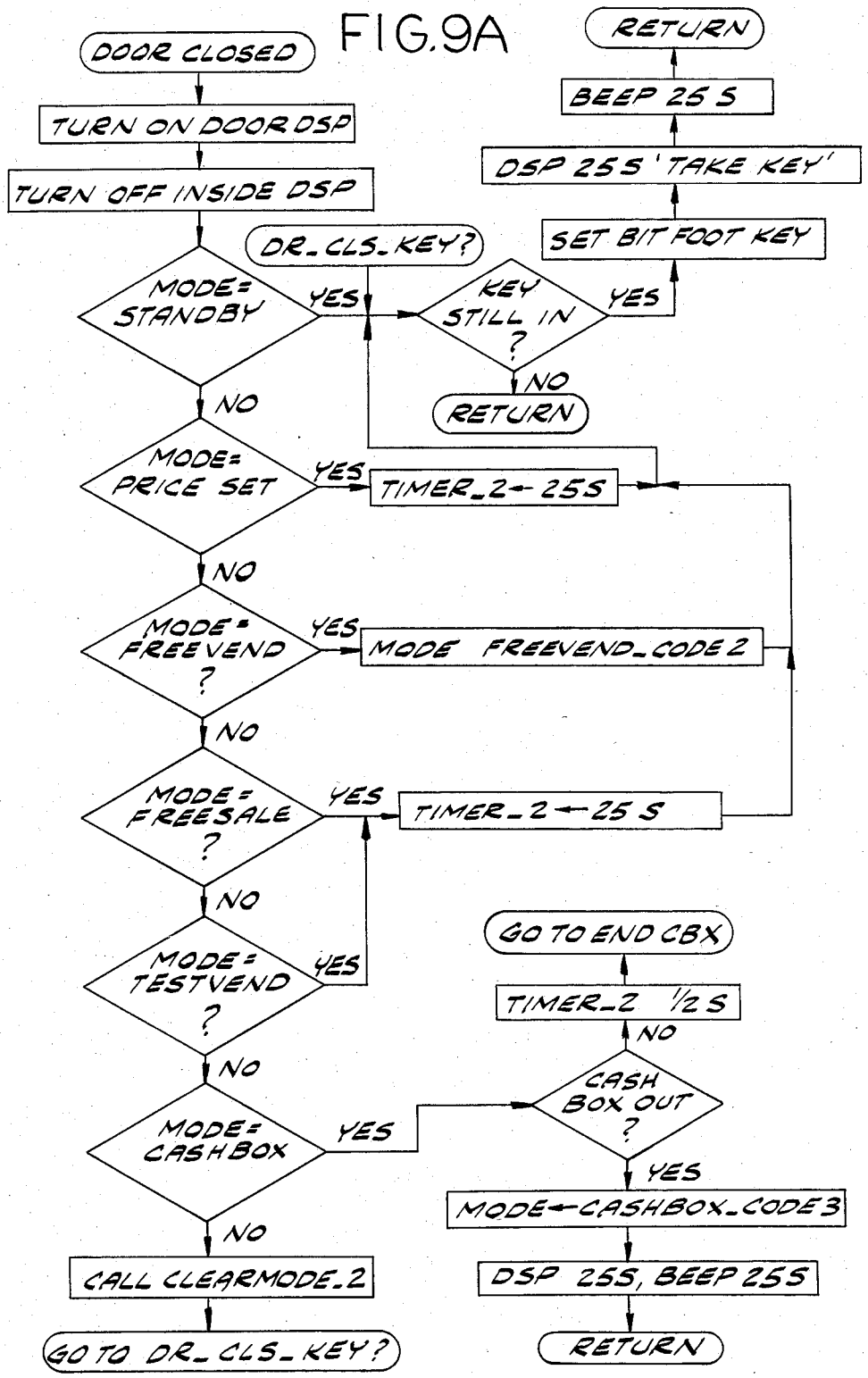
Figure 9B:
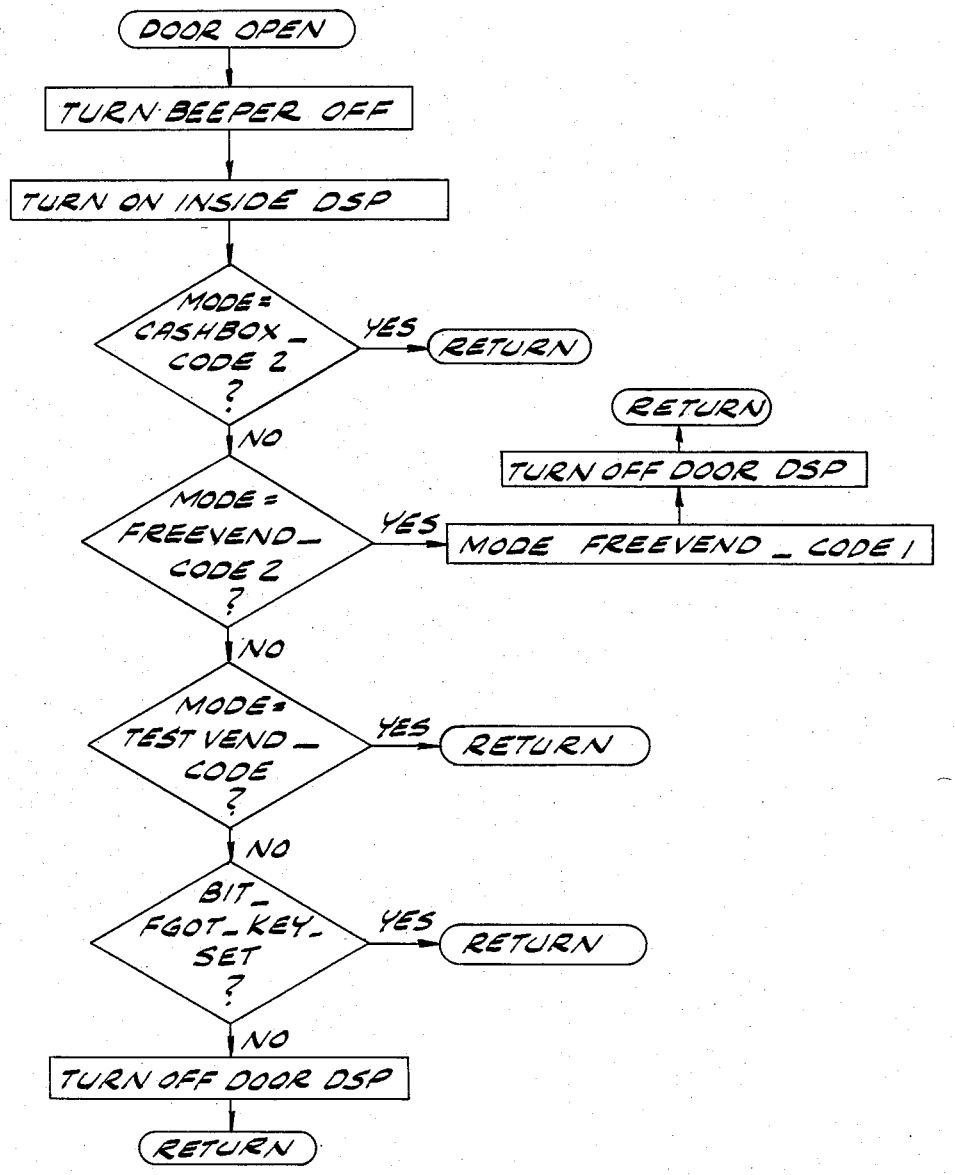
Figure 10:
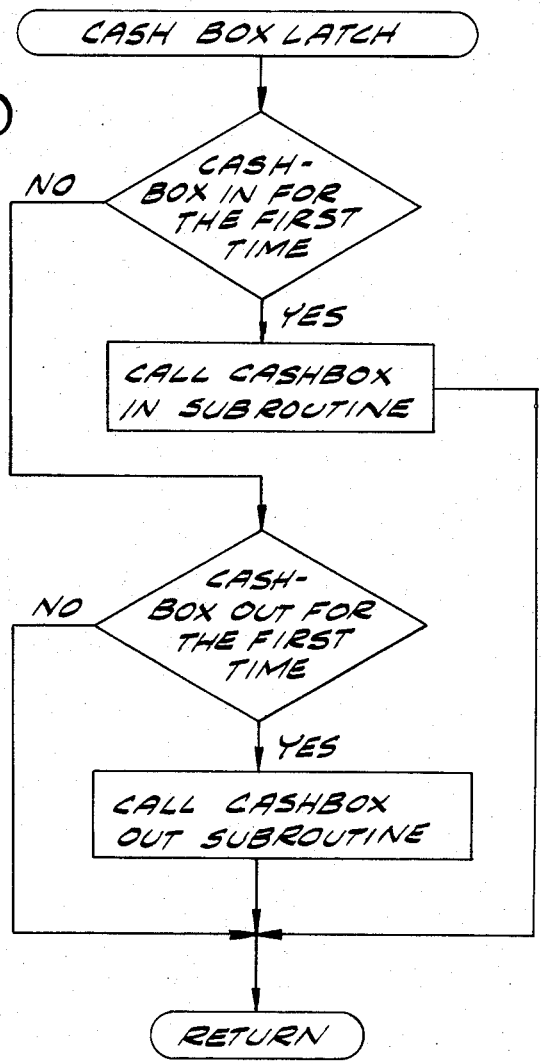

The flowchart for the routine for handling the door switch, referred to in connection with the main program, is shown in FIG. 9. In this routine, microcomputer 43 first checks to see if the door is closed by enabling tri-state buffer 163 by means of decoder 85 and line E3 and then reading over line AD5 the third output from the right of the buffer. This output represents the state of the door closed switch and, therefore, the state of the door itself. If the door is closed, the microcomputer first checks to see if the door was closed the last time it passed thrugh the door switch routine. If it was, no further action is required, so it returns to the main program. If the door was open the previous pass through the program, action is required. Microcomputer 43 performs these required actions in a subroutine labelled Door Closed (FIG. 9A). After returning from the Door Closed subroutine, the microcomputer returns to the main program. In those instances where the door is open rather than closed, the microcomputer after determining this fact first checks whether the door was open the previous time it passed through this subroutine. If it was, no further action is required and the microcomputer returns to the main program. If the door was not open the previous pass through this routine, the microcomputer calls a routine labelled Door Open (FIG. 9B) to perform the necessary actions. After returning from the Door Open subroutine, the microcomputer returns to the main program.

The first step in the Door Closed subroutine (FIG. 9A) is to turn on display 85, which is visible from the outside of vendor 11, and to turn off internal display 29, which is not. This is accomplished by controlling external display power circuit 83 (FIG. 5D) by means of line P11 and internal display power circuit 137 (FIG. 5F) by means of line AD7 and latch 141. After turning on and off the displays as required, the microcomputer tests whether the system is in the standby mode. If it is, the system should be ready to accept customer commands and no keys should be present in slot 35. Microcomputer 43, in a routine labelled DR-CLS-KEY?, checks whether a key is present and if one is sets a flag representing the fact that the service or route person has forgotten his key, displays the message "TAKE KEY" in external display 85, and turns on the beeper for 25 seconds. After the beeper is turned on for 25 seconds, or in those cases where a key is not in slot 35, the microcomputer returns from the Door Closed subroutine.

If the system was not in the standby mode after the displays were turned on and off, the microcomputer then checks whether it is in the price setting mode. If it is in the price setting mode, an internal timer, TIMER2, is set to 25 seconds to give the service person 25 seconds to begin setting or checking prices. After setting the timer, the microcomputer determines whether a key is still in slot 35 and follows the DR-CLS-KEY? routine described above. If the system was also not in the price setting mode, the free vend mode is checked next. If in free vend, the microcomputer places the system in mode 10B in which the machine will display the message "DO NOT INSERT MONEY . . . MAKE SELECTION", and then follows the DR-CLS-KEY? routine described above.

During the Door Closed subroutine, if the machine mode is neither standby, price setting, or free vend, the microcomputer next tests for the free sale mode. In the free sale mode, the next step is to set timer TIMER2 to 25 seconds and go to DR-CLS-KEY? routine. If the system is not in the free sale mode either, the microcomputer determines whether the system is in the test vend mode and if it is follows the same action it would have taken had the system been in the free sale mode. In both these modes, the service person has 25 seconds to perform some action with the vendor door closed before the microcomputer returns to the standby mode.

The last mode checked for by the microcomputer in the Door Closed subroutine is the cash box mode. In those instances where the system is not in the cashbox mode either, the microcomputer calls a subroutine labelled Clearmode-2 (described below in connection with FIG. 18) and then goes to the point in the program labelled DR-CLS-KEY?. If a key has been left in slot 35, it causes the beeper to sound and the "TAKE KEY" message to be displayed. On the other hand, when the system is in the cashbox mode, the next step is to test whether the cashbox is out. This is done by enabling tri-state buffer 163 and reading on line AD6 the output of that buffer representing the in or out status of the cash box. When the cash box is out and the door is closed, the microcomputer sets the system in mode 3(B), displays the message "CLOSE CASH BOX" for 25 seconds, and causes the beeper to sound for 25 seconds. After setting the timers, the microcomputer returns from the Door Closed subroutine. If the cash box is not out, however, microcomputer 43 sets timer TIMER2 to 0.5 seconds and goes to a routine labelled END-CBX, described below in connection with FIG. 10B.

The Door Open routine (FIG. 9B) commences with the microcomputer turning off the beeper, if it is on, and turning on the internal or inside display, display 29. Next the system mode is checked. If the system is in the second cashbox mode, microcomputer 43 returns from the Door Open routine. If the system is in the second free vend mode, the microcomputer changes the mode to the first free vend mode, turns off the door display (external display 85), and returns from the Door Open routine. If the system is in the test vend mode, the microcomputer returns from this routine, as it does if the forgot-key flag is set. Otherwise, the microcomputer first turns off the door display and then returns from the Door Open routine.

The Cashbox Latch routine (FIG. 10) which the microcomputer executes each time through the main program has as its first test whether or not the cash box was in place the previous time the microcomputer executed this routine. The microcomputer performs this test by examining the second output from the right of tri-state buffer 163, since the corresponding input of that buffer is connected via plug P3 to a sensor switch which detects when the cash box is in place. If the cash box is in place for the first time, a Cashbox-In subroutine (FIG. 10A) is called to cause the box to be latched. Otherwise, the microcomputer next tests to see whether the cash box is out of position for the first time. If it is, a Cashbox-Out subroutine (FIG. 10B) is called. If it is not, the microcomputer returns to the main program. The microcomputer also returns to the main program after completing the cashbox-in and cashbox-out subroutines as applicable.

In the Cashbox-In routine (FIG. 10A), microcomputer 43 first tests whether timer TIMER-2 is running and if it is goes to the DR-CLS-KEY? routine (see FIG. 9A) after calling subroutine Clearmode-3 (see FIG. 18) discussed below. Otherwise, after subroutine Clearmode-3 is executed, the microcomputer returns from subroutine Cashbox-In. An important point to remember is that the microcomputer causes the cashbox to be latched in place during normal operation.

The Cashbox-Out routine (FIG. 10B) is also important to the cash accountability aspects of this invention. In the Cashbox-Out routine, microcomputer 43 first stores in RAM chip 93 data representing the opening of the cashbox in two memory locations, one of which represents a perpetual record of openings of the cash box and the other of which represents a resettable total of such openings. Then the microcomputer stores in other locations in RAM the key number of the key used to gain access to the cashbox and the time the cashbox was opened. The remaining steps in the Cashbox-Out routine constitute the End-Cbx routine referred to above. In this routine, the microcomputer turns off the solenoid, puts the system in the second cashbox mode, and returns from the subroutine.

Figure 11:
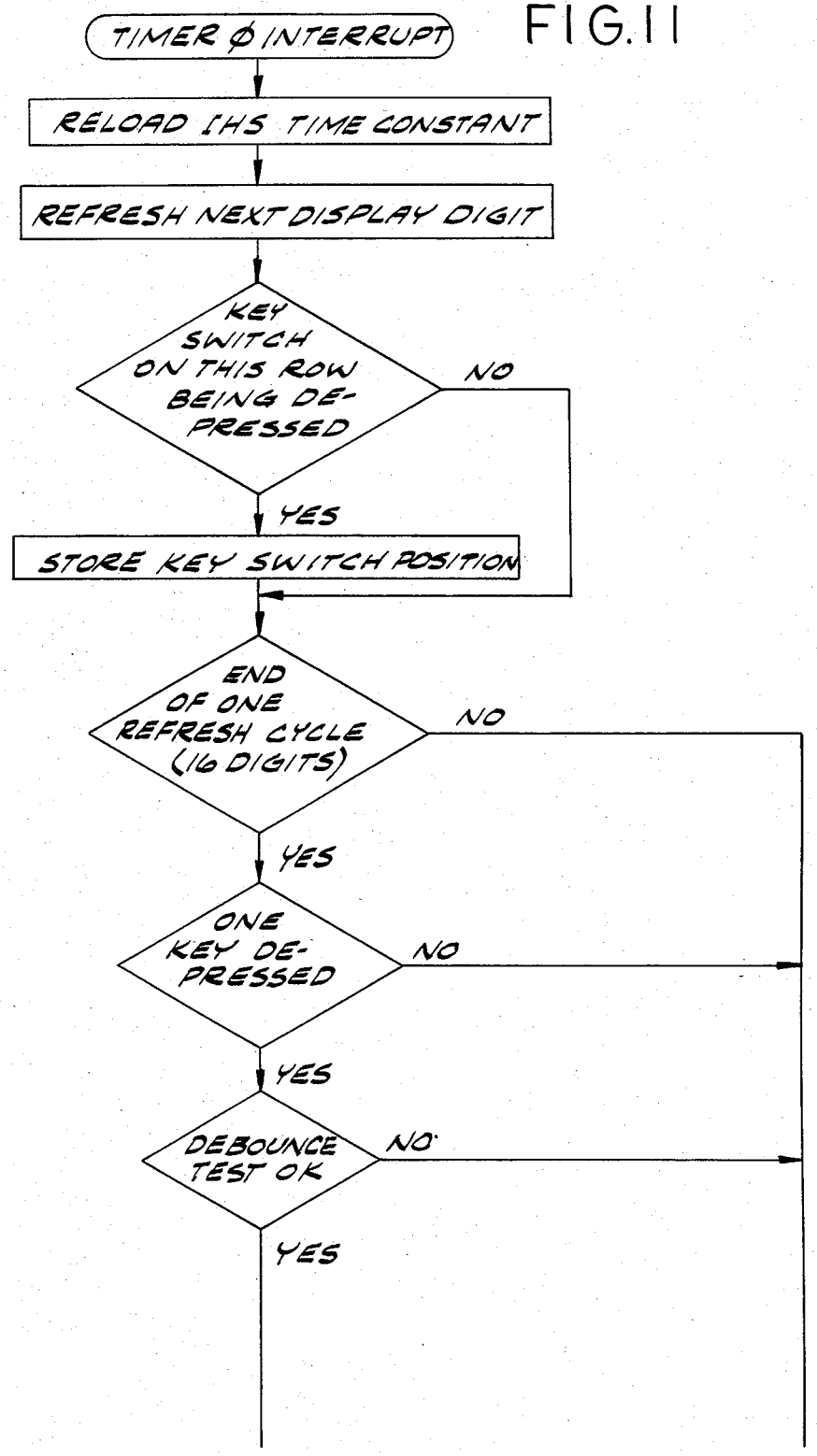
FIGS. 11–11A are flowcharts for an internally generated interrupt sequence of the microcomputer used in this invention.
Figure 11A:
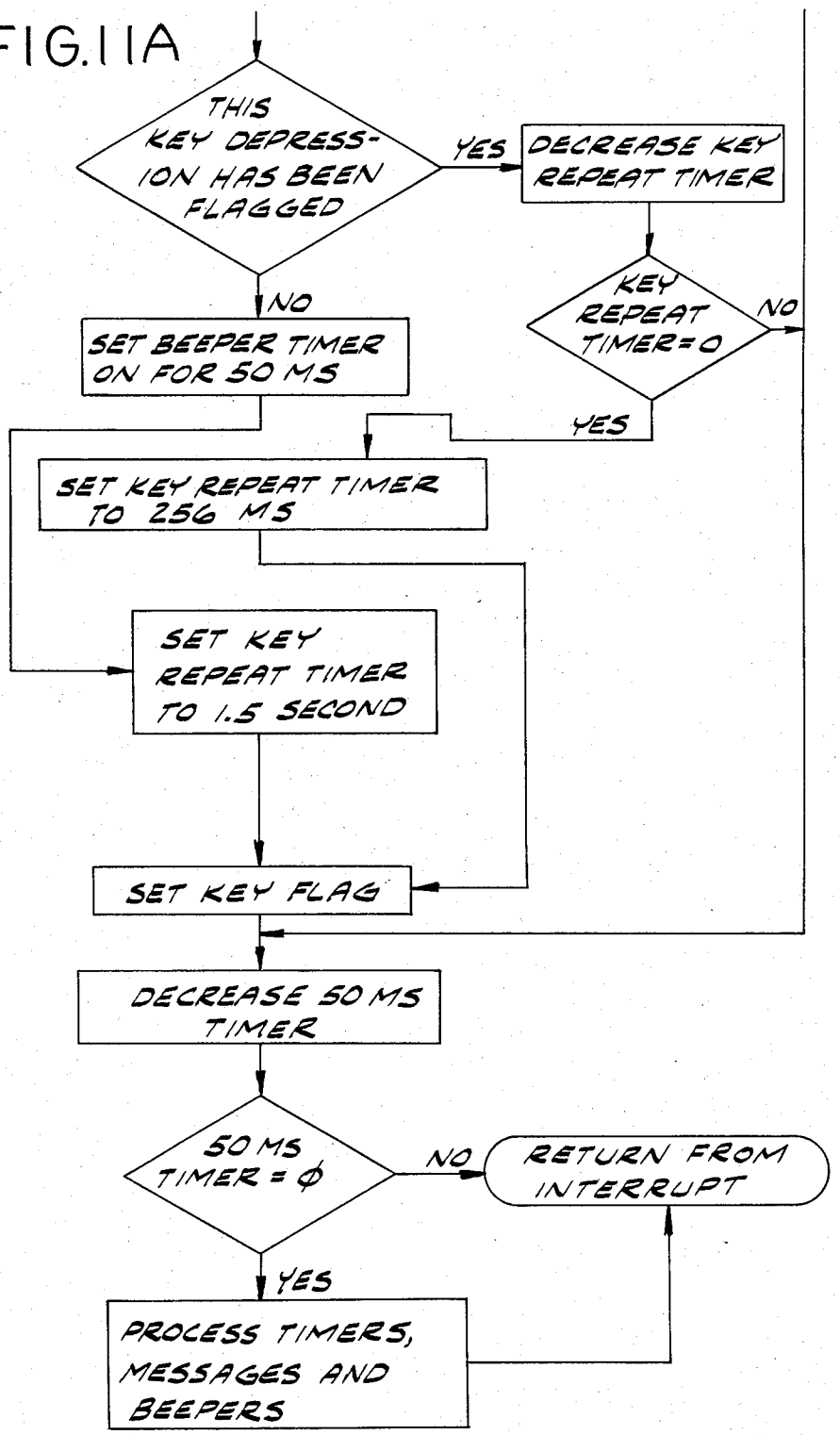
Figure 12:
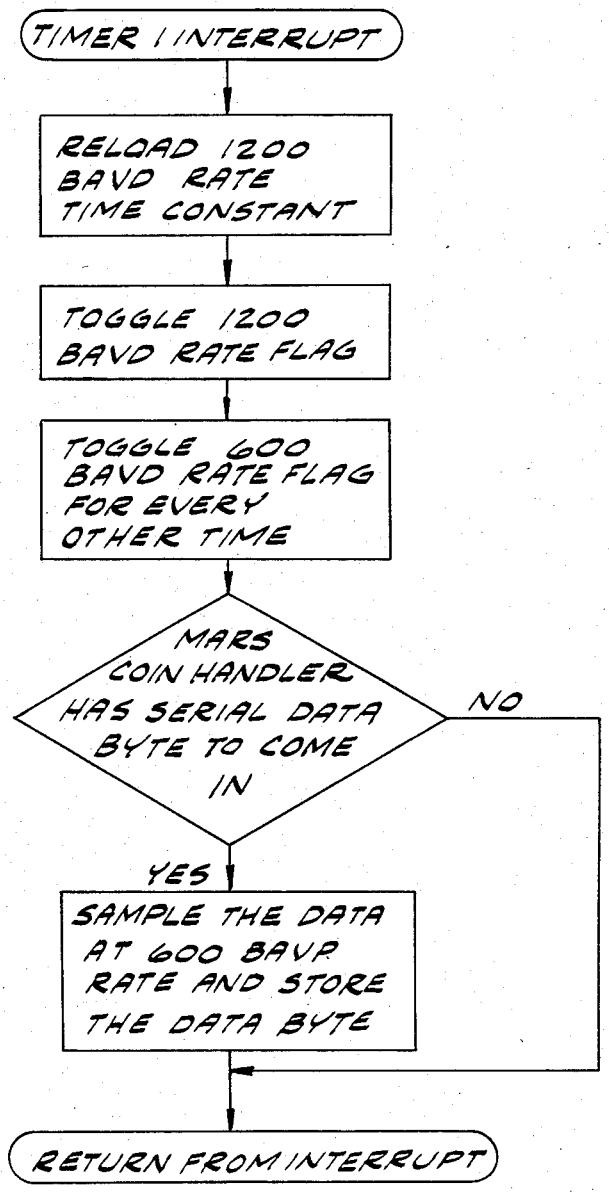
FIG. 12 is a flowchart for a second internally generated interrupt sequence of the microcomputer used in this invention.
Figure 13:
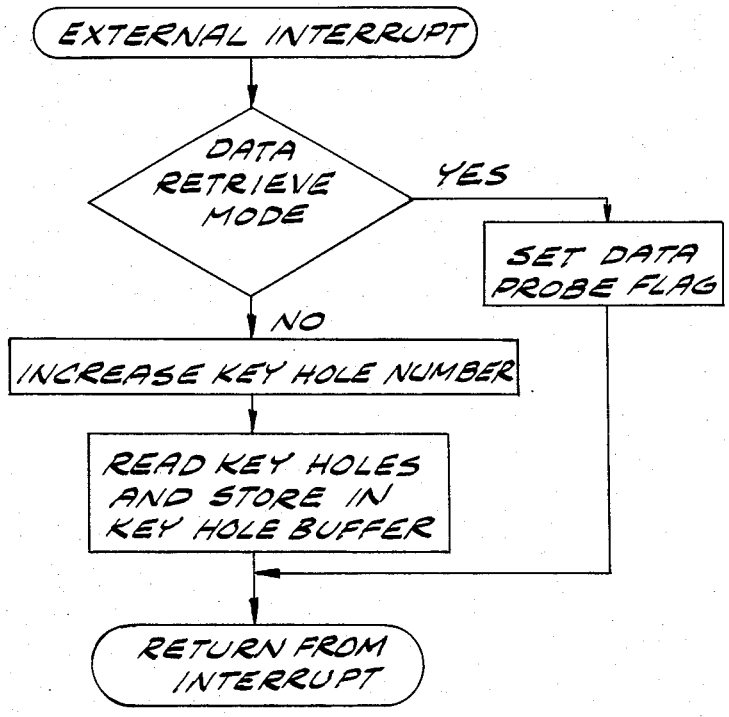
FIG. 13 is a flowchart for an externally generated interrupt sequence of the microcomputer used in this invention.

Microcomputer 43 does not scan the function switch and selection switch matrices as a part of the main program. Rather, function switch and selection switch closures are detected in an interrupt routine labelled TIMER0 Interrupt (FIGS. 11–11A) which is initiated internally by the microcomputer every millisecond. This interrupt also handles refreshing of the internal and external displays. In this interrupt sequence, the microcomputer reloads the timer to begin counting down toward the beginning of the next interrupt. Next it refreshes the next digit in the internal or external display as appropriate. As described above, digits are refreshed by decoder 147 (FIG. 5G) and drivers 151 and 153 under control of the microcomputer. The microcomputer signals over lines AD0–AD3 which digits are to be refreshed and decoder 147 supplies this information via the drivers to the displays. The three least significant outputs of the decoder are also connected via inverters 155, 157, and 159 to the rows of the function switch matrix, so as the microcomputer changes the digit to be refreshed it also strobes a different row of the function switch matrix or the selection switch matrix. After refreshing the particular digit, the microcomputer then reads the output of inverters 161 (FIG. 5M) over lines AD0–AD7 to see if one of the switches on the row being strobed is being depressed. If one is, the position of the depressed key is stored for use by the main program. Otherwise, microcomputer 43 directly checks to see whether a refresh cycle of sixteen digits has been completed. If the refresh cycle is not at its end, the microcomputer decreases a 50 ms timer (FIG. 11A) and then tests whether that timer is decremented to zero. If it is not, the microcomputer returns from the interrupt (FIG. 11A). In those instances in which the refresh cycle is at its end, the microcomputer checks to see if any one key has been depressed, (FIG. 11). If one key has not been depressed, the microcomputer decrements the 50 ms timer mentioned above and, assuming the timer is not decremented to zero, returns from the interrupt. On the other hand, if one switch has been depressed, the microcomputer checks to see if the switch closure has been debounced, that is it checks to make sure the switch was closed a predetermined amount of time sufficient to indicate there was a deliberate switch closure. If the switch closure is not debounced, the microcomputer sets a key repeat timer to 1.5 seconds, decrements the 50 ms timer and so on. If the switch closure is debounced, the microcomputer next checks to see if the switch closure or key depression, has been flagged (FIG. 11A). If the closure has been flagged, the key repeat timer is decremented. If the key repeat timer does not equal zero, the microcomputer then decreases the 50 ms timer and proceeds as described above. If the key repeat timer does equal zero, on the other hand, the key repeat timer is reset to 256 ms and the key flag is set before the 50 ms timer is decremented. Moving back up to the check of whether the switch closure has been flagged, if the switch closure has not been flagged, the microcomputer causes the beeper to beep for 50 ms (to indicate to the user that the switch closure has been detected) and then sets the key repeat timer to 1.5 seconds and sets the key flag as described above. Next, the 50 ms timer is decremented and the timer is checked for zero. If the 50 ms timer has been decremented to zero, the microcomputer processes the timers, any messages to be displayed and control of the beeper before it returns from the interrupt. Inasmuch as this processing does not relate to the cash accountability system of this invention it is not described in detail herein.

There is a second internally generated interrupt sequence labelled Timer1 Interrupt (FIG. 12) which microcomputer 43 follows to communicate with the Mars coin handler. Data from the Mars unit comes in serial form at a 600 baud rate via tri-state buffer 163 to line AD7 of the microcomputer. To read this data, and to read the data from the infrared data probe at a 1200 baud rate, microcomputer 43 loads a 1200 baud rate time constant, toggles a flag representing that fact, and every other time through the routine it toggles a 600 baud rate flag. If the coin handler has a serial data byte to come in that data is sampled at the 600 baud rate and stored in memory. After sampling, the microcomputer returns from the interrupt, as it does directly if no data byte is coming in from the coin handler.

There are two additional interrupt sequences which microcomputer 43 can follow. One is the external interrupt sequence (FIG. 13) initiated whenever key reader 63 detects a hole in key 37 or a pulse was detected which was sent by the magnetic data probe via port 33. In this sequence, the microcomputer first decides if it is in the data retrieve mode. If it is in this mode, microcomputer 43 sets the data probe flag and then returns from the interrupt. If it is not in the data retrieve mode, it initiates the key reader interrupt sequence. In this sequence, the microcomputer increments the keyhole number by one, to keep track of which hole in rows A and C are being read, reads those holes (or the absence thereof) and stores the information read in a buffer. The microcomputer then returns from the interrupt.

Figure 14:
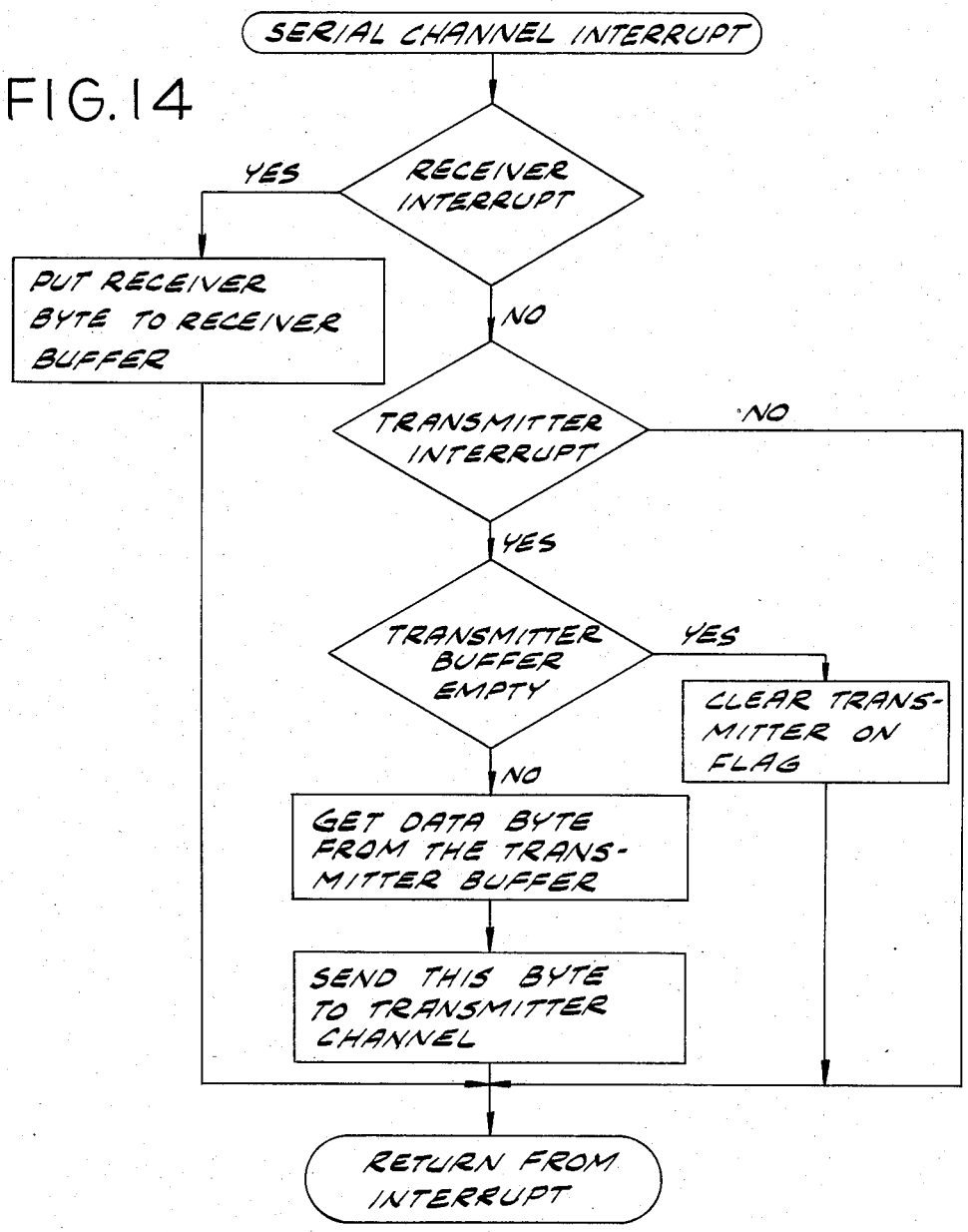
FIG. 14 is a flowchart for a serial channel interrupt sequence of the microcomputer used in this invention.

The other external interrupt sequence is initiated by the receipt from or transmission to a data probe of data (FIG. 14). In this interrupt sequence, the microcomputer tests to see whether the interrupt was caused by the receipt of data from a data probe. If it was, the received data byte is placed in an appropriate buffer, and the microcomputer returns from the interrupt. If the interrupt was not a receiver interrupt, the microcomputer next tests to see if the transmission of data to a data probe caused the interrupt. If not, the interrupt sequence is returned from directly. When the interrupt is a transmitter interrupt, the microcomputer then checks to see if the transmitter buffer is empty. If it is, a flag signifying that the transmitter function is on is cleared and microcomputer 43 returns from the interrupt. If it is not, the data in the transmitter buffer is sent out over pin TO or TXD as appropriate. Microcomputer 43 then returns from the interrupt.

Figure 15:
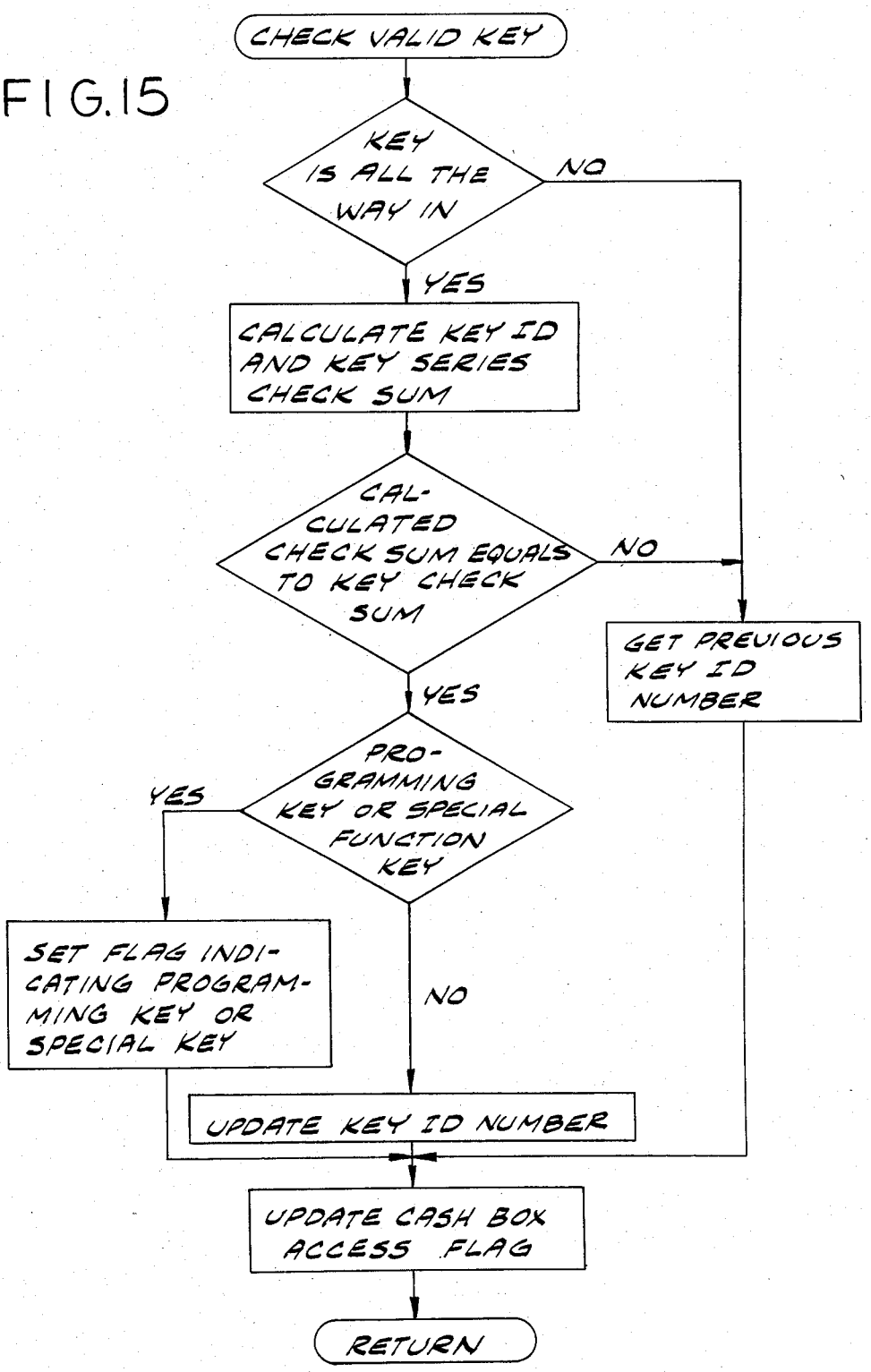
FIG. 15 is a flowchart of a routine of the microcomputer used in this invention in which it checks whether keys used with the system are valid.
Figure 16:
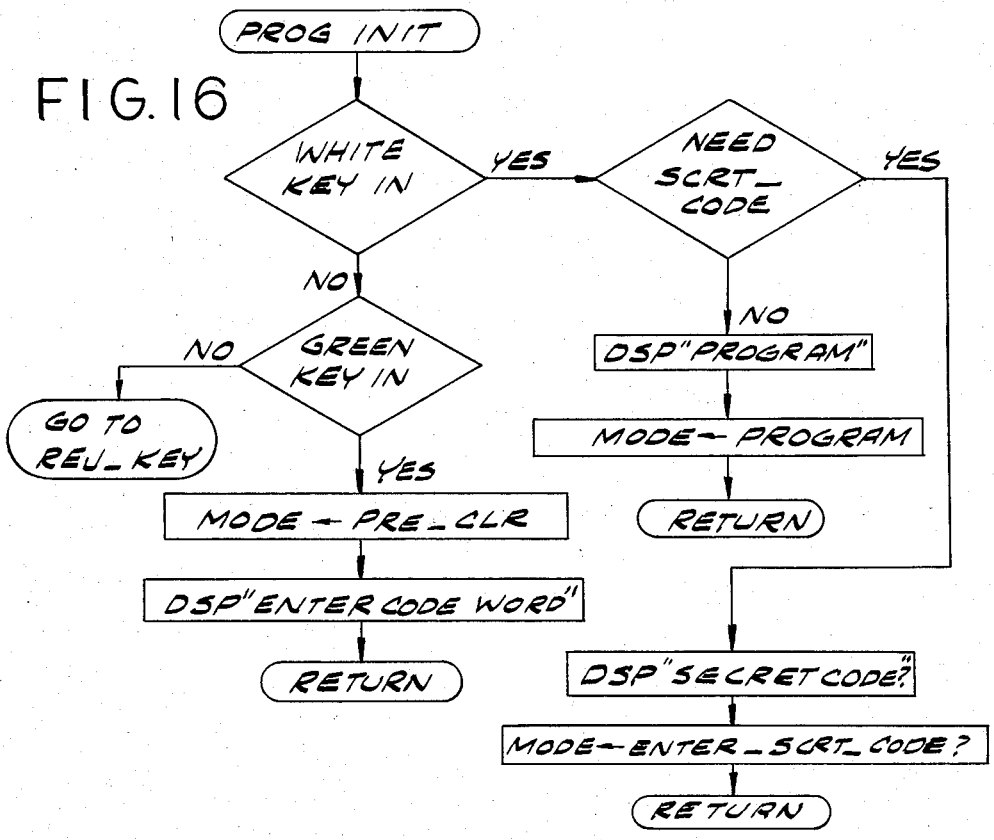
FIG. 16 is a flowchart for a routine of the microcomputer used in this invention in which it sets the mode of the system in response to the type of key being used.

As mentioned above, in the Process Key-In and Key-Out routine the microcomputer tests whether the key is a valid key. The flowchart for making this determination is shown in FIG. 15 and includes the first step of checking whether the key is all the way in slot 35. If it is not, the microcomputer retrieves the identification number of the last key used, updates a flag indicating whether access to the cash box is allowed, and returns from the Check Valid Key subroutine. If the key is all the way in, microcomputer 43 then tests to see if the key has been tampered with by adding the number of identification number holes on the key and comparing that total with the key check sum on that key. If the numbers do not match, the microcomputer follows the same steps it followed when the key was not all the way in. If the key is validated, a check of the key series of the key is then made to see if the key is a programming key or a special function key by checking the series number of the key. If the key is merely a data key, the key identification number is stored, the cashbox access flag is updated, and the microcomputer returns from the subroutine. If the key is instead a programming or special function key, a flag indicating that fact is set, the cashbox access flag is updated, and microcomputer 43 returns from the Check Valid Key routine.

If the key is determined to be valid in the Check Valid Key routine, the microcomputer in the Process Key-In and Key-Out routine (FIG. 7) next tests whether the key is a programming or special function key. That is, it checks the flag indicating that fact which was set in the Check Valid Key routine. If the key is a special function key or a programming key, a routine called PROG. INIT (FIG. 16) is called which sets the state or mode of the system in response to the particular type key being read. The keys can be color-coded and one such coding is indicated in the flowchart for the PROG. INIT routine. In this flowchart programming keys are white keys, clearing keys are green keys, and the lockout or reject key is some other color. In subroutine PROG. INIT the microcomputer first tests the appropriate flag to see if the key in slot 35 is a programming key. If it is, it checks a flag to see if a secret code must be entered before programming of the system via the keyboard console can take place. As is explained below, the operator in initializing the cash accountability system may require that only persons knowing a secret code be able to use a programming key to subsequently program the system. If such a code is needed, microcomputer 43 causes the message "SECRET CODE?" to be displayed in internal display 29, sets a flag indicating that the system is now in an Enter Secret Code mode or state, and returns from subroutine PROG. INIT. Conversely, if a secret code is not required, the microcomputer causes the message "PROGRAM" to be displayed in display 29, sets a flag to indicate that the system is in a Program mode, and returns.

If the key is a special function key instead of a programming key, the microcomputer discovers this fact at the beginning of subroutine PROG. INIT and then checks a flag to see if the key is a clearing key. If it is a clearing key, a flag is set indicating that the system is now in a Pre-Clear state or mode in which it will await the entry of a different secret code necessary to use the clearing key. As is described below, upon entry of the secret code, the stored cash accountability data is erased so that it is not available to a buyer of the vending machine. After setting the Pre-Clear flag, the microcomputer causes the message "ENTER CODE WORD" to be displayed in display 29, and returns from the subroutine.

If the special function key is not a clearing key, the microcomputer upon determining that fact goes to a subroutine labelled REJ-KEY (FIG. 17) in which it handles the reject or lockout key. In subroutine REJ-KEY, microcomputer 43 first sets a flag indicating that the system is now in a lock-out key or reject-key mode, and then examines a set of storage locations in memory reserved for identification numbers of keys which are no longer to be accepted. The microcomputer finds the first blank position in this set of locations or list, labelled REJ-KEY-LIST, and if the list is not full clears a buffer, labelled AMT or Amount, in which a key number of a key to be locked out can be temporarily stored. The microcomputer then causes the message "ENTER NEW REJECT" to be displayed in display 29 and returns. On the other hand, if the list of locked out keys is full the microcomputer causes "REJECT LIST FULL" to be displayed, sets a flag indicating that the system is in a state or mode labelled SHOW-REJ, and then returns.

As mentioned above in connection with FIG. 6A, in the main program microcomputer 43 processes any function switches (i.e., those switches on keyboard console 25) which are depressed. The first of these switches, the Clear Mode switch is processed in the routine illustrated by the flowchart of FIG. 18. If the system is in a program mode when the Clear Mode switch is pressed, clearing the system mode is not allowed, so microcomputer 43 immediately returns from the Clearmode routine if the system is in a programming mode. If the system is instead in the freevend mode, the microcomputer branches to the portion of the Clearmode routine labelled Clearmode-3 in which it changes the mode of the system to standby, sets timer TIMER2 to zero, enables the coin handler, turns on the internal display, reprocesses any key messages, clears the flag which signalled that the system was in the forced test vend mode, clears, if necessary, the flag indicating that a key was required, turns off external display 85, and returns from the subroutine to the main program.

If the mode of the system is the Cashbox mode when the Clear Mode switch is depressed, the microcomputer goes to the End-Cbx routine (FIG. 10B) described above in which it turns off the cashbox latch solenoid, sets the mode of the system to the second Open Cashbox mode (in which "Close Cash Box" is displayed), and returns. On the other hand if the mode is also not the Cashbox mode, microcomputer 43 begins a portion of the Clearmode routine labelled Clearmode-2 in which it first determines whether the system is in the second Payout mode (in which "PAYOUT" is displayed). If it is, microcomputer 43 checks to see if any amount has been paid out of the change tubes while the system was in that mode. If money has been paid out, that amount is added in memory to the perpetual total of paid out money and to the keyed data, the keyed data being the resettable data associating the key used to pay out coins with the amount or amounts paid out. Then, the microcomputer branches to routine Clearmode-3 described above.

If the mode of the system is the second Pulls mode (in which "PULLS" is displayed) when the Clear Mode switch is depressed, the microcomputer goes to a routine Enter Pulls which is described below in connection with the flowchart of FIG. 31. Otherwise it goes directly to routine Clearmode-3 described above.

Figure 19A:
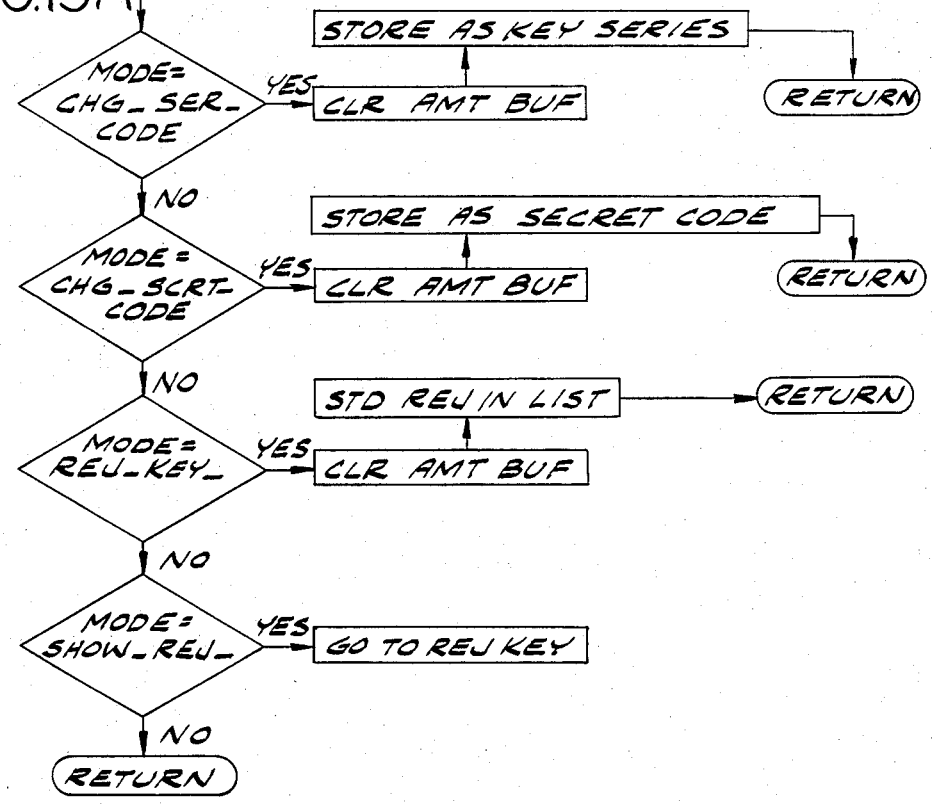
FIGS. 19–19A are flowcharts for a routine of the microcomputer used in this invention in which it clears the amount portion of a display.

The routine in which the microcomputer handles closure of the Clear Amount switch is labelled Clear Amt (FIG. 19 and 19A) and in it the microcomputer takes the following actions depending the mode of the system at the time the Clear Amount switch is depressed. If in the second refund mode, the microcomputer puts the system in the first refund mode, clears the Amount buffer (which clears the amount displayed) and returns from the subroutine. If the system is in the second Pulls mode, the microcomputer puts it in the first Pulls mode, clears the Amount buffer and returns. If the system mode is the change ID? mode, labelled CHG-ID?, in which an operator is attempting to change the identification number associated with the vending machine, the microcomputer sets the system in a state or mode labelled CHG-ID in which it will accept a new identification number, causes the message "ENTER NEW ID" to be displayed, clears the amount buffer, and returns. If the system mode is a mode labelled CHG-SER? in which the operator may be attempting to change the key series number which the system will accept, the microcomputer changes the system mode to one labelled CHG-SER in which the system will accept a new key series code number, causes the message "ENTER NEW SERIES" to be displayed, clears the amount buffer, and returns. Likewise if the operator is attempting to enter or change the secret code used to restrict use of the programming key to those who know the secret code, then the microcomputer changes the state or mode of the system from one labelled CHG-SCRT?-CODE to one labelled CHG-SCRT-CODE in which a new secret code can be entered, causes the message "SECRET CODE?" to be displayed, clears the amount buffer, and returns. If the system is in the Program Clear state, labelled PRG-CLR or CLR-PRG, or the Enter Secret Code state, labelled ENTER-SCRT-CODE, then the microcomputer clears the amount buffer and returns.

If when the microcomputer enters the Clear Amt routine it is in the Change ID Code state, it clears the amount buffer, stores "000" as the new identification number, and returns. Likewise, if the state of the system is Change Series Code or Change Secret Code mode when the microcomputer enters the Clear Amt routine, the microcomputer clears the amount buffer, stores "000" as the next key series or new secret code respectively, and returns. If the mode instead is the Reject Key mode, the microcomputer clears the amount buffer, stores "000" instead of the previous key number in the list of keys to be locked out or rejected, and returns. If the mode is the Show Reject mode, the microcomputer goes to subroutine Rej Key, described above (FIG. 17), and if not it returns directly from subroutine Clear Amt.

Figure 20:
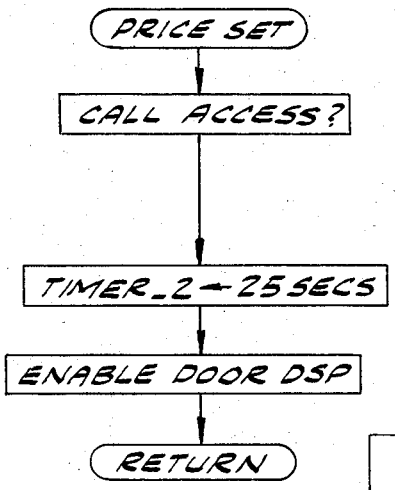
FIG. 20 is a flowchart for a routine of the microcomputer used in this invention in which it responds to the actuation of a price setting switch.

The routine in which the microcomputer handles closure of the Set Prices switch is labelled Priceset (FIG. 20). In routine Priceset the microcomputer first calls a routine labelled ACCESS? (see description in connection with FIGS. 21–21C below), loads timer TIMER2 to twenty-five seconds, enables external display 85, and returns from the Priceset routine.

In routine ACCESS? (FIGS. 21–21C) the microcomputer first tests whether the system mode or state corresponds to the function switch just pressed which caused routine ACCESS? to be called (the identity of which is stored in an identifier labelled New Mode). If it is, a routine labelled SKIP-1ST-RETURN is followed which decrements the stack pointer of the microcomputer twice (to skip the first return) and the microcomputer returns from routine ACCESS?. In those instances when the system mode does not correspond to the switch identified in New Mode, a test is made whether the system is in the Cashbox mode. If it is, routine End Cbx is called (FIG. 10B), the stack pointer is decremented twice, and the microcomputer returns from routine ACCESS?. If the system at the time of the test for the Cashbox mode is in some other mode, a test for the Change ID Code mode is made. If the system at this point is in the Change ID Code mode, the microcomputer follows a portion of the ACCESS? routine labelled Add-ID-Digit. In Add-ID-Digit, if the contents of the amount buffer are equal to or greater than 100,000 a new digit for the ID code is not accepted, the stack pointer is decremented twice and the microcomputer returns from subroutine ACCESS?. On the other hand, if the contents of the amount buffer are less than 100,000 the contents of New Mode represents a digit rather than a system mode. This digit corresponding to New Mode is shifted into the machine ID code as the next digit and the microcomputer follows a portion of the ACCESS? routine labelled Store-ID. In routine Store-ID the contents of the amount buffer are stored in RAM chip 93 in the location reserved for the machine identification number, the stack pointer is decremented twice, and the microcomputer returns from routine ACCESS?. Note that the structure of routine ACCESS? allows ten of the keyboard console switches (those having the indicia 0 to 9) to have a dual purpose. They are used to initiate the setting of system modes but when the system is in certain modes they can instead be used to enter digits into the system for display and storage.

If the system is in the Change Series Code mode when routine ACCESS? is entered, the microcomputer follows a portion of the ACCESS? routine labelled Add-Ser-Digit in which it first checks to see if the contents of the amount buffer are less than 100 (since key series numbers are not to exceed 1000 (decimal)). If the contents are not less than 100 the microcomputer goes to routine Skip-1st-Ret described above. Otherwise the digit corresponding to the contents of New Mode is shifted in as the next digit of the acceptable key series code and a portion of routine ACCESS? labelled STORE-SER is performed. In routine STORE-SER the amount buffer contents are stored in RAM chip 93 in the memory location for the key series, this new key series number is displayed on display 29, the stack pointer is decremented twice, and a return is made from the ACCESS? routine.

If the system is in the Change Secret Code mode when routine ACCESS? is entered, the microcomputer follows the portion of the ACCESS? routine labelled ADD-CHG-SCRT. In this portion of the routine, the current contents of the amount buffer are tested to determine if it is less than 1000. If not, the microcomputer goes to the Skip-1st-Ret routine described above. Otherwise, the digit corresponding to the contents of New Mode is shifted into the amount buffer and, in a portion of the routine labelled Store-Scrt, the contents of the amount buffer are stored in RAM chip 93 in the location reserved for the secret programming code. The contents of the amount buffer are displayed on display 29, the stack pointer 10 is decremented twice, and the microcomputer returns from the ACCESS? routine.

Figure 21:
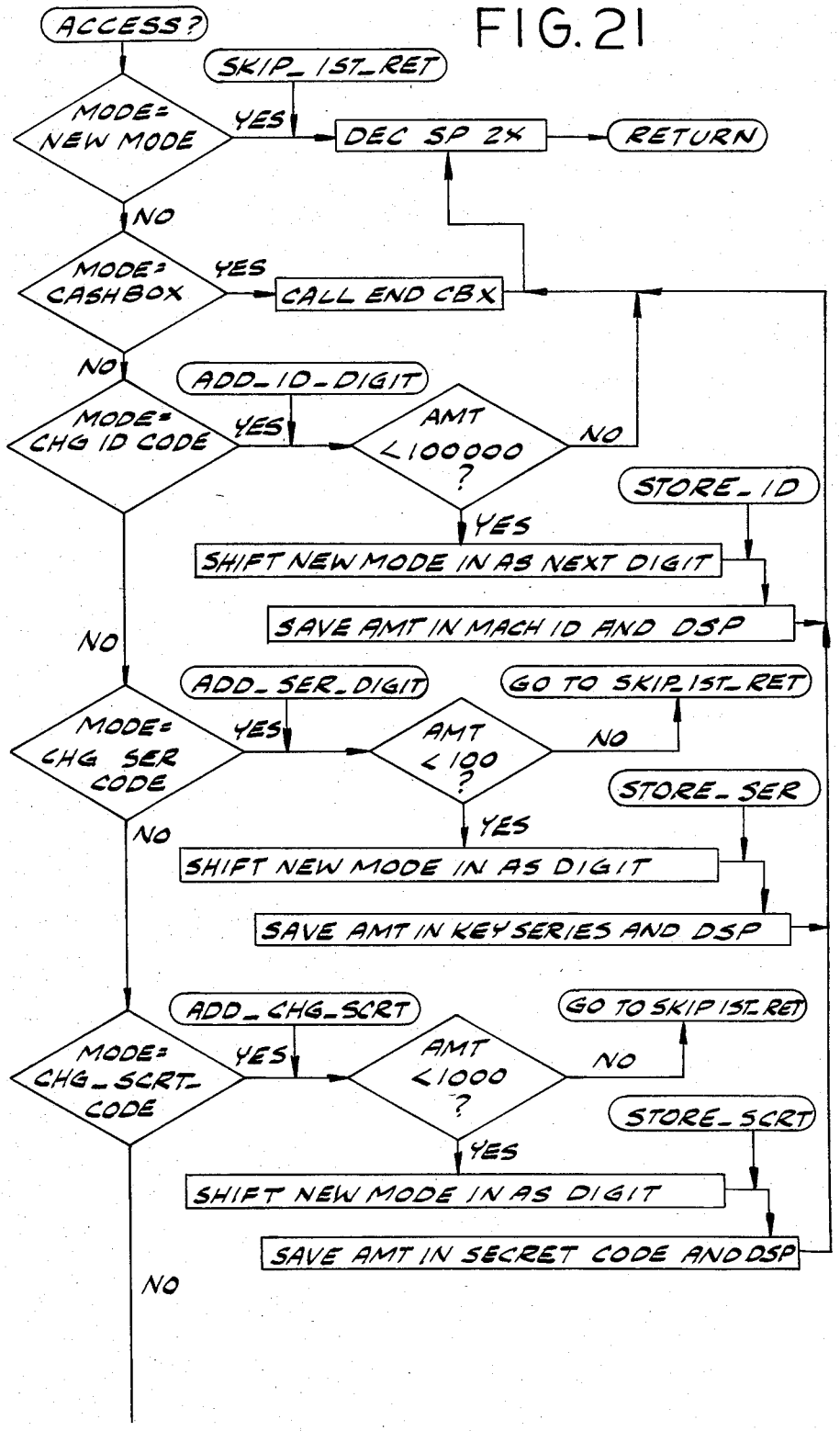
FIGS. 21–21C are flowcharts for a routine of the microcomputer used in this invention in which it checks the mode of the system before allowing or disallowing certain responses to switch closures.
Figure 21A:
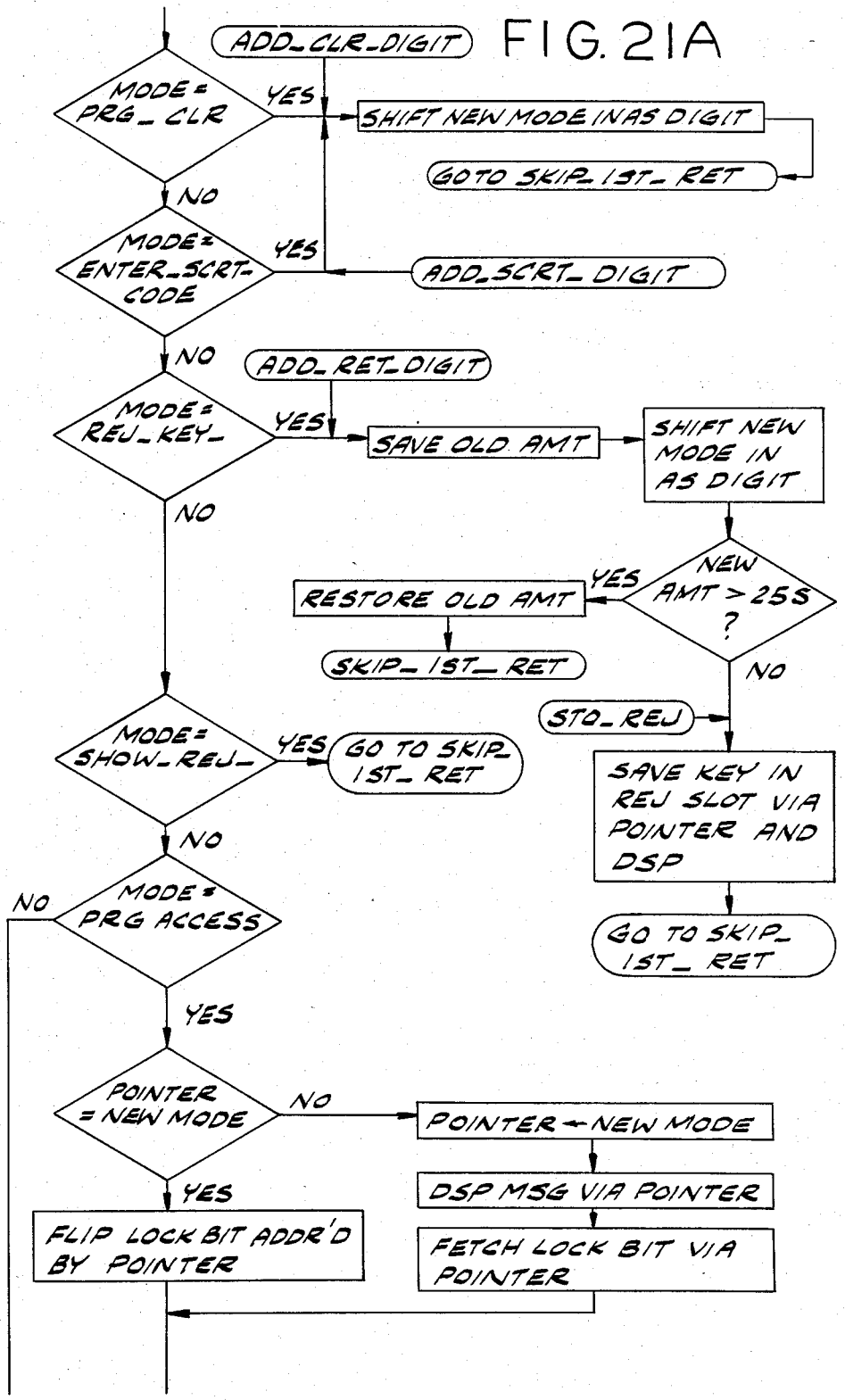

If the system is in the Program-Clear mode or the Enter-Secret-Code mode when routine ACCESS? is entered, the microcomputer follows the following routine (FIG. 21A) which is labelled Add-Clr-Digit in the case of the Program-Clear mode and is labelled Add-Scrt-Digit in the case of the Enter Secret Code mode: the digit corresponding to the contents of New Mode is shifted in as a new digit and the microcomputer goes to routine Skip-1st-Return.

In those instances in which the system is in the Reject Key mode when it enters routine ACCESS?, a portion of the ACCESS? routine labelled Add-Rej-Digit is followed. In Add-Rej-Digit, the contents of the amount buffer is saved, then the digit corresponding to the contents of New Mode is shifted in. If the contents of the amount buffer are now greater than 255 (the maximum key number in this embodiment of the invention), the old amount is restored and the microcomputer goes to the Skip-1st-Return routine. Otherwise, the microcomputer (in a routine labelled STO-Rej) saves the new key number in a slot in its list of keys to be rejected, displays the new key number in display 29, and goes to Skip-1st-Ret.

If the system is in the Show Reject mode when the microcomputer enters routine ACCESS?, the microcomputer immediately goes to the Skip-1st-Return routine. On the other hand, if the system is in the Program Access mode when the microcomputer enters the ACCESS? routine, the microcomputer first tests whether a pointer points to the switch corresponding to the contents of New Mode. If not, the pointer is loaded with the contents of New Mode and a message is displayed on display 29 corresponding to the contents of the pointer. For example, if the Data switch were depressed the pointer would now point to the message "Data" and "Data" would be displayed. Each switch has associated with it in memory a bit representing whether the switch may be used without a key. For example, the operator may want the Test Vend switch to be useable without a key but all other switches useable only with a key. This lock bit for the displayed switch is obtained via the pointer in those cases where the pointer and New Mode did not correspond to the same switch. On the other hand, if the pointer and New Mode did correspond to the same switch this means the switch has been pressed more than once. In this case, the lock bit addressed by the pointer is flipped or complemented, meaning that if the bit was previously a logical "1" it becomes a logical "0" and vice versa. The end result is that if the system is in the Program Access mode, the locked or unlocked status of a switch can be changed back and forth merely by sequentially depressing the switch which one desires to lock or unlock. If the lock bit is set, the message "KEY REQ" is added to the message being displayed at that time (which is merely the name of the switch being locked or unlocked) whereas if the lock bit for that particular switch is not set the message "NO KEY" is added. After changing the displayed message as mentioned, the microcomputer goes to the Skip-1st-Return routine.

Figure 21B:
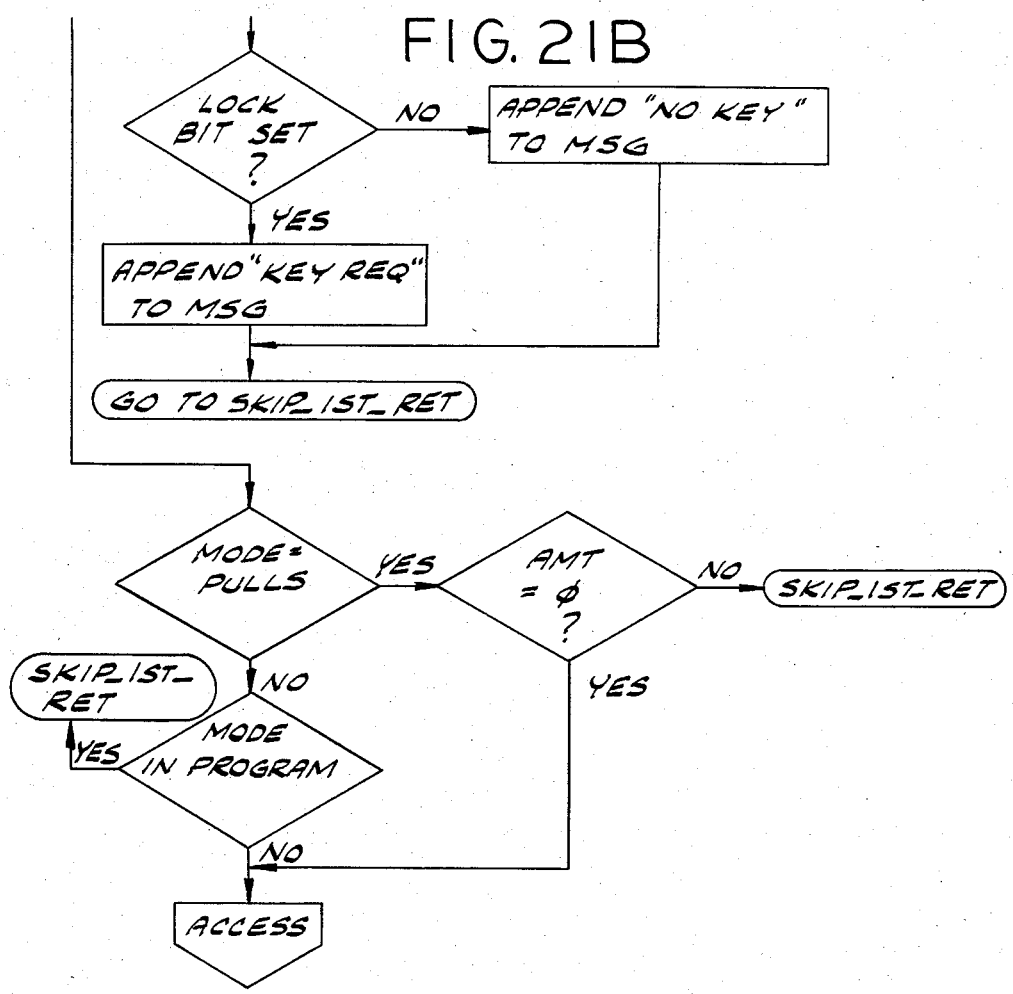
Figure 21C:
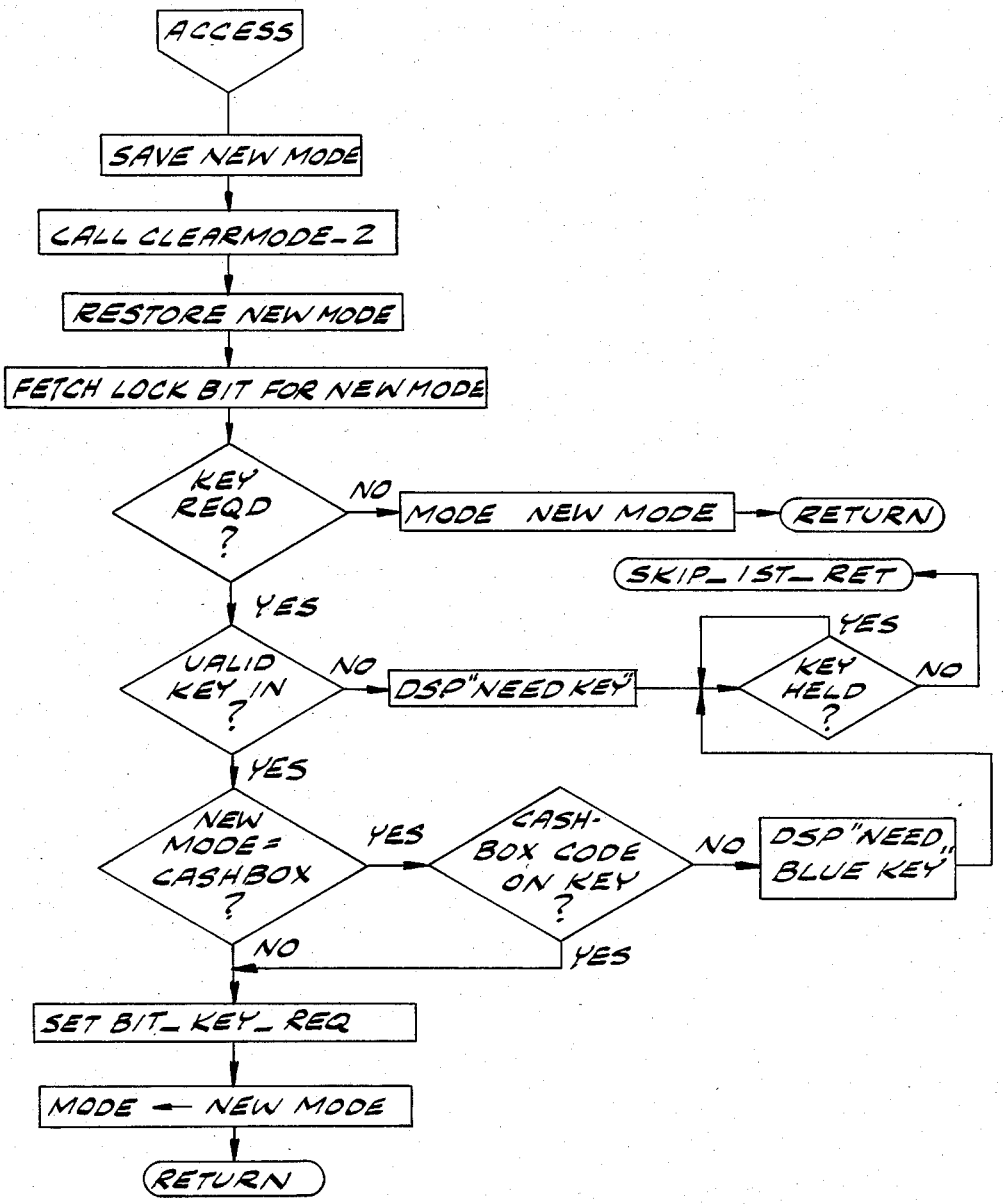

If the system is in the Pulls mode when it enters routine ACCESS?, the microcomputer first checks the amount buffer for zero contents and if the contents are not zero goes to the Skip-1st-Ret routine. If the amount does equal zero, the microcomputer continues with a portion of the ACCESS? routine labelled ACCESS (FIGS. 21C) described below. Likewise, if the system is in one of the program modes when it enters routine ACCESS?, microcomputer 43 goes to the Skip-1st-Ret routine. If it tests for this and finds the system is not in one of the Program modes, the microcomputer follows the Access routine (FIG. 21C).

In routine ACCESS the New Mode contents are saved, routine Clearmode-3 (See FIG. 18) is called, and the information in New Mode is restored. The lock bit for the switch corresponding to the contents of New Mode is retrieved from memory and examined. If the bit indicates that for the particular switch depressed a key is not required, the contents of New Mode are loaded into Mode and the microcomputer returns from the ACCESS? routine. On the other hand, if a key is required by the lock bit for that particular switch, the microcomputer next checks whether a valid key is present in slot 35. If a key is required for the particular switch but no valid key is present in the slot, the microcomputer causes the message "NEED KEY" to be displayed on display 29 and tests whether a key is being held in the slot. If one is present in the slot, it must be invalid, so the microcomputer loops through this step until the switch then being depressed is opened. Otherwise the microcomputer goes to the Skip-1st-Ret routine.

In the ACCESS routine, if a key is required for a particular switch, and a valid key is in the slot, the microcomputer checks whether New Mode represents the depression of the Cashbox switch. If it does, the identification information from the key is read to determine, as described above, if this particular key authorizes access to the cashbox. If it does not, the message "NEED BLUE KEY" is displayed on display 29, signifying that the particular key being used does not authorize access to the cashbox. The microcomputer then goes into the key-held loop described above until the switch then being depressed is opened. On the other hand if New Mode does not represent the Cashbox switch, of if the key does contain the proper cashbox access code, the Bit-Key-Req flag is set, New Mode is loaded into Mode, and the microcomputer returns from the ACCESS? routine.

Figure 22:
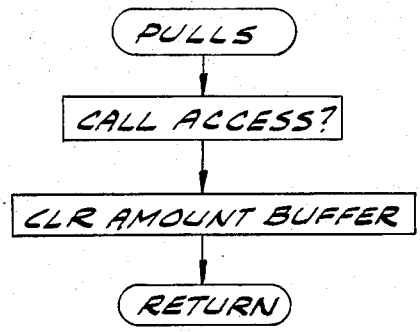
FIG. 22 is a flowchart for a routine of the microcomputer used in this invention in which it responds to the activation of a pulls switch.

The routine in which the processing of the Pulls switch is handled is shown in FIG. 22. In this routine, the ACCESS? routine is called and, assuming that switch has not been locked as described above, the microcomputer clears the amount buffer and returns from the Pulls routine. If, on the other hand, the Pulls switch has been locked, the microcomputer in the ACCESS? routine recognizes that fact and skips the return to the Pulls routine.

Figure 23:
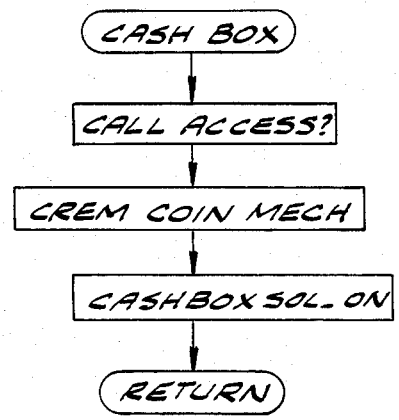
FIG. 23 is a flowchart for a routine of the microcomputer used in this invention in which it responds to the actuation of a cashbox switch.

The routine in which the processing of the Open Cashbox switch is handled is shown in FIG. 23. This routine, like the Pulls routine, is completed only if the ACCESS? routine reveals the present key is a valid key and allows access to the cashbox. If the microcomputer returns from the ACCESS? routine to the cashbox routine, it causes the coin handler to be cremed, i.e., it prevents the coin handler from accepting additional coins until further notice, and it unlatches the cashbox in a routine labelled Cashbox Sol-On. Then the microcomputer returns from the cashbox routine.

Figure 24:
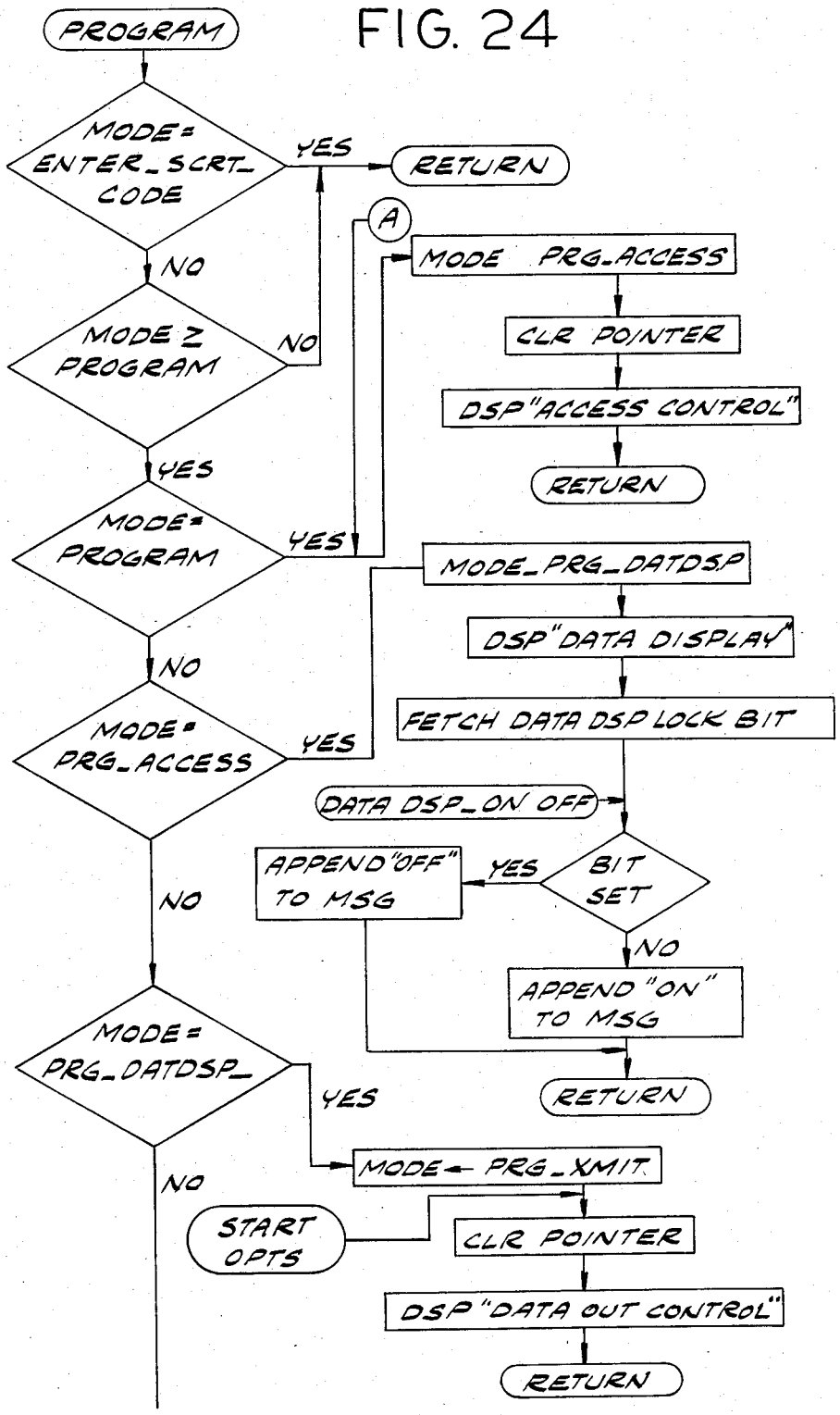
FIGS. 24–24B are flowcharts for a routine of the microcomputer used in this invention in which it responds to the actuation of a program switch.
Figure 24A:
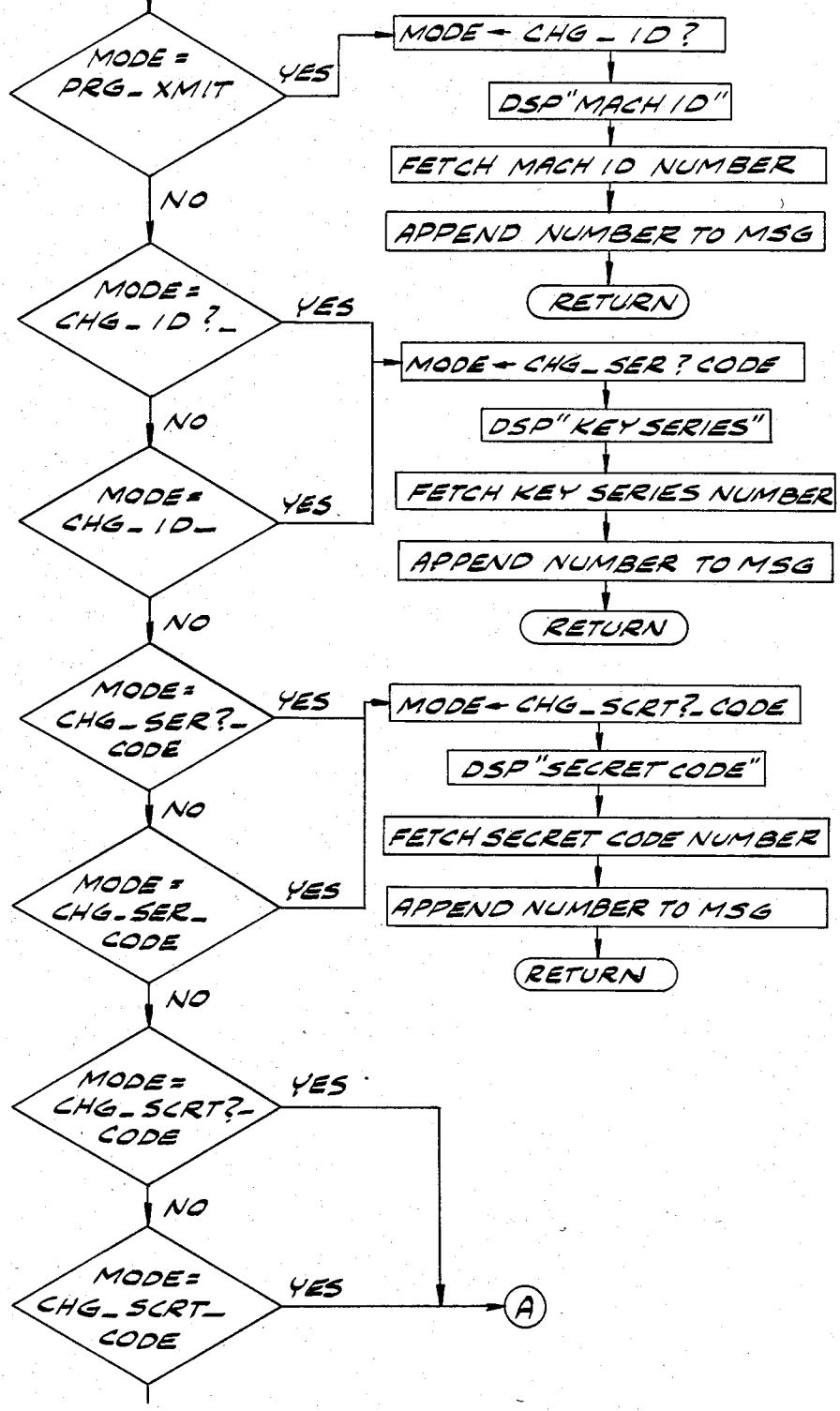
Figure 24B:
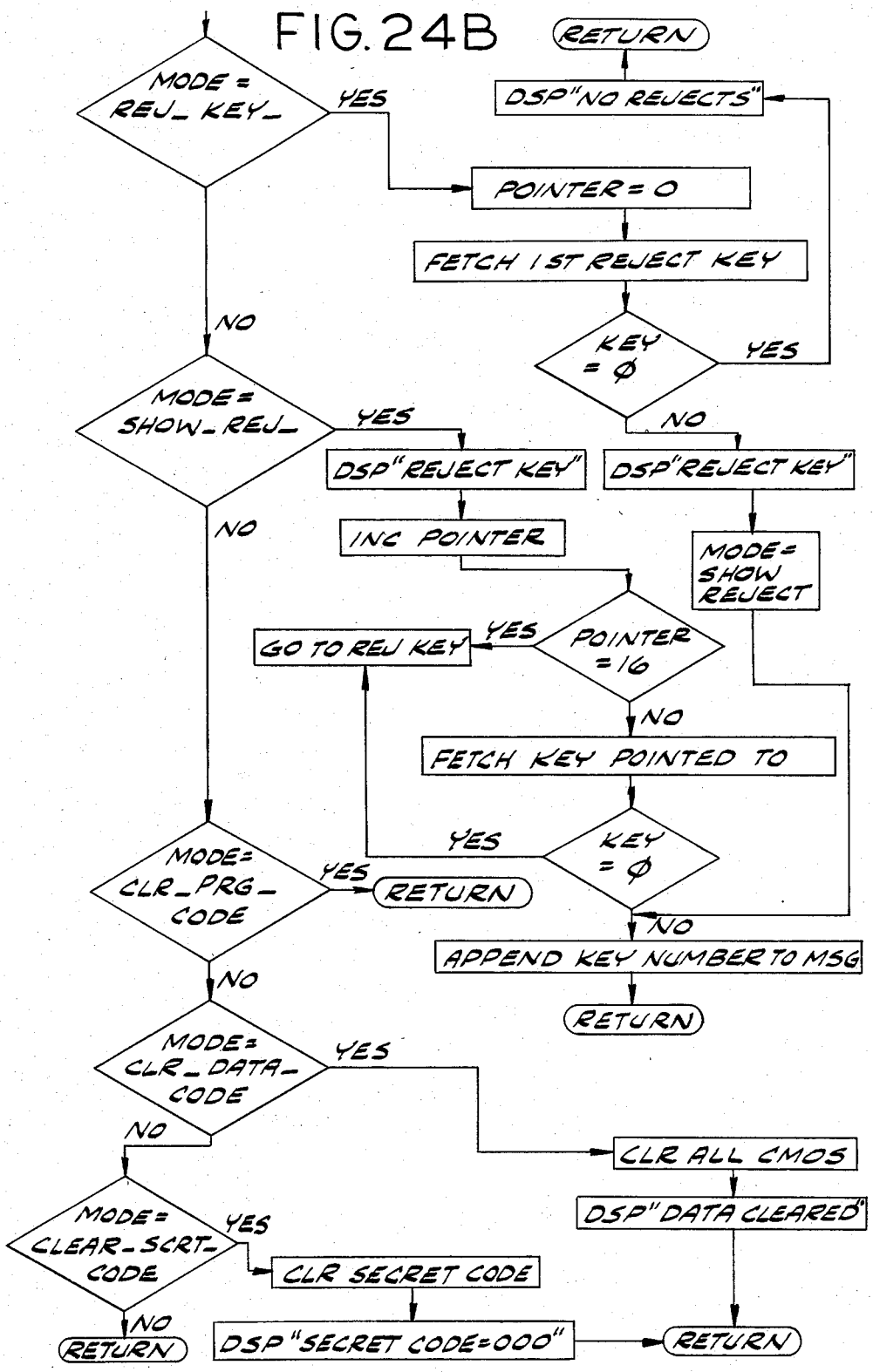

The routine for handling the Program switch is shown in FIGS. 24–24B. If the system is in the Enter Secret Code mode or a mode which is less than the Program Code modes, then the microcomputer returns from the Program routine because the closure of that switch while the system is in these modes is ignored.

If the system is in the Program mode when the microcomputer enters the Program routine, the mode of the system is changed to the Program Access mode, the pointer is cleared, the message "ACCESS CONTROL" is displayed in display 29, and the microcomputer returns from the Program routine. This sequence of actions is labelled A on FIG. 24. If the system is in the Program Access mode when the microcomputer enters the Program routine, the system mode is changed to the Program Data Display mode, the message "DATA DISPLAY" is displayed on display 29, and the lock bit for the data display, display 29, is retrieved. Then, in a portion of the Program routine labelled Data Dsp-On-Off, the data display lock bit is examined. If the data display lock bit is set, the word "OFF" is appended to the message on display 29. The message then reads "DATA DISPLAY OFF" and microcomputer 43 returns from the Program routine. On the other hand, if the data display lock bit is not set the message displayed reads "DATA DISPLAY ON".

If the system is in the Program Data Display Code mode when the microcomputer enters the Program routine, the microcomputer changes the mode to the Program Transmit mode, clears the pointer, causes the message "DATA OUT CONTROL" to be displayed, and returns from the Program routine. The portion of this routine after the system mode is changed to the Program Transmit mode is labelled Start Opts.

Referring to FIG. 24A, if the system is in the Program Transmit Code mode when the microcomputer enters the Program routine, the mode is changed to the Change ID? mode, the message "MACH ID" is displayed on display 29, and the machine identification number is retrieved from memory and also displayed on display 29 before the microcomputer returns from the Program routine. If the system is already in the Change ID? mode when the microcomputer enters the Program routine or if it is in the Change ID mode, the microcomputer puts the system in the Change Series? Code mode, causes the message "KEY SERIES" to be displayed on display 29, fetches the current key series number from memory and displays it, and then returns from the Program routine. Likewise, if the system is already in the Change Series? Code mode or the Change Series Code mode when the microcomputer enters the Program routine, it changes the system mode to the Change Secret? Code mode, causes the message "SECRET CODE" to be displayed, retrieves the current secret code from memory and displays it, and then returns from the routine.

If the system is in the Change Secret? Code mode or the Change Secret Code mode when microcomputer 43 enters the Program routine, it follows that portion of the routine labelled A (see FIG. 24), described above, in which the system mode is changed to Program Access and the message "ACCESS CONTROL" is displayed. Thus, sequential operation of the Program switch causes the system mode to be changed in a predetermined order if the mode of the system when the switch is pressed is Program, Program Access, Program Data Display , Program Transmit, Change ID?, Change ID, Change Series? Code, Change Series Code, Change Secret? Code, or Change Secret Code. But the Program switch has other uses as well.

If the system is in the Reject Key mode when the microcomputer enters the Program routine (FIG. 24B), the microcomputer sets the pointer to point at the first item in the list of keys which are locked out and fetches the key number pointed to. If this item equals zero, there are no locked out keys, so the message "NO REJECTS" is displayed on display 29 and the microcomputer returns from the Program routine. If this item does not equal zero, the microcomputer causes the message "REJECT KEY" to be displayed, the system mode is changed to Show Reject, and the key number is appended to the message.

If the system was in the Show Reject mode when it entered this Program routine, the microcomputer causes the message "REJECT KEY" to be displayed, and the pointer to be incremented. After incrementing the pointer, the microcomputer tests whether the pointer has been incremented to sixteen. If it has the microcomputer goes to routine Reject Key described above (FIG. 17). Otherwise the key number pointed to is retrieved from memory and compared with zero. If the key number does equal zero, the end of the list of locked out keys has been reached, so the microcomputer goes to the Reject Key routine (FIG. 17). If the pointer does not equal sixteen and the key number pointed to does not equal zero, the retrieved key number is also displayed along with the message "REJECT KEY" on display 29, and the microcomputer returns from the Program routine.

If the system is in the Clear Program mode when the microcomputer enters the Program routine, it simply returns from that routine because the Program switch is ineffectual while the system is in the Clear Program mode.

If the system is in the Clear Data mode when it enters the Program routine, the microcomputer causes the data in RAM chip 93 to be erased so that machine 11 may be sold to another without revealing the confidential data normally stored in RAM chip 93. The microcomputer then displays "DATA CLEARED" on display 29 and returns from the Program routine.

If the system is in the Clear Secret Code mode when the microcomputer enters the Program routine, the microcomputer sets the secret code equal to zero, displays the message "SECRET CODE=000", and returns from the Program routine.

Figure 25:
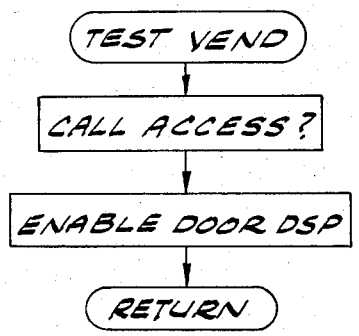
FIG. 25 is a flowchart for a routine of the microcomputer used in this invention in which it responds to the actuation of a test vend switch.

The Test Vend switch routine is shown in FIG. 25. In it the microcomputer calls the ACCESS? routine and, if a return is made from the ACCESS? routine to the Test Vend routine, enables external or door display 85 and returns from the Test Vend routine.

Figure 26:
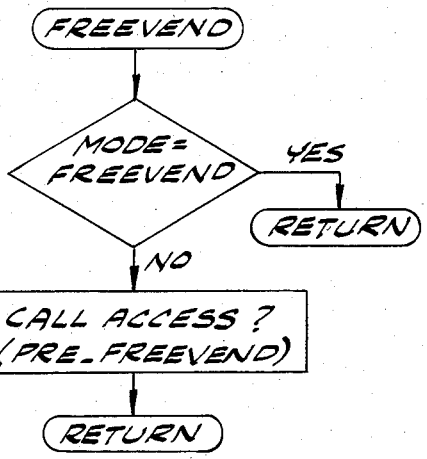
FIG. 26 is a flowchart for a routine of the microcomputer used in this invention in which it responds to the actuation of a free vend switch.

The Free Vending switch routine is shown in FIG. 26. If the system mode is already Free Vend when the Free Vending switch is pressed, the microcomputer returns from the Free Vend routine. On the other hand, if the mode of the system was not Free Vend at that time, the Newmode (which is tested in the ACCESS? routine) becomes Pre-Free Vend mode and the ACCESS? routine is entered.

Figure 27:
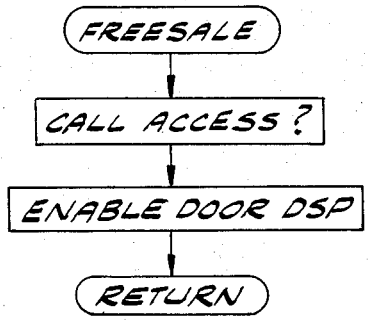
FIG. 27 is a flowchart for a routine of the microcomputer used in this invention in which it responds to the actuation of a free sale switch.

The routine for the "*" switch is shown in FIG. 27 and is labelled Free Sale. In this routine the ACCESS? routine is called and if a return is made from the ACCESS? to the Free Sale routine, the door display is enabled and the microcomputer returns from the Free Sale routine.

Figure 28:
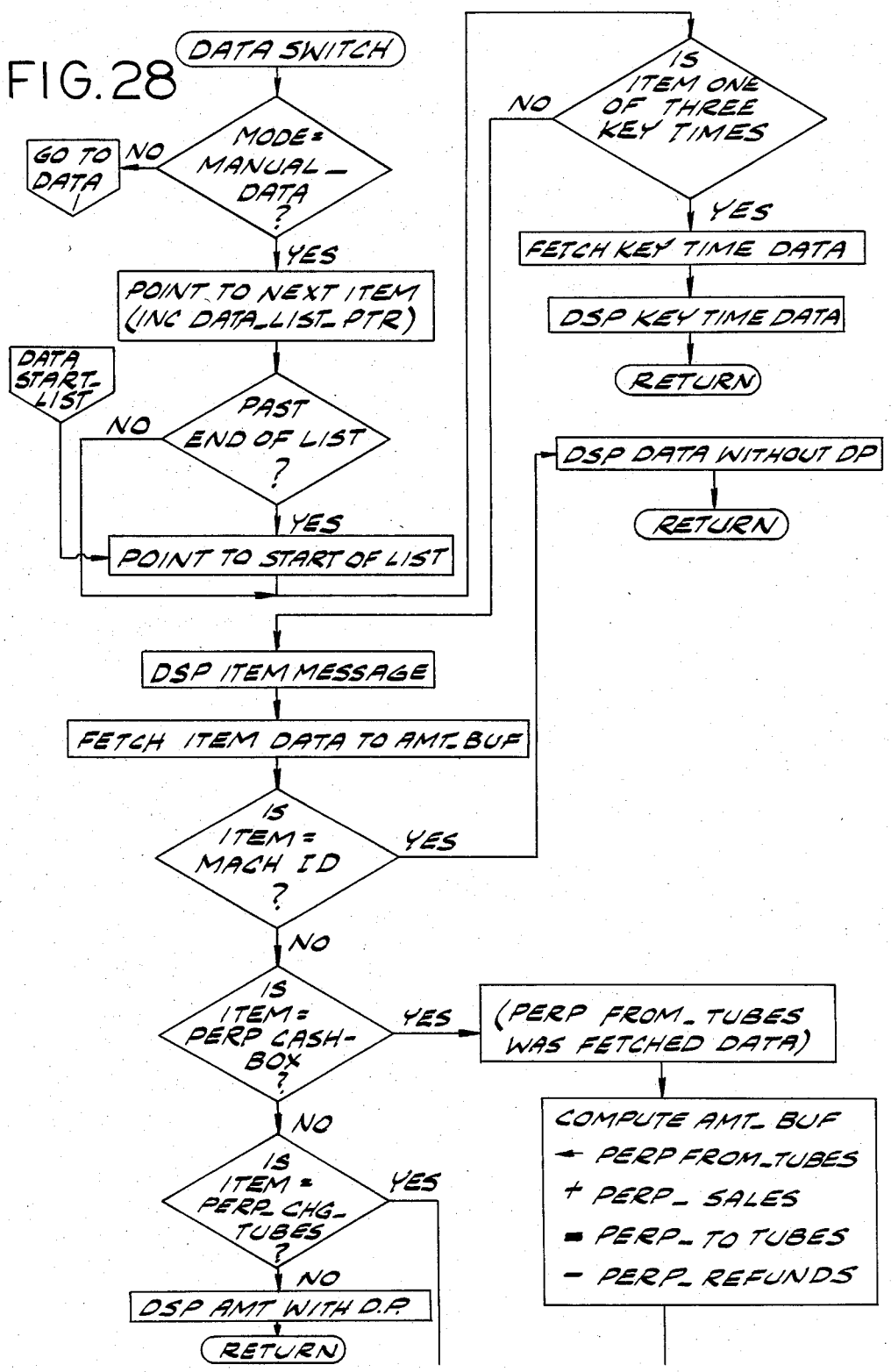
FIGS. 28–28C are the flowchart for a routine of the microcomputer used in this invention in which it responds to the actuation of a data switch.
Figure 28A:
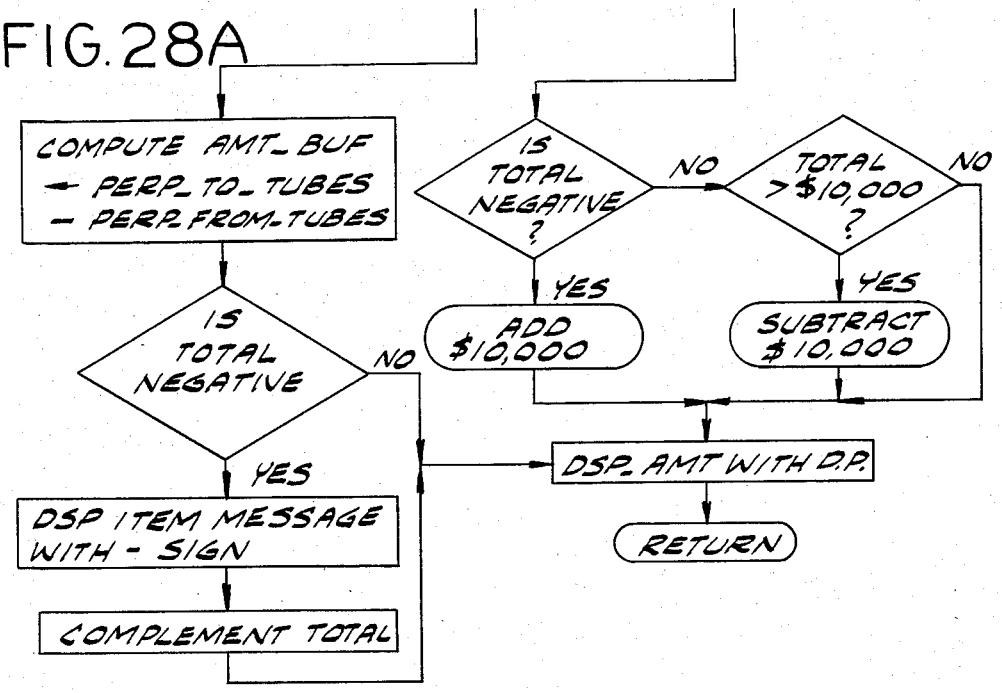
Figure 28B:
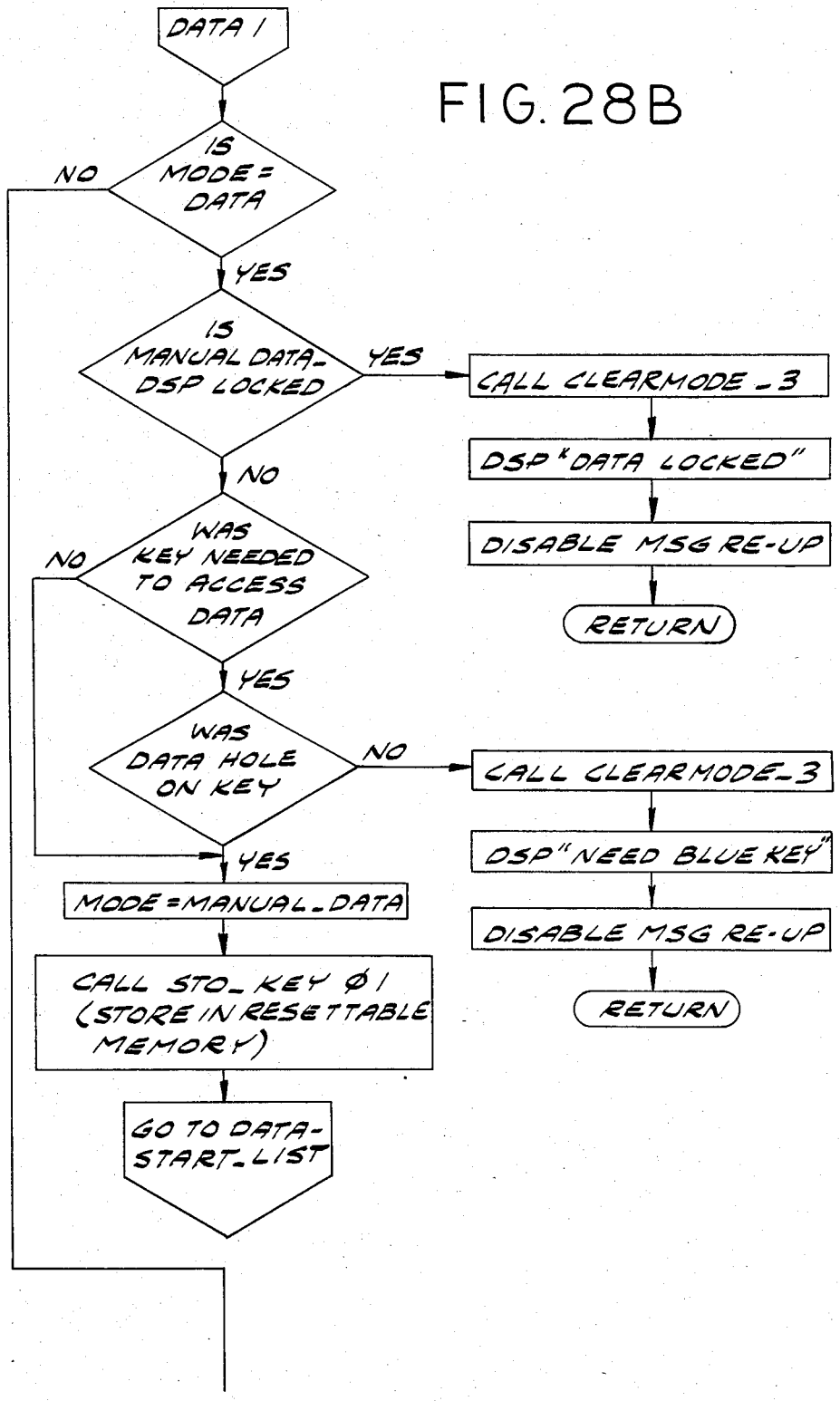
Figure 28C:
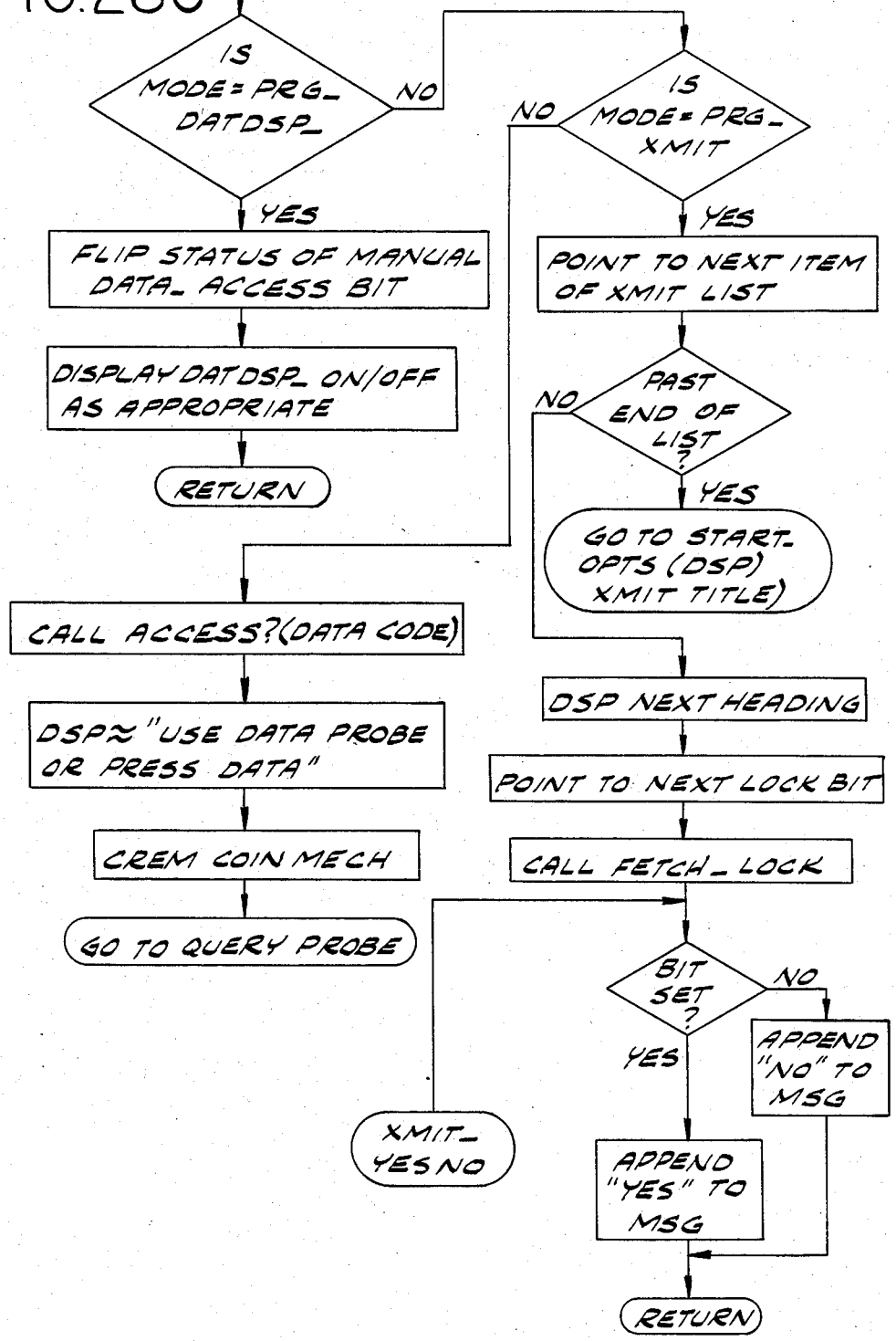

The routine for the Data Switch is shown in FIGS. 28–28C. If the system is in the Manual Data mode when the Data switch is pressed this means the service or route person is pressing the Data switch to obtain the display of a number of different data items on display 29. Each time through the Data Switch routine the pointer (labelled Data-List-Ptr) which points to these data items is incremented. If as a result of the incrementing, the pointer is pointed past the list of data items to be displayed, the pointer is reset to point to the start of the list. This resetting step is labelled Data-Start-List in FIG. 28. Next the microcomputer tests whether the data item is one of three key times which, as described below, are stored in memory. If it is, the key time data is retrieved and displayed, and the microcomputer returns from the Data Switch routine. On the other hand, if the item is not one of the three key times items the microcomputer causes to be displayed in display 29 a message corresponding to the item pointed to. For example, if the item pointed to is the machine identification number, the message "MACH ID" is caused to be displayed. Other possible messages are "PERP CASHBOX" (data pointed to is the perpetual total for money in the cashbox) and "PERP CHG TUBES" (data pointed to is the perpetual total of money in the change tubes). After displaying the requisite item message the data pointed to by the pointer is retrieved from memory and stored in the amount buffer. Then the microcomputer tests whether the item pointed to is the machine identification number. If it is, the data pointed to is displayed without a decimal point on display 29 and the microcomputer returns from the Data Switch routine.

If the item pointed to is the perpetual cashbox total the item retrieved from the memory was the perpetual total of coins from the change tube. This figure is added to the perpetual sales figure from memory. The perpetual total of money going to the change tubes is subtracted from this figure, as is the perpetual total of refunds figure, and the total is loaded into the amount buffer. If the total is negative (FIG. 28A) the microcomputer adds $10,000 to it, displays the amount with a decimal point, and returns from the Data Switch routine. If the perpetual cashbox figure is not negative, it is compared with $10,000. If it is greater than $10,000 that amount is subtracted from the perpetual cashbox figure, and the resulting lesser figure is displayed. Otherwise the perpetual cashbox figure itself is displayed.

If the item pointed to is the perpetual change tubes figure, the microcomputer stores the difference between the perpetual-to-tubes amount and the perpetual-from-tubes amount in the amount buffer. If this difference is negative the minus sign is added to the message, the amount is complemented and the complemented amount displayed. Then the microcomputer returns from the Data Switch routine. On the other hand, if the perpetual change tube figure is not negative, it is displayed directly and the return from the Data Switch routine is made.

If the item pointed to is some item other than machine identification number, perpetual cahsbox, or perpetual change tubes, the amount is displayed in display 29 with a decimal point (FIG. 28) and the microcomputer returns from the Data Switch routine.

Going back to the start of the Data Switch routine, if the system is not in the manual data mode when the Data switch is pressed, the microcomputer follows that portion of the Data Switch routine labelled DATA-1 and shown in FIGS. 28B–28C. In the DATA-1 routine, the microcomputer tests whether the system is in the data mode and, if it is, whether the manual display of data is locked. If the display of data by manually pressing the data button is locked, routine Clearmode-3 (FIG. 18) is called, the message "DATA LOCKED" is displayed on display 29, further messages are disabled, and the microcomputer returns from the Data Switch routine. If the manual display of data is not locked, on the other hand, the microcomputer next tests whether a key is needed to access data. If so, the information read from the key is checked to see if the key being used is one which is coded to authorize the user to obtain the data. If the key is not valid for this purpose, routine Clearmode-3 is called, the message "NEED BLUE KEY" is displayed, further messages are disabled, and a return from the Data Switch routine is made.

If no key is needed to access data or if the key in slot 35 is coded to allow access to data, the system is put in the manual data mode, and the number of the key used (if one was required) is stored in memory chip 93. This information is not kept perpetually but rather is resettable. After storing the key number, the microcomputer goes to the Data Start List routine (FIG. 28) described above.

Referring back to the top of FIG. 28B, if the system is not in the data mode when the microcomputer begins the Data-1 routine, it (see FIG. 28C) next tests whether the system is in the Program Data Display mode. If it is, the user is trying to lock or unlock the manual access of data, so the microcomputer flips the state of the bit representing the status of manual data access, displays "DATA DSP ON" or "DATA DSP OFF" as appropriate, and returns from the Data Switch routine. If the system is not in the Program Data Display mode, on the other hand, a check is made to see whether the system mode is Program Transmit. If it is not, the routine ACCESS? is called, the message "USE DATA PROBE OR PRESS DATA" is displayed on display 29, the coin handler is cremed, and any probe present is interrogated.

On the other hand, if the system is in the Program Transmit mode, the next item on the list of data to be transmitted is pointed to. If this causes the end of the list to be passed, the microcomputer goes to routine Start-Opts, described above in connection with FIG. 24.

Otherwise an identifier for the next item on the list is displayed and a lock bit for that particular item is checked in a portion of the routine labelled XMIT-YES NO. If the lock bit is set the word "YES" is added to the message while if it is not set the word "NO" is added. After appending the proper word to the message, the microcomputer returns from the Data Switch routine.

Figure 29:
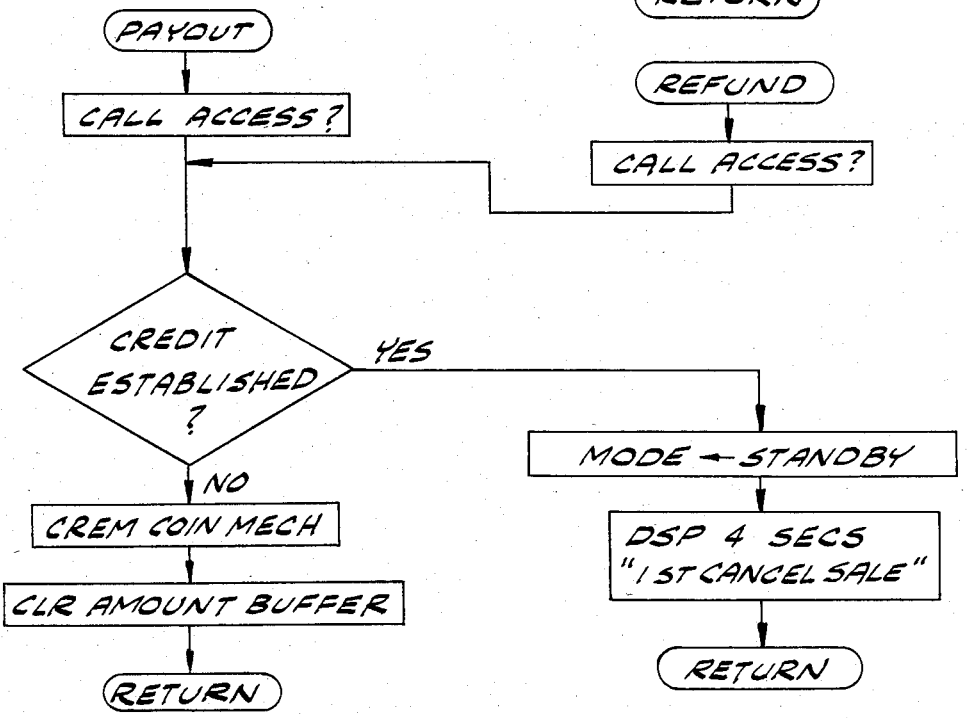
FIG. 29 is the flowchart for a routine of the microcomputer used in this invention in which it responds to the actuation of a payout switch.

The routine for the Refund and Payout Change switches is shown in FIG. 29. In this routine the routine ACCESS? is called, followed by a determination of whether credit has been established. If credit has been established the system mode is changed to standy, the message "FIRST CANCEL SALE" is displayed for four seconds, and a return from the routine is made. If credit has not been established, the coin handler or mechanism is instructed not to accept coins until further notice, the amount buffer is cleared, and the return occurs.

Figure 30:
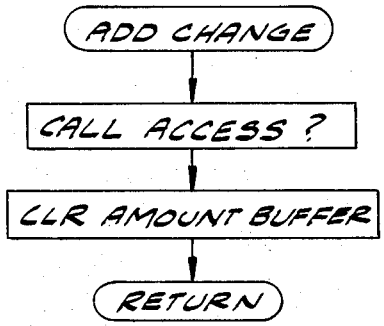
FIG. 30 is the flowchart for a routine of the microcomputer used in this invention in which it responds to the actuation of an add-change switch.

The routine for the Add Change switch is shown in FIG. 30. In it, routine ACCESS? is called, the amount buffer is cleared, and the microcomputer returns from the routine.

Figure 31:
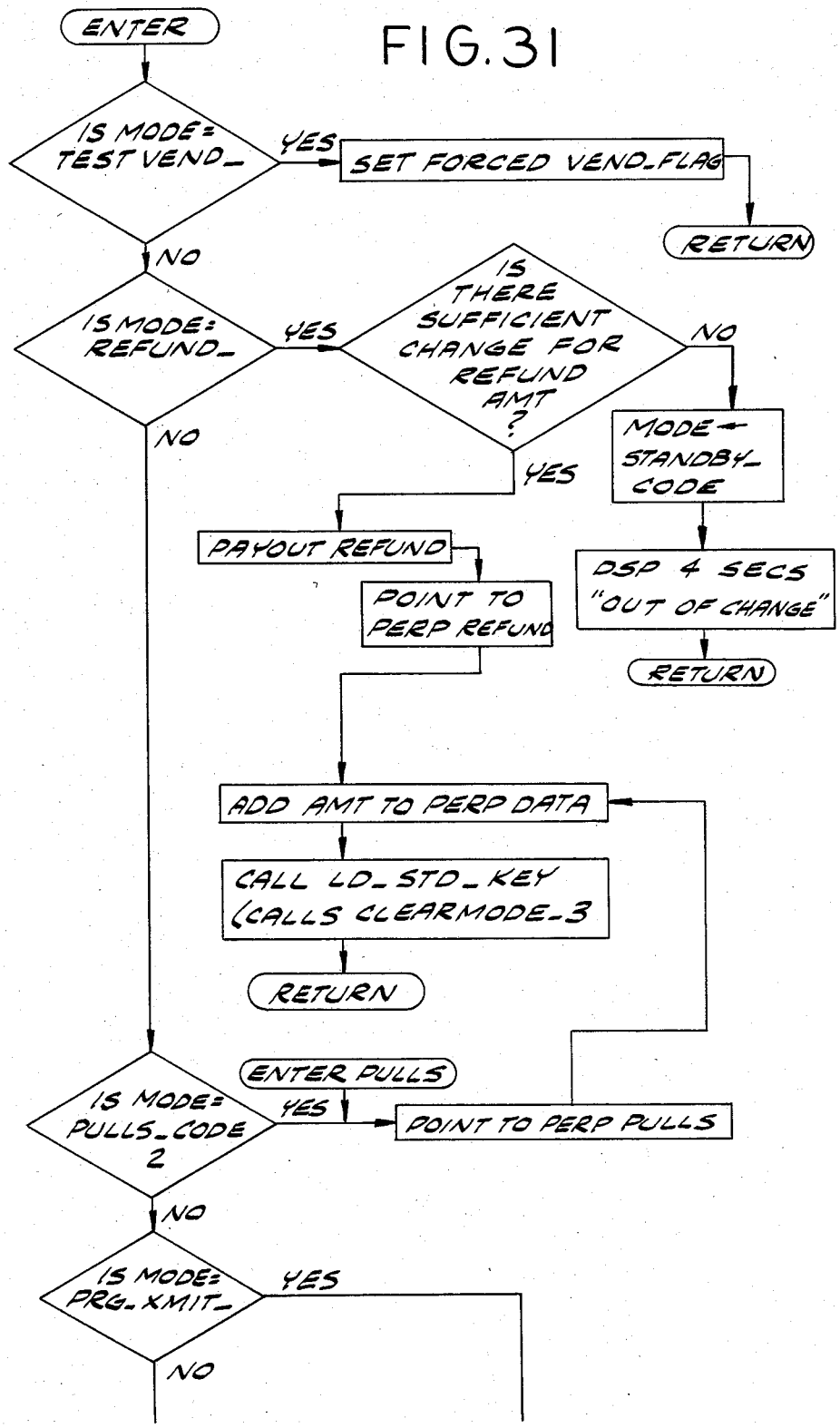
FIGS. 31–31B are the flowchart for a routine of the microcomputer used in this invention in which it responds to the actuation of an enter switch.
Figure 31A:
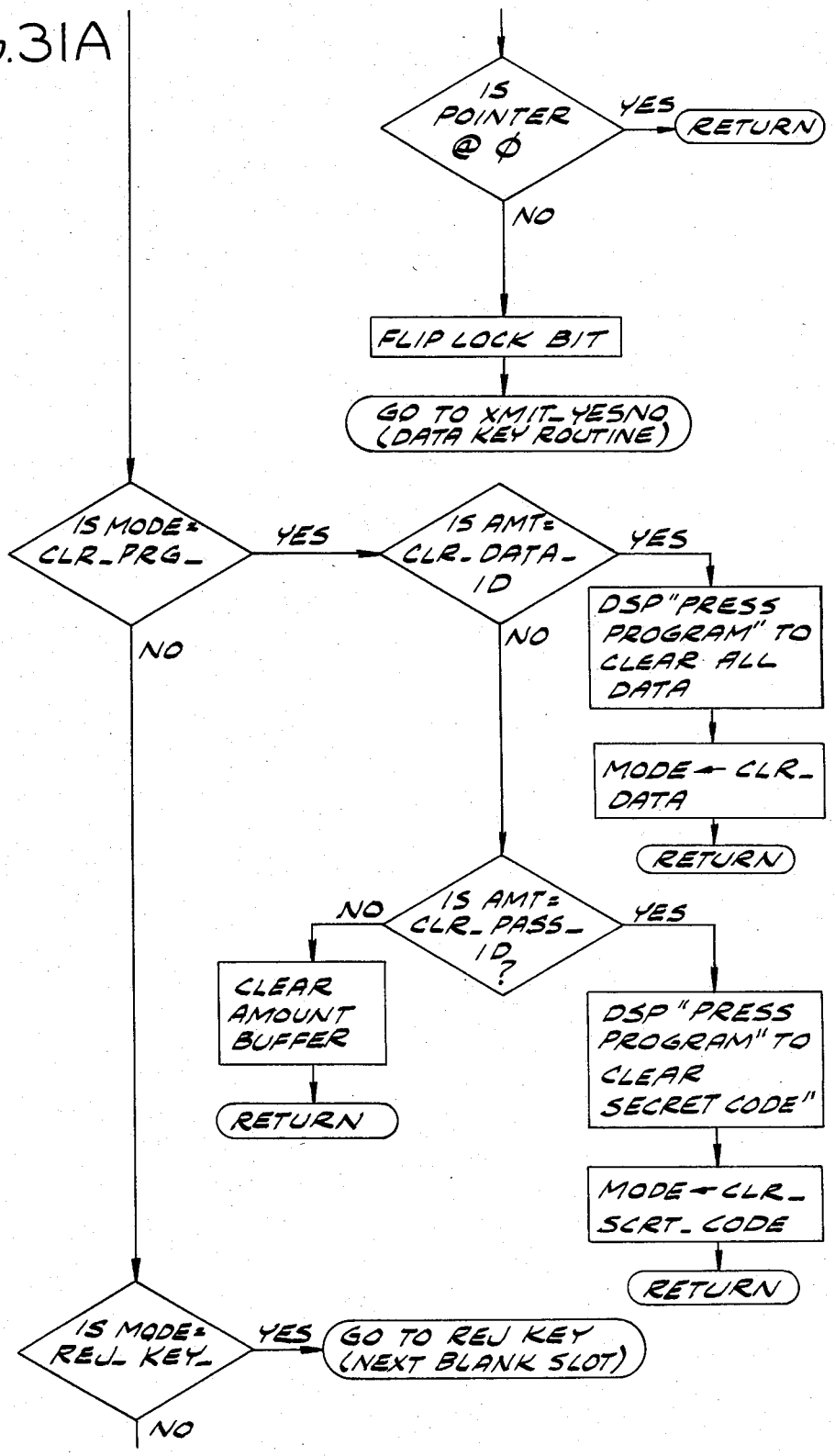
Figure 31B:
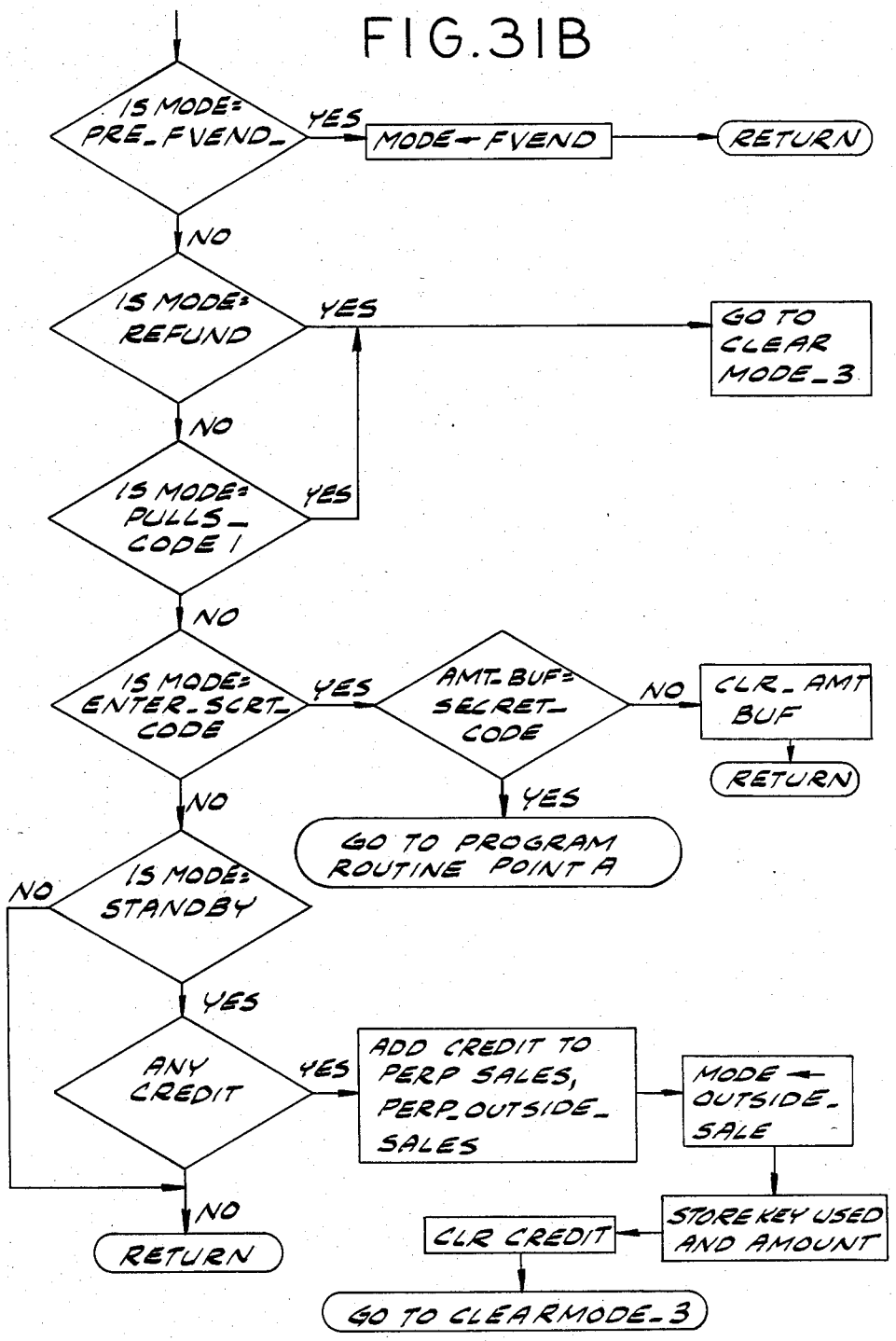
Figure 33:
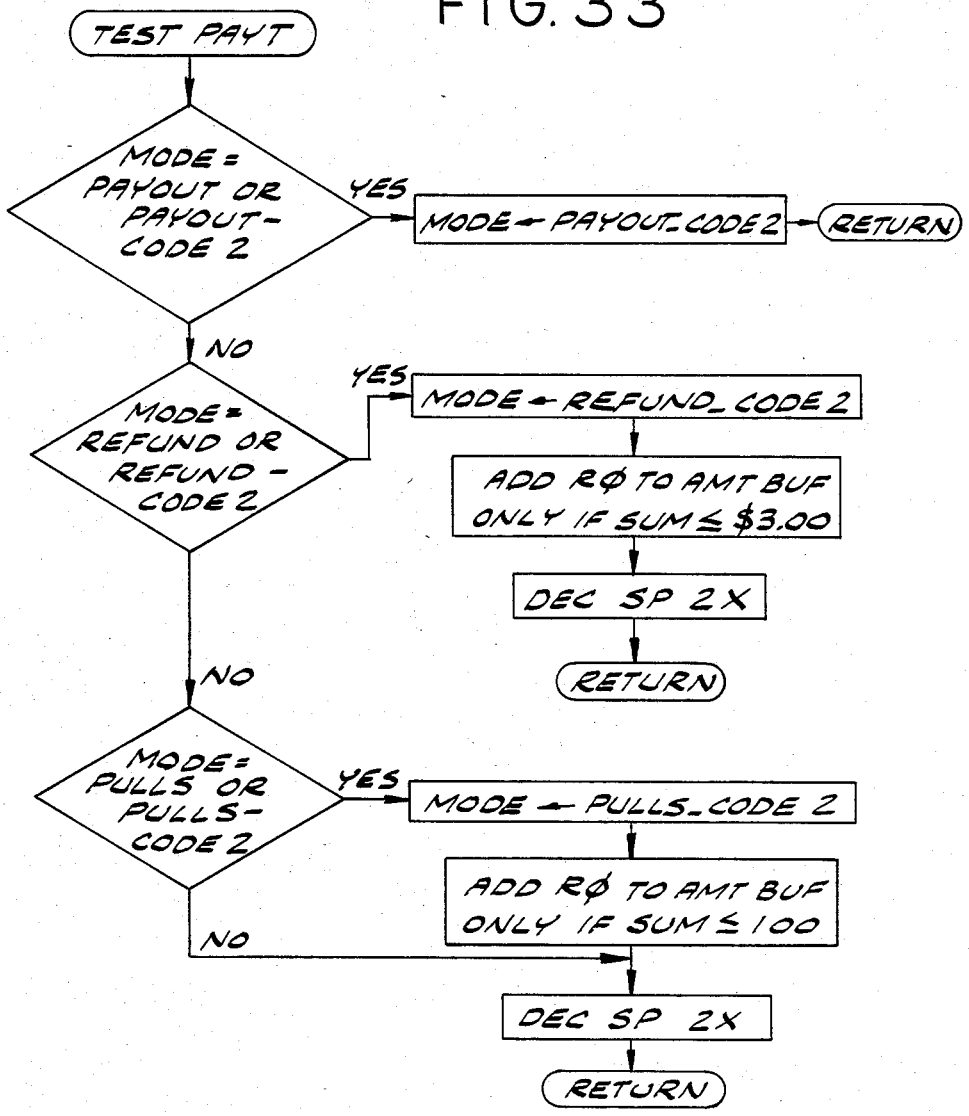
FIG. 33 is the flowchart for a routine of the microcomputer used in this invention in which it tests the mode of the system before allowing or disallowing certain actions in response to the actuation of the nickel, dime, quarter and dollar switches.

The Enter switch routine is shown in FIGS. 31–31B. If the system is in the Test Vend mode when it enters this routine, the microcomputer sets a flag labelled Forced-Tvend-Flag and returns. If it is in the Refund mode, the microcomputer checks to see if there is sufficient change in the change tubes to refund the amount then being displayed in display 29. If there is not sufficient change, the system mode is changed to standby, the message "OUT OF CHANGE" is displayed for four seconds, and the microcomputer returns from the Enter routine. On the other hand, if there is sufficient change to refund the displayed amount, the refund is paid out by sending the appropriate commands to the coin handler, and a pointer points to the perpetual total of refunds stored in RAM chip 93. Then the amount of the refund is added to the perpetual total of refunds in memory, routine Clearmode-3 is called, and the microcomputer returns from the Enter routine.

If the system is in the second Pulls mode when the Enter routine is entered, the microcomputer follows a portion of the routine labelled Enter Pulls. In Enter Pulls it points to the perpetual total of pulls in chip 93, adds the amount of the pull just entered to the perpetual total of pulls, calls Clearmode-3 and returns. On the other hand if the system is in the Program Transmit mode when it enters the Enter routine, microcomputer 43 first checks to see whether the pointer is pointing at zero (FIG. 31A) i.e., at the heading of the list of data to be transmitted. If it is, it immediately returns from the Enter routine. Otherwise the lock bit for the item being pointed to is flipped or complemented and the microcomputer goes to routine XMIT-YES/NO described above in connection with FIG. 28C.

If the system is in the Clear Program mode when it begins the Enter routine, it first tests whether the code or identification number required to clear data is present in the amount buffer. If it is, the message "PRESS 'PROGRAM' TO CLEAR ALL DATA" is displayed on display 29, the system mode is changed to the Clear Data mode, and the microcomputer returns from the Enter routine. On the other hand, if the clear data code number is not present in the amount buffer, the microcomputer checks to see whether the code number required to clear the secret or pass code is present in the amount buffer. If it is, the message "PRESS 'PROGRAM' TO CLEAR SECRET CODE" is displayed on display 29, the system mode is changed to the Clear Scrt Code mode, and a return is made from the Enter routine. On the other hand, if the clear pass code is also not present in the amount buffer, that buffer is cleared and the microcomputer returns from the Enter routine without taking further action.

If the system is in the Reject Key mode when the microcomputer begins the Enter routine, it goes to the Rej-Key routine, described above in connection with FIG. 17.

Referring now to FIG. 31B, if the system is in the Pre-Freevend mode when the microcomputer enters the Enter routine, the system mode is changed to Free Vend and the Enter routine is returned from. In contrast, if the system is in the Refund or Pulls mode when the Enter routine is entered, the microcomputer goes to routine Clearmode-3.

If the system is in the Enter Secret Code mode when the Enter routine is entered, the microcomputer tests whether the secret code equals the number entered via keyboard console 25, which number is stored in the amount buffer. If it is, the microcomputer goes to point A on the Program routine (FIG. 24) and continues. Otherwise the amount buffer is cleared and the microcomputer returns from the Enter routine.

The last mode the microcomputer checks for in the Enter routine is the Standby mode. If the system is not in the standby mode either, the microcomputer returns from the Enter routine. On the other hand, if the system is in the standby mode, the microcomputer checks whether there is any credit accumulated. If there is not, a return from the Enter routine occurs. If there is accumulated credit, however, this credit is added to two perpetual totals in the memory, namely the perpetual sales total and the perpetual outside sales total. After adding the credit to these two perpetual totals, the microcomputer changes the system mode to outside sale, stores the number of the key used by the person who made the outside sale, clears the present credit, and goes to routine Clearmode-3.

The routine for the 5¢ switch is found in FIG. 32 and is labelled NICKEL. In Nickel a return buffer R0 is loaded with 1 to represent the fact that 5¢ has been requested for payout. The microcomputer then calls a routine labelled Test-Payt, described below in connection with FIG. 32. Upon returning from routine Test-Payt, microcomputer 43 orders the coin handler routine to pay out a nickel and then, in a portion of the routine labelled COIN PAID?, examines the messages from the coin handler routine to see if a coin was actually paid out. If one was, its value (in this case 5¢) is added to the amount buffer and the Nickel routine is returned from. If the coin was not paid out, the microcomputer causes the message "OUT OF CHANGE" to be displayed. It then tests whether the switch, in this case the 5¢ switch, is still being held down. As long as it is, the microcomputer continues to display "OUT OF CHANGE". Once the switch is released, the microcomputer returns from the Nickel routine.

In routine Test Payt, the microcomputer firsts tests to determine is the system is in the first payout mode (the one in which 'TO PAYOUT CHANGE . . . PRESS YELLOW BUTTONS' is displayed) or in the second payout mode. If it is, the mode is changed to or retained in the second payout mode ('PAYOUT' is displayed) and the microcomputer returns from the Test Payt routine. If the system is not in one of the payout modes when routine Test Payt is entered, the microcomputer checks to see if it is in the first refund mode ('REFUND . . . ENTER AMOUNT WITH YELLOW BUTTONS' is displayed in this mode) or in the second refund mode. If it is, the microcomputer places or retains the system in the second refund mode ('REFUND' is displayed), adds the contents of R0 to the amount buffer if the contents of R0 is less than or equal to $3.00, decrements the stack pointer twice to skip one return, and returns from the Test Payt routine. If the mode of the system is the first pulls mode ('PULLS . . . ENTER AMOUNT BY PRESSING YELLOW BUTTONS' is displayed when the system is in this mode) or the second pulls mode when routine Test Payt is entered, the microcomputer changes the mode of the system to or retains the system in the second pulls mode ('PULLS' is displayed), adds the contents of R0 to the amount buffer only if the sum is less than or equal to $100, decrements the stack pointer twice, and returns. When the microcomputer enters the Test Payt routine and is not in one of the payout modes, one of the refund modes, or one of the pulls modes, the microcomputer decrements the stack pointer twice and returns.

Figure 34:
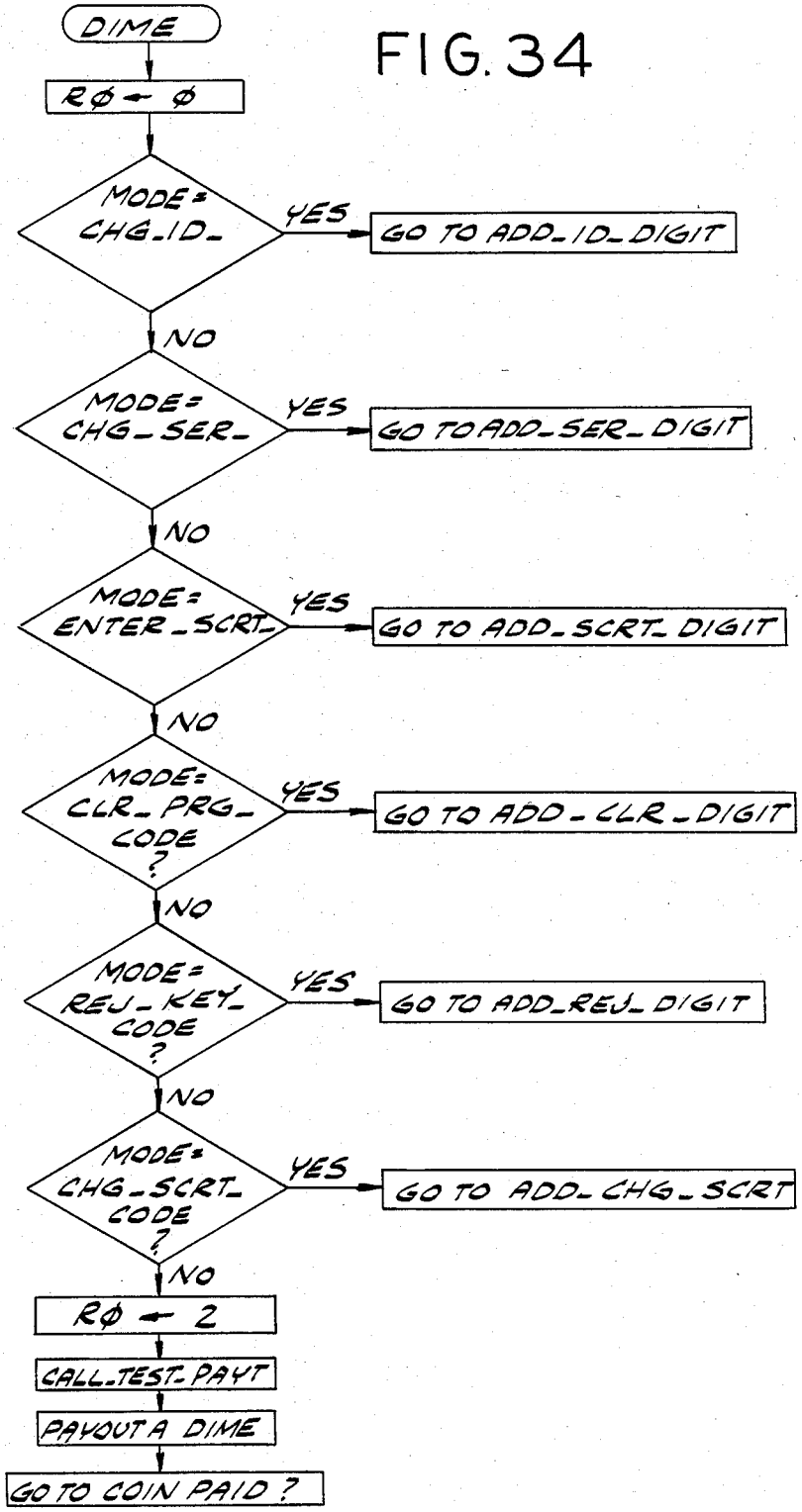
FIG. 34 is the flowchart for a routine of the microcomputer used in this invention in which it responds to the actuation of the dime switch.

The routine for the 10¢ switch is shown in FIG. 34 and is labelled Dime. In routine Dime, the buffer R0 is first loaded with zero, since this switch can represent a numeric zero as well as the order to pay out a dime from the change tubes. After loading R0, the microcomputer tests the mode of the system. If the system is in the Change Machine Identification mode, the microcomputer goes to routine Add-ID-Digit which is discussed above in connection with FIG. 21. If the system is in the Change Series mode, it goes to routine Add-Ser-Digit (see FIG. 21). If in the Enter Secret Code mode, the microcomputer goes to the Add-Scrt-Digit routine (see FIG. 21A). If the system is in the Clear Program mode, the microcomputer goes to the Add-Clr-Digit routine (see FIG. 21A). If the system is in the Reject Key mode, it goes to the Add-Rej-Digit routine (see FIG. 21A). And if the system is in the Change Secret Code mode, the microcomputer goes to the Add-Chg-Scrt routine discussed in connection with FIG. 21. If the system is in none of these modes, the 10¢ switch is being used to initiate payout of a dime instead of as a numeric zero switch, so buffer R0 has two loaded into it to represent the fact that ten cents (two times the value of a nickel) is being requested. The microcomputer then calls the Test Payt routine and upon a successful return from that routine orders the coin handler to pay out a dime. Next the microcomputer follows the Coin Paid? routine described above in connection with FIG. 32.

The routine for the 25¢ switch is shown in FIG. 35 and is labelled Quarter. In the Quarter routine, buffer R0 is loaded with five, routine Test Payt is called, and upon a successful return from Test Payt the coin handler is ordered to payout a quarter. Then microcomputer 43 goes to the Coin Paid? routine. Similarly in the routine for the $1 switch, shown in FIG. 36 and labelled Dollar, the microcomputer loads twenty into buffer R0 and calls routine Test Payt. Upon a successful return from the Test Payt routine while in the Dollar routine, however, the microprocessor returns immediately from the Dollar routine.

The operation of the present invention is as follows: The present invention allows vending machine operators to program their machines to control access to different function, to regulate the amount of data transmitted to a data probe, to restrict the types of data that can be visually displayed at the machine, to store the machine identification number, and to store the series number of the data keys to be used with that machine. The cash accountability system of the present invention stores a great amount of sales and cash data, not all of which might be of interest to every vending machine operator. Moreover, data probes have limited storage capabilities and as a result only a few machines could be interrogated with any one probe if all the data available with this system were automatically supplied to the probe. Thus, the system has been designed to normally release standard sales and cash data to the data probe, but additional data such as price settings, sales by selection, sales by price setting and data as to the use of data keys are released to the data probe only if the system is so programmed by the operator.

To program the system, the operator inserts his programming key in slot 35. As the key is inserted, it is read by reader 63, which initiates the external interrupt routine shown in FIG. 13, and the information about the key is stored. Then back in the main program, the microcomputer processes this key-in condition as described above in connection with FIG. 7. If the key is a valid programming key, the Prog. Init. routine (FIG. 16) is called and, since at this time no secret code is necessary to program the system, the message 'PROGRAM' is displayed in display 29 and the system is set in the program mode. The microcomputer then returns to the main program. Next the operator presses the Program switch on keyboard console 25 which results in the microcomputer calling the routine corresponding to that switch (see FIG. 24). In this routine, since the system has been set in the program mode, the mode of the system is changed to Program Access, and the message 'ACCESS CONTROL' is displayed. In this mode the system can be programmed to require a data key to operate the function switches, that is to make operative the switches of the keyboard console. To make a switch inoperative without a data key, i.e. to lock out the switch, one presses the function switch which he desires to lock out. The microcomputer responds to this switch closure in the various switch routines discussed above. For example, assume the operator wishes to lock out the Test Vend switch. In response to closure of the Test Vend switch, the microcomputer performs the routine of FIG. 25, the first step of which is the calling ? 4 25 of the Access? routine. In Access? (FIG. 21–21B) the microcomputer takes the actions required because the system is the the Program Access mode, which includes obtaining the lock bit for the pressed switch and displaying 'KEY REQ' if the lock bit is set and 'NO KEY' if the bit is not set. Subsequent closure of the Test Vend switch will result in the lock bit being complemented once for each switch closure, so that the Test Vend switch (or any of the other function switches) can be locked or unlocked as desired by the operator by pressing the switch he desires to lock once or twice until the desired 'KEY REQ' or 'NO KEY' message appears in display 29.

After requiring that any desired function switches only be operative with a data key, the operator by pressing the Program switch again can control whether sales and cash data are to be displayed on display 29 to the service people. Because at this time the system is the the Program Access mode, the microcomputer (see FIG. 24) changes the system mode to Program Data Display, retrieves the lock bit for the data display and if the bit is set displays the message 'DATA DISPLAY OFF'. Of course if the bit is not set, the display reads 'DATA DISPLAY ON'. If the operator wishes to change the locked or unlocked status of the data display, he presses the Data switch. In response the microcomputer enters the Data Switch routine and, since the system is in the Program Data Display mode (see FIG. 28C), complements the data display access or lock bit. The display is changed as a result from 'DATA DISPLAY ON' to 'DATA DISPLAY OFF' or vice versa.

Pressing the Program switch a third time, i.e. while the system is in the Program Data Display mode (see FIG. 24) allows the operator to selectively release data other than standard sales and cash data to a data probe. The closure of the Program switch causes the microcomputer to place the system in the Program Transmit mode and to cause 'DATA OUT CONTROL' to be displayed in display 29. The operator may now choose from a list of additional data items those data items he wishes this system to transmit to the data probe by pressing the Data switch. The first time the Data switch is closed while the system is in the Program Transmit mode (see FIG. 28C), the microcomputer fetches the first data item from the list and displays its identifier, namely "VEND PRICES". If the lock bit associated with Vend Preices, i.e., the prices at which the items in the vendor are currently set to be vended is set, "YES" is appended to the message and if it is not set "NO" is appended. Thus, the two possible messages in display 29 upon the first closure of the Data switch are "VEND PRICES YES" and "VEND PRICES NO". To change the message from "NO" to "YES" to permit vend prices to be retrieved by a data probe one presses the Enter switch. In the Enter routine (see FIGS. 31 and 31A) since the system is in the Program Transmit mode, the lock bit for Vend Prices is complemented or flipped and the message changed from "VEND PRICES NO" to "VEND PRICES YES". Clearly exactly the same action, pressing the Enter button, will result in a "VEND PRICES YES" message being changed to "VEND PRICES NO". Once the person has programmed the Vend Price data for retrieval or not by a data probe, he may similarly program the retrieval or not of sales/price data by pressing the Data switch again. The sales/price data is a list of the perpetual total sales of the vendor for each price setting. Once the Data switch is closed, the message "SALES/PRICE YES" or "SALES/PRICE NO" is displayed in display 29. The message, and hence the retrieval status of this data is changed merely by pressing the Enter button as described above in connection with vend prices.

While the system is in the Program Transmit mode, the operator by pressing the Data switch a third time causes the message "SALES/SELECT YES" or "SALES/SELECT NO" to be displayed. This represents the retrieval status of the perpetual total sales data for each machine selection. The Enter button is again used to change the retrieval status of the message from "YES" to "NO" and vice versa. Closing the Data switch a fourth time enables the operator to program the retrieval status of the data representing the numbers of data key used to perform different machine functions and the corresponding amounts of money involved since the last reading of such data. For example, a typical set of such data might be Key No. 128
Refunds $1.35.

The operator may also change the machine identification number at this point. While in the Program Transmit mode, closure of the Program switch again causes the system mode to be changed to Change ID? (see FIG. 24A). The message "MACH ID" is displayed in display 29 along with the current identification number for that machine. To change this number the operator presses the Clear Amount button. This action (see FIG. 19) causes the system to be put in the Change ID mode, and the message "ENTER NEW ID" to be displayed. To enter the new machine identification number the numbered function buttons are used. As an example, suppose the operator wants to change the machine identification number to "1230". He first presses the Set Prices switch, which bears the numeral "1". The microcomputer enters the Priceset routine (FIG. 20) in response and calls the ACCESS? routine. In ACCESS? since the system is in the Change ID mode, the routine ADD-ID-Digit (FIG. 21) is followed, which stores "1" as the new identification number and displays it in display 29 before skipping the return to the Priceset routine. Likewise when the Pulls switch, which bears the numeral "2" is pressed the microcomputer again enters the ACCESS? routine (this time via the Pulls routine (FIG. 22). The numeral "2" is added to the identification number as the next digit and "12" is displayed in display 29. Likewise, pressing the Open Cashbox switch causes "123" to be displayed in display 29 because the Cashbox routine (FIG. 23) also calls the ACCESS? routine. To display the "0", the 10¢ switch is closed. In response (see FIG. 34) the microcomputer, since the system is in the Change ID mode, goes to that portion of the ACCESS? routine labelled Add-ID-Digit (FIG. 21) which causes the number "1230" to be displayed in display 29 and stored as the new machine identification number. If the person makes a mistake in entering the new number, he presses the Clear Amount button again. Since the system is in the Change ID mode, the microcomputer (see FIG. 19) clears the amount buffer, which clears the displays, and stores zero as the new machine identification number. A new number can now be entered as described above.

The operator can also change the series number of data keys which are to be accepted by the system. To do this he presses the Program switch again, i.e., while the system is in the Change ID? or Change ID mode. This action causes the microcomputer (see FIG. 24A) to change the system mode to the Change Series? mode and to display the message "KEY SERIES" and the current key series number in display 29. To change the series number, the user presses the Clear Amount button. This causes (see FIG. 19) the system mode to be changed from Change Series? to Change Series and the message "ENTER NEW SERIES" to be displayed. A new key series number is entered using the numbered function switches just as described above in connection with the machine identification number.

It is also possible with the present system to program in what has been called up to now a secret code. This code, once entered, prevents one from subsequently programming the system, even with a programming key, unless he enters the secret code. To program in a secret code, the user presses the Program switch while the system is in the Change Series? or Change Series mode. In response (see FIG. 24A) the microcomputer changes the system mode to Change Secret? Code and displays the message "SECRET CODE". By subsequently pressing the Clear Amount switch (see FIG. 19), the user causes the system to be placed in the Change Secret Code mode. Digits of the new secret code are entered via the numbered function switches in routine Add-Chg-Scrt of the ACCESS? routine in the same manner as new machine identification numbers and new key series numbers are entered. Once the system is programmed to require a secret code number, the next time a programming key is used, the microcomputer in the program of FIG. 16 will determine that a secret code is needed to further program the system. In response to this determination, it will cause "SECRET CODE?" to be displayed and will put the system in the Enter Secret Code mode. Subsequent actuations of the Program switch without first entering the secret code will be ineffectual because the microcomputer immediately returns from the Program routine (FIG. 24) while the system is in the Enter Secret Code mode. To enter the secret code at this stage one uses the numbered function switches as described above. The digits are shifted into the amount buffer in routine Add-Scrt-Digit of the ACCESS? routine. When the user has entered the secret code, which is not displayed, he presses the Enter button. This causes (see FIG. 31B) the actual secret code stored in memory to be compared with the contents of the amount buffer. If they are equal, the user has properly entered the secret code and is authorized to program the system as described above. The message (see FIG. 24) "ACCESS CONTROL" is displayed and the system enters the Program Access mode. Otherwise (see FIG. 31B) the amount buffer is cleared and the user must try to enter the proper secret code again.

Figure 7B:
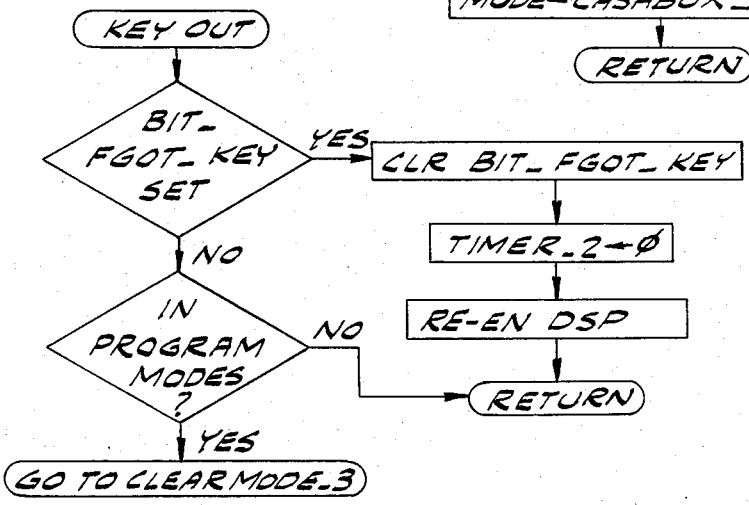

If the Program switch is pressed again, while the system is in the Change Secret? Code or Change Secret Code modes, the microcomputer begins the series of program modes again (see FIGS. 24A and 24) by putting the system back in the Program Access mode. To get out of this loop of program modes, one removes the programming key from slot 35. Then the next time through the Process Key In and Key Out routine, the microcomputer calls (see FIG. 7A) the Key Out routine (FIG. 7B). Since the system is in a program mode at the time, the microcomputer calls routine Clearmode-3 (FIG. 18) which returns the system to the Standby mode.

In addition to being ineffectual while the system is in the Enter Secret Code mode, the Program switch is also ineffectual when a data key (instead of a programming key, lockout key, or clearing key) is inserted in slot 35. Only the programming key, the lockout key or the clearing key cause the system to be put in a mode which the Program routine does not immediately reject. All other system modes are considered to be less than the Program mode and cause the immediate return from the Program routine.

When the lockout or Reject Key key is placed in slot 35 it causes (see FIG. 17) the system to be put in the Reject Key mode or the Show Reject mode and the message "ENTER NEW REJECT" or "REJECT LIST FULL" as appropriate to be displayed on display 29. If the Program switch is subsequently pressed while the system is in one of these two modes, the message "REJECT KEY" along with the number of one of the list of locked out keys is displayed, assuming there are keys on that list. The numbers of the other keys on the reject key list may be displayed by additional closures of the Program switch while in the Show Reject mode. The identification numbers of new keys to be rejected or locked out are entered using the numbered switches of keyboard console 25 (see FIG. 21A and the description of the ACCESS? routine). After the desired number is displayed, the user presses the Enter switch. In response (see FIGS. 31A and 17) the microcomputer calls the Rej Key routine and, assuming the reject key list is not full, clears the amount buffer so that another key number can be entered if desired. The user can exit this mode of operation by removing the lockout key from slot 35.

The clearing key has two purposes. It can be used in conjunction with a fixed four digit number, e.g., "4321", which is called a clear-data-id, to clear all data from the memory chip 93 so that this data will not be available to subsequent buyers of the vending machine. It can also be used in conjunction with a second four digit number, e.g., "5790", which is called a clear-pass-id, to clear the secret programming code mentioned above. To do either of these two actions, one inserts a clearing key in slot 35. In response the microcomputer (in routine PROG. INIT-FIG. 16) puts the system in the Program Clear mode and causes "ENTER CODE WORD" to be displayed. Digits of the desired four digit number are then entered via the numbered function switches as described above and as each is entered the microcomputer (in routine Add-Clr-Digit of routine ACCESS? (FIG. 21A) stores it in the amount buffer. Once the user has entered the number, he presses the Enter button. The microcomputer in the Enter routine (see FIG. 31A), since the system is in the Program Clear mode, checks to see if the contents of the amount buffer equal the clear-data-id or the clear-pass-id. If it equals the first, the correct clear-data-id has been entered, so the system mode is changed to the Clear Data mode and the message "PRESS 'PROGRAM' TO CLEAR ALL DATA" is displayed. Subsequent operation of the Program switch (see FIG. 24B) causes all the data in RAM chip 93 to be cleared and the message "DATA CLEARED" to be displayed.

If the contents of the amount buffer equals the clear-pass-id on the other hand, the system mode is changed to the Clear Pass mode and the message "PRESS 'PROGRAM' TO CLEAR SECRET CODE" is displayed. Subsequent actuation of the Program switch causes (see FIG. 24B) the secret code to be cleared and the message "SECRET CODE=000" to be displayed, since the system is then in the Clear Pass mode. In those cases where the user has entered a number which is neither the clear-data-id or the clear-pass-id, the microcomputer clears the amount buffer (thus clearing the entered number) and returns. One leaves this mode of operation by removing the clearing key from slot 35.

The system, as mentioned above, can be programmed to require a data key for effective operation of some or all of the function switches on keyboard console 25. When a valid data key is inserted in slot 35, the microcomputer (see FIGS. 7 and 15) stores the identification number of the key and sets the cashbox access flag if the proper cashbox access code appears on the key. If the user of this key is not allowed access to the cashbox, the access flag is not set. In either case, if the data key is valid the message "KEY ACCEPTED" is displayed in display 29 and the beeper sounds for 50 ms. The user may now effectively operate even those function switches which require the presence of a data key. For example, assume the Test Vend switch requires the presence of a data key in slot 35 before it is operative. Actuation of this switch while a valid data key is present in slot 35 causes (see FIGS. 25, 21 and 21C) the system to be placed in the Test Vend mode. Conversely, actuation of this switch without a valid data key being present in slot 35 causes (see FIG. 21C) the message "NEED KEY" to be displayed.

Note that even with a valid data key in slot 35, there are three switches on keyboard console 25 that are either not operable or might not be operable, depending upon the prior programming of the system and the particular data key being used. These switches are the Open Cash Box switch, the Program switch, and the Data switch. The Open Cash Box switch is not operative unless the key inserted in slot 35 is coded to permit access to the cashbox. If the key is so coded, pressing of the Open Cash Box switch causes (see FIG. 21C) the system to be set to the cashbox mode and (see FIG. 23) the cashbox to be unlatched. Otherwise (see FIG. 21C) the message "Need Blue Key" is displayed and the cashbox remains latched.

Pressing the Program switch while a data key is in the slot is ineffective because the microcomputer merely returns immediately from the Program routine since the system is in a mode less than a Program mode. And pressing the Data switch when manual display of all data is locked results in (see FIG. 28B) the message "DATA LOCKED" being displayed in display 29.

The route person checks and sets prices of the items in the vendor by using the Set Prices switch. Closing this switch causes (see FIGS. 20 and 21C) the system to be set in the Price Set mode if no data key is required to operate this switch or if a valid data key is present in slot 35. Timer-2 is set to 25 seconds and the door display is enabled in response to the closure of an operative Set Prices switch. The message displayed while the system is in the Price Set mode is "SET PRICE". In the same manner as described in coassigned U.S. Pat. No. 4,231,105, the item prices are checked by pushing the selection switches corresponding to the items whose price one wants to check. That is, the Set Prices switch and the selection switches constitutes means operable via the logic means to check the prices previously set for the products to be vended with the prices appearing on display 29. An item price is changed by pressing an up-button or a down-button to increment the price up or down, all as described in U.S. Pat. No. 4,231,105. In addition to storing the new prices set by means of the Set Prices switch, the microcomputer also stores in RAM chip 93 the identification number of the data key used, if the system is programmed to require a data key to set prices. This information is of course stored in a predetermined location and is retrievable. The system is removed from the Price Set mode by the route person pressing the Clear Mode switch or some function switch other than the Set Prices switch, or upon the timing out of TIMER-2, the twenty-five second timer. This timer is reset to twenty-five seconds upon the pressing of any selection switch or the up/down buttons.

From the viewpoint of sales and cash accountability, the identity of the person who changed item prices is usually less critical than another piece of data the present system records and makes available, namely the amount of machine money paid out in refunds to customers. It is necessary to know this figure in order to accurately determine the amount of money which should be turned in from this machine. With the present system, refunds are paid out of the change tubes and the amounts are stored in recallable memory. More specifically, to make a refund the service person presses the Refund switch, then presses the 5¢, 10¢, 25¢, or $1 switches as necessary to obtain the refund amount from the change tubes as described above, and then presses the Enter switch. Pressing the Refund button causes (see FIGS. 29 and 21C) the system to be put in the first Refund mode and the message ". . . REFUND . . . ENTER AMOUNT WITH YELLOW BUTTONS" to be displayed. Subsequently pressing the 5¢, 10¢, 25¢ and $1 switches, the yellow switches, causes (see FIG. 33) the amount corresponding to the activated switch to be added to the amount buffer. Note that this occurs only if the sum is less than or equal to $3.00. Refunds in excess of $3.00 are not allowed by the system. Note also that pressing the yellow switches does not cause the corresponding amount to be paid out, since in the Test Payt routine one return is skipped. The actuation of a yellow switch merely updates the contents of the amount buffer, which contents are then displayed in display 29. To actually pay out the refund, the Enter button must be pressed. This causes (see FIG. 31) the refund to be paid out (or if there is insufficient change, the message "OUT OF CHANGE" to be displayed), the amount of the refund to be added to the perpetual total of refunds stored in memory, and the system to be taken out of the Refund mode. Thus, the Refund, 5¢, 10¢, 25¢, $1 and Enter switches constitute means operable via the logic means to effect delivery of coin from the coin holding means for making refunds. Pressing the Clear Mode button, or any other special function button, before the Enter button is pressed also removes the system from the Refund mode. If a data key was necessary to operate the Refund switch, the identification number of the data key used and the amount of the refund are also stored in memory.

Note that the manner in which the present system handles refunds has several advantages over prior systems. For one, the present system eliminates the need for the employee to make out refund slips. The record of refunds is made automatically. Moreover, there is no need with the present system for the service person to have access to the cashbox. Access to the cashbox can be limited to the employee who collects the money. If the data key is used to operate the Refund switch, this information is also recorded, which enables the employer to know how many refunds are made by each employee and to detect and identify excessive use of refunds.

The present system also has numerous advantages over other systems in the handling of test vends. By pressing the Test Vend switch, which puts the system in the Test Vend mode (see FIGS. 25 and 22C), inserting money and making a selection, the service person may test the money handler of the vendor without causing a product to be dispensed. The money inserted is the service person's credit amount and this amount (see FIG. 6B) is compared with the price of the item selected. For a test of the money handler this amount will exceed the price. If there is enough change in the change tubes to return change and the price amount to the service person, the microcomputer first pays the change amount to the service person (see FIG. 6C), delays four seconds, and then pays the price amount to the service person (see FIG. 6D). Since no product is dispensed no record of this type of test vend is necessary for product accountability. Moreover, since the same amount inserted into the machine during the test vend is returned to the employee at its end, there is no need to keep a record of this type of test vend for cash accountability purposes either. The employee, since he automatically gets back the amount of money he inserted, can supply his own change to test the money handler and need not be given access to the cash box or the change tubes.

The present system also provides a test vend of the dispensing function of the vendor without the use of money. To do this the service person presses the Test Vend button (putting the machine in the test vend mode), presses the Enter button (setting the forced-test-vend flag—see FIG. 31), and makes a selection. Since the forced test vend flag is set and the credit amount is zero (see FIG. 6B), the vend is processed without regard to the status of the change tubes (see FIG. 6C), and the test vend total in RAM chip 93 is updated (see FIG. 6D) to record the vend for product accountability purposes. Thus, the Test Vend and Enter switches constitute testing means operable via the logic means, without deposit of cash, to operate the delivery means (e.g., vend motors) of the vendor. Note that in this type of test vend the employee again has no need for access to the cash box or change tubes. Test vend slips are not necessary because the system automatically records the vend in recallable memory. Of course the test vend record is not needed for cash accountability purposes because no money is involved.

The present system also allows concurrent test vends of the money handler and the vending cycle. To do this the service person presses the Test Vend button (putting the system in the test vend mode), inserts money, presses the Enter button (setting the forced-test-vend flag), and makes his selection. In response the microcomputer follows the program of FIGS. 6A–6D. The selected item is dispensed and the money inserted is returned from the changer. Any change is returned first, followed four seconds later by the amount of the price of the selection. The test vend is automatically stored in the test vend total for product accountability. In this type of test vend, as in the other two types, the service person's money is returned so that he need not be given money for test vends by his employer or have access to the machine cash. If a data key is needed to operate the Test Vend button, the identification number of the key used and the vend price of the dispensed item are also stored in memory chip 93. Thus, the Test Vend switch and the Enter switch constitute means operable via the logic means for testing by a service person of the cash handling means and the delivery means of the vendor.

To exit the test vend mode, one presses the Clear Mode button, or presses any other function or mode button. The system also automatically exits the test vend mode as the test vend is completed (see FIG. 6D).

Another feature of the present system which is important to product accountability is the provision of means to handle free sales, using the "*" button, separately from the test vends. To make a free sale with the present system, that is to obtain an item for his own consumption for free, the employee presses the "*" button. This causes (see FIGS. 27 and 21C) the system to be set in the free sale mode (the message "FREE SALE . . . MAKE SELECTION" is displayed) and the door display to be enabled. The employee then presses the selection switch corresponding to the desired item. The machine dispenses the desired item in response and (see FIG. 6D) updates the total free sale figure in RAM chip 93 and stores the number of the key used to initiate the free sale if a key was required. Thus, the Free Vend and "*" switches constitute means operable via the logic means enabling free deliveries by the vendor. More particularly the "*" switch constitutes means operable via the logic means for enabling free deliveries by the vendor to service persons and the Free Vend switch constitutes means operable via the logic means for enabling free deliveries by the vendor to anyone. Exit from the free sale mode is made automatically after dispensing of the product but the free sale mode can also be exited by pressing the Clear Mode button, by pressing some other mode button, or by leaving the vending machine door closed for at least 25 seconds without making a selection.

The present system can also be used to quickly and accurately make a record of outside sales, i.e. sales to customer from the route person's trays, for cash and product accountability purposes. To record an outside sale, the route person deposits the money received from the customer in the coin slot of the coin handler, thereby accumulating credit in the machine, and then presses the Enter button. Since the system is then in the Standby mode, the microcomputer in response (see FIG. 31B) adds the credit to the perpetual sales figure and to the perpetual outside sales figure in recallable memory, stores the number of the key used, if any, and clears the credit. As a result the amount of cash in the cash box will now check out and a record of outside sales is made merely by inserting the money and pressing the Enter button.

Similarly the present system can easily be set on free vend in which no money need be inserted to obtain products. This is done by pressing the Free Vend switch and then the Enter button. Pressing the Free Vend switch causes (see FIGS. 26 and 21C) the system to be put in the Pre-Free Vend mode (the message "FOR CONTINUOUS FREE VENDING . . . PRESS ENTER BUTTON" is displayed) and subsequent closure of the Enter switch causes (see FIG. 31B) the machine to be set on free vend (the message "FREE VENDING . . . TO EXIT PRESS CLEAR MODE" is displayed at that time). Once the door is closed the message "DO NOT INSERT MONEY . . . MAKE SELECTION" is displayed. So long as the system remains in a free vend mode, one of these messages will be displayed. Thus, when the microcomputer tests whether a message is being displayed (see FIG. 6), it finds that one is and immediately (see FIG. 6C) processes the function switch without checking the credit. The total free amount is updated and any credit is then returned. To leave the Free Vend modes, one presses the Clear Mode button or any other mode button.

Pulls are recorded with the present system by pressing the Pulls button and then pressing the 5¢, 10¢, 25¢, and $1 buttons as required to enter the amount of the pull. Once the desired amount is displayed, the Enter button is pressed. Pressing the Pulls switch causes (see FIGS. 22 and 21C) the system to be placed in the Pulls mode (the message "PULLS . . . ENTER AMOUNT BY PRESSING YELLOW BUTTONS" is displayed). Subsequent closure of the 5¢, 10¢, 25¢ or $1 switches causes (see FIGS. 32–36) the corresponding amount to be added to the amount buffer and the new total displayed. Once the desired amount is displayed, the user presses the Enter button, which causes (see FIG. 31) the contents of the amount buffer to be added to the perpetual total of pulls in memory. The Pulls mode is exited by pressing the Clear Mode button or any other mode switch.

Figure 10B:
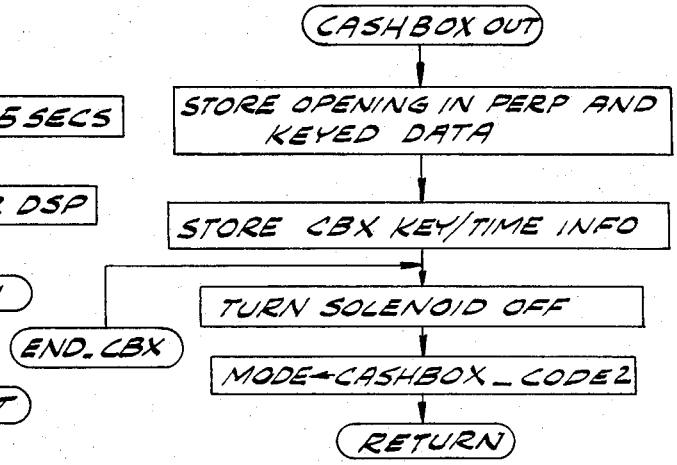
FIGS. 10–10B are flowcharts for the cashbox handling routine of the microcomputer used in this invention.
Figure 10A:
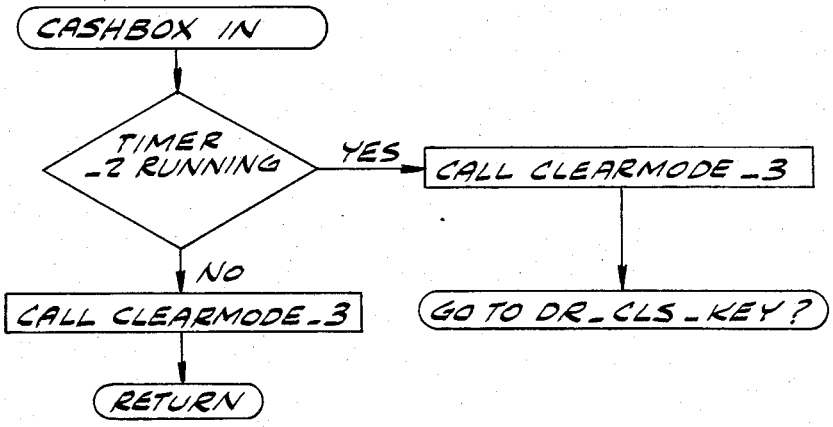

The cash accountability system of this invention also has provision for a latched cash box and is designed to limit access to its contents. As should be apparent from the preceding description of the operation of the system, the system has been designed so that all machine service and accountability functions except collection of money from the cash box are carried out without removing the cash box. To unlatch the cash box, the user presses the Open Cashbox switch. If (see FIGS. 23 and 21C) the data key being used is not coded for access to the cashbox, the cashbox will not unlatch. Only if the data key being used is coded for access to the cashbox is the cashbox unlatched and the system set in the cashbox mode. In addition (see FIGS. 6 and 10B) once the cashbox is removed, the microcompouter stores the fact that the cashbox has been opened (a perpetual total is kept of cashbox openings) and also stores the number of the key used and the time the cashbox was opened. Thus, the cashbox latch constitutes means for preventing unauthorized access to the cash in the cash box and the Open Cashbox switch constitutes means operable via the logic means to enable access to the cash box and to store data as to said access in memory. In addition the message "CLOSE CASH BOX" is displayed to remind the service person that the cashbox is unlatched. As long as the system remains in one of the cashbox modes, i.e., as long as the cashbox remains unlatched, the machine is inoperative. The function switches do not initiate their usual corresponding actions. For each closure of any of the function switches, the ACCESS? routine (FIG. 21) is called and, since the system is in a cashbox mode, the action taken in response is the calling of the End-Cbx routine (FIG. 10B). Likewise, closure of the Clear Mode switch is ineffectual when the system is in a cashbox mode (see FIG. 18) since the action taken is again the calling of the End-Cbx routine. Only by putting the cashbox back in place can the system be taken out of the cashbox modes (see FIGS. 10 and 10A). This feature guarantees that all monies which should go to the cashbox will be accepted only when the cashbox is in place. In addition, if the door is closed while the cashbox is out, the message "CLOSE CASH BOX" is displayed and the beeper sounds for 25 seconds (see FIG. 9A).

The level of change in the change tubes can be controlled by a route person by using the Payout Change and Add Change switches. To add change, the user presses the Add Change button and then inserts the desired coins (e.g., nickels) into the coin slot of the vendor. Thus, the Add Change switch constitutes means operable via the logic means for addition of coins to the coin handling means. The microcomputer updates the status of the coin tubes as the coins are inserted (see FIG. 8). It is preferred that each change tube accept coins only until a predetermined number of coins are contained therein, and that subsequent coins of that denomination not be accepted into the change tube. This can be done mechanically or electrically as desired. Payout of coins is accomplished by pressing the Payout Change button and then pressing the 5¢, 10¢ or 25¢ switch as necessary to pay out the desired coins. These switches constitute means operable via the logic means to effect payout of coins from the coin holding means. Since the present system has a Refund switch for initiating refunds, the Payout Change switch need be used only for obtaining money to trade for other denomination coins to replenish the change tubes or when the change tubes are deliberately depleted by a route person as part of the collection of cash from the machine. As a result the attendant need not have access to the cashbox to replenish the change tubes. He can pay out quarters from the change tubes and exchange them for nickels and dimes and reinsert the nickels and dimes, thus replenishing the supply of those coins in the change tubes. As the quarters are paid out that amount is recorded, and as the nickels and dimes are put in that amount is also recorded. If the two amounts are not the same, the shortage can easily be detected.

As mentioned above the data recorded by the present system can be retrieved either by a data probe or manually. To release the data to a data probe the route person presses the Data switch and places the probe adjacent the proper port 31 or 33. Pressing the Data switch results in the message "USE DATA PROBE OR PRESS DATA" being displayed and the probe, if any, being interrogated (see FIG. 28C). If no probe is used, the route person presses the Data switch again. If (see FIG. 28B) the data is not locked from manual display and a key, if needed, is present in slot 35, the start of the data list is pointed to and the items on the data list are displayed (see FIG. 28), one for each actuation of the data switch. As each of the items (machine identification number, total sales, differential between money entering the change tubes and money dispensed therefrom, the amount of refunds, the amount of test vends, the amount of free vends, and the amount of free sales) are displayed, the route person manually copies those items which the owner wants to have copied. The total sales, change tube differential and refunds are especially important for cash accountability purposes. Note that the provision of mechanical retrieval of data allows operators to acquire the present cash accountability system without a huge outlay for data probes and computer equipment but with the ability to automate their cash accountability as such equipment is acquired with no change in the underlying system.

From the above, it will appear that on each vend, i.e., on each sale, data is stored in the memory 47 as to the amount of cash which should be retained in the vendor on account of the vend. This amount is the price of the item vended. Data is also stored in the memory on the amount of coin delivered to the change tubes (as they may require) and delivered from the change tubes (e.g., in change). The logic means 43 is operable to update in the memory the stated data for computation of the amount of cash which should be turned in by one who collects cash from the vendor. By way of example, assuming that three quarters are deposited for purchase of a 60¢ item, and that one of the quarters is delivered to the quarter change tube, on the vend of the 60¢ item, data as to the 60¢ sale, delivery of the quarter (25¢) to the change tubes and delivery of 15¢ in change from the change tubes, the logic means is operable to update data in the memory as to the sales and amount of coin delivered to and from the change tubes. Assuming, for example, that the update at a given time reflects total sales of \$175.25 and a difference of +\$3.80 in change in the change tubes since the last readout, the amount which should be turned in by one who collects cash from the vendor is \$175.25−\$3.80=\$171.45. When coin is paid out from the change tubes other than on a vend, e.g., on a refund or test vend, and when coin is added to the change tubes other than on a vend, these factors are further taken into account in determining the amount that should be turned in.

In view of the above, it will be seen that the several objects of the invention are achieved and other advantageous results attained.

As various changes could be made in the above system without departing from the scope of the invention, it is intended that all matter contained in the above description or shown in the accompanying drawings shall be interpreted as illustrative and not in a limiting sense.

What is claimed is:

1. An accountability system for a vendor having means for handling cash deposited, means for holding coins for delivery in change to a customer, and a cash box, said handling means being adapted to accept said coins and deliver them to the coin holding means if needed, otherwise to deliver them to the cash box, said system comprising:

a memory for storing data on the amount of cash which should be retained in the vendor out of cash deposited in the vendor, and also data on the amount of coin delivered to and delivered from the coin holding means; and logic means for controlling input of data to and retrieval of data from the memory;

said logic means being operable to update in the memory said data for computation of the amount of cash which should be turned in by one who collects cash from the vendor.

2. An accountability system as set forth in claim 1 wherein the logic means is operable to compute the amount of cash which should be turned in by one who collects cash from the cash box, and to store data as to the computed amount in the memory for retrieval.

3. An accountability system as set forth in claim 1 having means operable via the logic means to effect delivery of coin from the coin holding means for making refunds, said memory being adapted to store data as to the amount of such refunds, said logic means being responsive to operation of the refund means to update the refund data in the memory, and being operable to retrieve the refund data from the memory, whereby the amount of refunds made since the last collection may be determined and factored into the computation to determine the cash which should be turned in.

4. An accountability system as set forth in claim 1 having means operable via the logic means for testing by a service person of the cash handling means and a delivery means of the vendor, the service person depositing an appropriate amount of cash for the testing, said memory being adapted to store data as to the monetary amount of a delivery if the delivery means is tested, said logic means being responsive to the testing to effect delivery of coin from the coin holding means to reimburse the service person for the amount deposited, and to update in the memory the monetary amount of test deliveries.

5. An accountability system as set forth in claim 4 wherein said testing means is operable via the logic means, without deposit of cash, to operate the delivery means, and to update in the memory the monetary amount of test deliveries.

6. An accountability system as set forth in claim 1 having means for preventing unauthorized access to cash in the cash box, said memory being adapted to store data as to access to the cash box, and means operable via the logic means to enable access to the cash box and to store data as to said access in the memory.

7. An accountability system as set forth in claim 1 having means operable via the logic means enabling free deliveries by the vendor, said memory being adapted to store data on the monetary amount of free deliveries, and the logic means being responsive to a free delivery to update in the memory the data on the monetary amount of free deliveries.

8. An accountability system as set forth in claim 1 having first means operable via the logic means for enabling free deliveries by the vendor to service persons, second means operable via the logic means for enabling free deliveries by the vendor to anyone, said memory being adapted separately to store data on the respective monetary amounts of each of the first and second types of free deliveries, and the logic means being responsive to each delivery to update in the memory the respective data on the respective monetary amounts of free deliveries of the first and second types.

9. An accountability system as set forth in claim 1 having means operable via the logic means to effect payout of coins from the coin holding means, said memory being adapted to store data as to the amount of payout, said logic means being responsive to operation of the payout means to update the payout data in the memory.

10. An accountability system as set forth in claim 1 having means operable for addition of coins to the coin holding means, the logic means being operable on operation of said addition means to store in the memory data as to amount added.

11. An accountability system as set forth in claim 1 for a vendor having means for vending different products at different prices, selectors for the different products, and means for displaying the total amount deposited as a credit and the vend price of each product, said system having means operable via the logic means to check the prices previously set for the products with the prices appearing on said display means.

12. An accountability system as set forth in claim 1 for a vendor having means for vending different products at different prices, selectors for the different products, and means for displaying the total amount deposited as a credit and the vend price of each product, said system having means operable via the logic means to set the system in a mode for checking the prices previously set for the products and for changing the prices, said logic means then being operable in response to actuation of any product selector to retrieve data from the memory as to the price of the respective product and for display of the price on said display means, said vendor having means then manually operable to change the price with the new price displayed on said display means.

13. An accountability system as set forth in claim 1 having means operable via the logic means for storing in the memory data as to the monetary amount of pulls from the vendor.

14. An accountability system as set forth in claim 1 wherein the memory is adapted to store data as to sales made by the vendor and the logic means is responsive to operation of the vendor to make a vend to update in the memory data on sales made by the vendor, whereby the amount of cash which should be turned in by one who collects cash from the cash box may be computed by determining from the data the amount of sales made since the last collection and the difference (plus or minus) in the amount of coin in the coin holding means since the last collection.

15. An accountability system as set forth in claim 14 wherein the logic means is operable to compute the amount of cash which should be turned in from the data on the amount of sales and the said difference in the amount of coin in the coin holding means, and to store data as to the computed amount in the memory for retrieval.

16. An accountability system as set forth in claim 14 having means operable via the logic means to effect delivery of coin from the coin holding means for making refunds, said memory being adapted to store data as to the amount of such refunds, said logic means being responsive to operation of the refund means to update the refund data in the memory, and being operable to retrieve the refund data from the memory, whereby the amount of refunds made since the last collection may be determined and factored into the computation to determine the cash which should be turned in.

17. An accountability system as set forth in claim 14 having means operable via the logic means for testing by a service person of the cash handling means and a delivery means of the vendor, the service person depositing an appropriate amount of cash for the testing, said memory being adapted to store data as to the monetary amount of a delivery if the delivery means is tested, said logic means being responsive to the testing to effect delivery of coin from the coin holding means to reimburse the service person for the amount deposited, and to update in the memory the monetary amount of test deliveries.

18. An accountability system as set forth in claim 17 wherein said testing means is operable via the logic means, without deposit of cash, to operate the delivery means, and to update in the memory the monetary amount of test deliveries.

19. An accountability system as set forth in claim 14 having means for preventing unauthorized access to cash in the cash box, said memory being adapted to store data as to access to the cash box, and means operable via the logic means to enable access to the cash box and to store data as to said access in the memory.

20. An accountability system as set forth in claim 14 having means operable via the logic means enabling free deliveries by the vendor, said memory being adapted to store data on the monetary amount of free deliveries, and the logic means being responsive to a free delivery to update in the memory the data on the monetary amount of free deliveries.

21. An accountability system as set forth in claim 14 having first means operable via the logic means for enabling free deliveries by the vendor to service persons, second means operable via the logic means for free deliveries by the vendor to anyone, said memory being adapted separately to store data on the respective monetary amounts of each of the first and second types of free deliveries, and the logic means being resposive to each delivery to update in the memory the respective data on the respective monetary amounts of free deliveries of the first and second types.

22. An accountability system as set forth in claim 14 having means operable via the logic means to effect payout of coins from the coin holding means, said memory being adapted to store data as to the amount of payout, said logic means being responsive to operation of the payout means to update the payout data in the memory.

23. An accountability system as set forth in claim 14 having means operable for addition of coins to the coin holding means, the logic means being operable on operation of said addition means to store in the memory data as to amount added.

24. An accountability system as set forth in claim 14 for a vendor having means for vending different products at different prices, selectors for the different products, and means for displaying the total amount deposited as a credit and the vend price of each product, said system having means operable via the logic means to check the prices previously set for the products with the prices appearing on said display means.

25. An accountability system as set forth in claim 14 for a vendor having means for vending different products at different prices, selectors for the different products, and means for displaying the total amount deposited as a credit and the vend price of each product, said system having means operable via the logic means to set the system in a mode for checking the prices previously set for the products and for changing the prices, said logic means then being operable in response to actuation of any product selector to retrieve data from the memory as to the price of the respective product and for display of the price on said display means, said vendor having means then manually operable to change the price with the new price displayed on said display means.

26. An accountability system as set forth in claim 14 having means operable via logic means for storing in the memory data as to the monetary amount of pulls from the vendor.

27. An accountability system as set forth in claim 3 wherein the coin holding means is adapted to hold coins of different denominations, and the means operable via the logic means to effect delivery of coin from the coin holding means for a refund comprises a manually operable refund mode selector for setting the system in a refund mode, and a set of manually operable switches one for each of certain of said denominations each operable in said mode to effect delivery of coin of the respective amount from said holding means.

28. An accountability system as set forth in claim 9 wherein the coin holding means is adapted to hold coins of different denominations, and the means operable via the logic means to effect payout of coins from the coin holding means comprises a manually operable payout mode selector for setting the system in a payout mode, and a set of manually operable switches operable in said payout mode to effect said payout of coins.

29. An accountability system as set forth in claim 12 wherein the coin holding means is adapted to hold coins of different denominations, and wherein the system comprises a set of manually operable switches, one for each of certain of said denominations.

30. An accountability system as set forth in claim 13 wherein the coin holding means is adapted to hold coins of different denominations, and wherein the system comprises a set of manually operable switches, one for each of certain of said denominations, operable in said pulls mode for storing in the memory data as to the monetary amount of pulls.

31. An accountability system as set forth in claim 1 wherein the memory is for storing data on a plurality of transactions in addition to said deposit of cash and delivery of coin, the logic means controls input of data to and retrieval of data from the memory on said additional transactions as well as on said deposit of cash and delivery of coin, and is responsive to said additional transactions as well as said deposit of cash and delivery of coin to update the data in the memory, and wherein means is provided for effecting programming of the system for controlling retrieval of data from the memory.

32. An accountability system as set forth in claim 31 wherein the control means comprises means for supplying a code to the logic means.

33. An accountability system as set forth in claim 31 having means for visually displaying retrieved data.

34. An accountability system as set forth in claim 33 wherein the control means is operable to effect programming of the system for deactivating the visual display means to withhold visual display of data except to an authorized person.

35. An accountability system as set forth in claim 34 wherein said control means comprises means for supplying a code to the logic means.

36. An accountability system as set forth in claim 34 wherein said control means comprises means for supplying a programming controlling code to the logic means for the programming of the system by one authorized to program the system to deactivate the visual display means and also for supplying a service code to the logic means to activate the visual display means for display of data to one authorized to see it.

37. An accountability system as set forth in claim 36 wherein the means for supplying the codes to the logic means comprises a reader for reading a coded key constituting a programming key to be used by one authorized to program the system and also for reading a coded key constituting a service key for use by a service person to enable retrieval of the otherwise protected data.

38. An accountability system as set forth in claim 31 having a data output terminal for outputting retrieved data to a portable interrogator.

39. An accountability system as set forth in claim 38 having means for effecting programming of the system to cut off outputting of some data to the interrogator to prevent overloading of the interrogator.

40. An accountability system as set forth in claim 31 having means for visually displaying retrieved data and a data output terminal for outputting retrieved data to a portable interrogator.

41. An accountability system as set forth in claim 40 having means for effecting programming of the system for deactivating the visual display to withhold display of data except to an authorized person and to cut off outputting of some data to the interrogator to prevent overloading of the interrogator.

42. An accountability system as set forth in claim 41 wherein said control means comprises means for supplying a code to the logic means.

43. An accountability system as set forth in claim 41 wherein said control means comprises means for supplying a programming controlling code to the logic means for the programming of the system by one authorized to program the system to deactivate the visual display means and cut off outputting of some data to the interrogator, and also for supplying a service code to the logic means to activate the visual display means for display of data by one authorized to see it.

44. An accountability system as set forth in claim 43 wherein the means for supplying the codes to the logic means comprises a reader for reading a coded key constituting a programming key to be used by one authorized to program the system and also for reading a coded key constituting a service key for use by a service person to enable retrieval of the otherwise protected data.

45. An accountability system for a vendor for carrying out a plurality of cash accountability functions comprising:

means including a set of function selectors for selecting a function to be carried out;

a memory for storing data as to the functions;

logic means for controlling input of data to and retrieval of data from the memory;

said logic means being adapted for operation in response to operation of a function selector to enable carrying out the respective function;

said logic means being operable upon carrying out of a function to effect storage in the memory of data on that function for subsequent retrieval; and means for effecting programming of the system for controlling retrieval of data from the memory.

46. An accountability system as set forth in claim 45 wherein the control means comprises means for supplying a code to the logic means.

47. An accounting system as set forth in claim 45 having means for visually displaying retrieved data.

48. An accountability system as set forth in claim 47 wherein the control means is operable to effect programming of the system for deactivating the visual display means to withhold visual display of data except to an authorized person.

49. An accountability system as set forth in claim 48 wherein said control means comprises means for supplying a code to the logic means.

50. An accountability system as set forth in claim 48 wherein said control means comprises means for supplying a programming controlling code to the logic means for the programming of the system by one authorized to program the system to deactivate the visual display means and also for supplying a data code to the logic means to activate the visual display means for display of data to one authorized to see it.

51. An accountability system as set forth in claim 50 wherein the means for supplying the codes to the logic means comprises a reader for reading a coded key constituting a programming key to be used by one authorized to program the system and also for reading a coded key constituting a service key for use by a service person to enable retrieval of the otherwise protected data.

52. An accountability system as set forth in claim 46 further including a port over which function data is transmittable by the logic means to a data probe, the means for supplying a code to the logic means comprising a reader for reading a coded key constituting a programming key to be used by one authorized to program the system to preselect those categories of data retrievable by said data probe.

53. An accountability system as set forth in claim 52 wherein one of the function selectors is a data function selector, the logic means being responsive to repeated actuations of the data function selector while programming the retrievable data categories to display a list of retrievable data categories.

54. An accountability system as set forth in claim 46 wherein the means for supplying a code to the logic means comprises a reader for reading a coded key constituting a programming key to be used by one authorized to program the system to deactivate the visual display.

55. An accountability system as set forth in claim 45 wherein the set of function selectors comprises means operable via the logic means to effect delivery of coin from a coin handling means for making refunds, said memory being adapted to store data as to the amount of such refunds, said logic means being responsive to operation of the refund means to update the refund data in the memory.

56. An accountability system as set forth in claim 45 wherein the set of function selectors comprises means operable via the logic means for testing by a service person of a cash handling means and a delivery means of the vendor, the service person depositing an appropriate amount of cash for the testing, said memory being adapted to store data as to the monetary amount of a delivery if the delivery means is tested, said logic means being responsive to the testing to effect delivery of coin from the cash handling means to reimburse the service person for the amount deposited, and to update in the memory the monetary amount of test deliveries.

57. An accountability system as set forth in claim 56 wherein said testing means is operable via the logic means, without deposit of cash, to operate the delivery means and to update in the memory the monetary amount of test deliveries.

58. An accountability system as set forth in claim 45 having a cash box and means for preventing unauthorized access thereto, the memory being adapted to store data as to access to the cash box, wherein the set of function selectors comprises means operable via the logic means to enable access to the cash box and to store data as to said access in the memory.

59. An accountability system as set forth in claim 45 wherein the set of function selectors comprises means operable via the logic means enabling free deliveries by the vendor, said memory being adapted to store data on the monetary amount of free deliveries, and the logic means being responsive to a free delivery to update in the memory the data on the monetary amount of free deliveries.

60. An accountability system as set forth in claim 45 wherein the set of function selectors comprises first means oprable via the logic means for enabling free deliveries by the vendor to service persons, and second means operable via the logic means for enabling free deliveries to anyone, said memory being adapted to separately store data on the respective monetary amounts of each of the first and second types of free deliveries, the logic means being responsive to each free delivery to update in the memory the respective data on the monetary amounts of free deliveries of the first and second types.

61. An accountability system as set forth in claim 45 wherein the set of function selectors comprises means operable via the logic means to effect payout of coins from a coin holding means, said memory being adapted to store data as to the amount of payout, said logic means being responsive to operation of the payout means to update the payout data in the memory.

62. An accountability system as set forth in claim 45 wherein the set of function selectors comprises a means operable via the logic means for addition of coins to a coin holding means, the logic means being operable on operation of said addition means to store in the memory data as to the amount added.

63. An accountability system as set forth in claim 45 for a vendor having means for vending different products at different prices, selectors for the different products, and means for displaying the total amount deposited as a credit and the vend price of each product, said set of function selectors including means operable via the logic means to check the prices of the products.

64. An accountability system as set forth in claim 45 wherein the set of function selectors includes means operable via the logic means for storing in the memory data as to the monetary amount of pulls from the vendor.

65. An accountability system as set forth in claim 45, including a cash box and coin holding means, wherein the memory is adapted to store data as to sales made by the vendor and the logic means is responsive to operation of the vendor to make a vend to update in the memory data on sales made by the vendor, whereby the amount of cash which should be turned in by one who collects cash from the cash box may be computed by determining from the data the amount of sales made since the last collection and the difference in the amount of coin in the coin holding means since the last collection.

66. An accountability system as set forth in claim 65 wherein the logic means is operable to compute the amount of cash which should be turned in from the data on the amount of sales and the said difference in the amount of coin in the coin holding means, and to store data as to the computed amount in the memory for retrieval.

67. An accountability system as set forth in claim 65 wherein the set of function selectors includes means operable via the logic means to effect delivery of coin from the coin holding means for making refunds, said memory being adapted to store data as to the amount of such refunds, said logic means being responsive to operation of the refund means to update the refund data in the memory, and being operable to retrieve the refund data from the memory, whereby the amount of refunds made since the last collection may be determined and factored into the computation to determine the cash which should be turned in.

68. An accountability system as set forth in claim 65 further including means for preventing unauthorized access to cash in the cash box, said memory being adapted to store data as to access to the cash box, wherein the set of function selectors includes means operable via the logic means to enable access to the cash box and to store data as to said access in the memory.

69. An accountability system as set forth in claim 65 wherein the set of function selectors includes means operable via the logic means to effect payout of coins from the coin holding means, said memory being adapted to store data as to the amount of payout, said logic means being responsive to operation of the payout means to update the payout data in the memory.

70. An accountability system as set forth in claim 65 wherein the set of function selectors includes means operable for addition of coins to the coin holding means, the logic means being operable on operation of said addition means to store in the memory data as to amount added.

71. An accountability system as set forth in claim 65 further including coin holding means adapted to hold coins of different denominations, the set of function selectors including means operable via the logic means to effect delivery of coin from the coin holding means for a refund, said coin delivery means comprising a manually operable refund mode selector for setting the system in a refund mode, and a set of manually operable switches, one for each of certain of said denominations, each operable in said mode to effect delivery of coin of the respective amount from said holding means.

72. An accountability system as set forth in claim 65 wherein the set of function selectors further includes means operable via the logic means to effect payout of coins from a coin holding means, said payout means comprising a manually operable payout mode selector for setting the system in a payout mode, and a set of manually operable switches operable in said payout mode to effect said payout of coins.

73. An accountability system for a vendor for carrying out a plurality of cash accountability functions comprising:

means including a set of function selectors for selecting a function to be carried out;

a memory for storing data as to the functions;

logic means for controlling input of data to and retrieval of data from the memory;

said logic means being adapted for operaton in response to operation of a function selector to enable carrying out the respective function;

said logic means being operable upon carrying out of a function to effect storage in the memory of data on that function for subsequent retrieval;

said logic means being programmable to block the carrying out of one or more of the functions; and means for supplying a code to the logic means to unblock the carrying out of one or more of the otherwise blocked functions.

74. An accountability system as set forth in claim 73 wherein the code-supplying means comprises a reader for reading a coded key constituting a service key for use by a service person to enable carrying out an otherwise blocked function.

75. An accountability system as set forth in claim 74 wherein the reader is also operable to read a coded key constituting a programming key to be used by one authorized to program the system for supplying a programming controlling code to the logic means for programming the logic means to block the carrying out of one or more of the functions.

76. An accountability system as set forth in claim 75 wherein the logic means is programmable to withhold retrieval of data from the memory as well as to block the carrying out of one or more of the functions, and wherein the code-supplying means is also operative to supply a code to logic means to enable retrieval of otherwise withheld data.

77. An accountability system as set forth in claim 76 wherein the code-supplying means comprises a reader for reading a coded key constituting a programming key to be used by one authorized to program the logic means for supplying a programming controlling code to the logic means for programming the logic means to withhold retrieval of data and/or block the carrying out of one or more of the functions, and also for reading a coded key constituting a service key for use by a service person to enable carrying out an otherwise blocked function and to enable retrieval of otherwise withheld data.

78. An accountability system as set forth in claim 77 having means for visually retrieving data and wherein the logic means is programmable to deactivate the visual display means.

79. An accountability system as set forth in claim 77 having a data output terminal for outputting retrieved data to a portable interrogator, and wherein the logic means is programmable to cut off outputting of some data to the interrogator to prevent overloading of the interrogator.

80. An accountability system as set forth in claim 79 having means for visually retrieving data and wherein the logic means is programmable to deactivate the visual display means.

81. An accountability system as set forth in claim 73 further including a cash box and coin holding means, wherein the memory is adapted to store data as to sales made by the vendor and the logic means is responsive to operation of the vendor to make a vend to update in the memory data on sales made by the vendor, whereby the amount of cash which should be turned in by one who collects cash from the cash box may be computed by deterx'ining from the data the amount of sales made since the last collection and the difference (plus or minus) in the amount of coin in the coin holding means since the last collection.

82. An accountability system as set forth in claim 81 wherein this set of function selectors includes means operable via the logic means for testing by a service person of cash handling means and a delivery means of the vendor, the service person depositing an appropriate amount of cash for the testing, said memory being adapted to store data as to the monetary amount of a delivery if the delivery means is tested, said logic means being responsive to the testing to effect delivery of coin from the coin holding means to reimburse the service person for the amount deposited, and to update in the memory the monetary amount of test deliveries.

83. An accountability system as set forth in claim 82 wherein said testing means is operable via the logic means, without deposit of cash, to operate the delivery means, and to update in the memory the monetary amount of test deliveries.

84. An accountability system as set forth in claim 81 wherein the set of function selectors includes means operable via the logic means enabling free deliveries by the vendor, said memory being adapted to store data on the monetary amount of free deliveries, and the logic means being responsive to a free delivery to update in the memory the data on the monetary amount of free deliveries.

85. An accountability system as set forth in claim 81 wherein the set of function selectors includes first means operable via the logic means for enabling free deliveries by the vendor to service persons, second means operable via the logic means for free deliveries by the vendor to anyone, said memory being adapted separately to store data on the respective monetary amounts of each of the first and second types of free deliveries, and the logic means being responsive to each delivery to update in the memory the respective data on the respective amounts of free deliveries of the first and second types.

86. An accountability system as set forth in claim 81 wherein the set of function selectors includes means operable via logic means for storing in the memory data as to the monetary amount of pulls from the vendor.

87. In an accountability system for a vendor having means for handling cash deposited, means for holding coins for delivery in change to a customer, and a cash box, said coin handling means being adapted to accept said coins and deliver them to the coin holding means if needed, otherwise to deliver them to the cash box, said system comprising:

a memory for storing data for an accounting for cash which should be turned in by one who collects cash from the vendor;

logic means for controlling input of data to and retrieval of data from the memory; and means operable via the logic means to effect delivery of coin from the coin holding means for making refunds, the memory being adapted to store data as to the amount of such refunds as part of the data needed to determine the amount of cash which should be in the cash box;

said logic means being responsive to operation of the refund means to update the refund data in the memory, and being operable to retrieve the refund data from the memory, whereby the amount of refunds made since the last collection may be determined and factored into the accounting to determine the cash which should be turned in.

88. An accountability system as set forth in claim 87 having means for visually displaying retrieved data and a data output terminal for outputting retrieved data to a portable interrogator.

89. An accountability system as set forth in claim 88 having means for effecting programming of the system for deactivating the visual display to withhold display of data except to an authorized person and to cut off outputting of some data to the interrogator to prevent overloading of the interrogator.

90. An accountability system as set forth in claim 89 wherein said control means comprises means for supplying a code to the logic means.

91. An accountability system as set forth in claim 89 wherein said control means comprises means for supplying a programming controlling code to the logic means for the programming of the system by one authorized to program the system to deactivate the visual display means and cut off outputting of some data to the interrogator.

92. An accountability system as set forth in claim 87 wherein the coin holding means is adapted to hold coins of different denominations, and the means operable via the logic means to effect delivery of coin from the coin holding means for a refund comprises a manually operable refund mode selector for setting the system in a refund mode, and a set of manually operable switches one for each of certain of said denominations each operable in said mode to effect delivery of coin of the respective amount from said holding means.

93. An accountability system as set forth in claim 87 having means operable for addition of coins to the coin holding means, the logic means being operable on operation of said addition means to store in the memory data as to amount added.

94. An accountability system as set forth in claim 87 having means operable via the logic means to effect payout of coins from the coin holding means, said memory being adapted to store data as to the amount of payout, said logic means being responsive to operation of the payout means to update the payout data in the memory.

95. An accountability system as set forth in claim 87 wherein the memory is adapted to store data as to sales made by the vendor and the logic means is responsive to operation of the vendor to make a vend to update in the memory data on sales made by the vendor, whereby the amount of cash which should be turned in by one who collects cash from the cash box may be computed by determining from the data the amount of sales made since the last collection and the difference (plus or minus) in the amount of coin in the coin holding means since the last collection.

96. An accountability system as set forth in claim 95 wherein the logic means is operable to compute the amount of cash which should be turned in from the data on the amount of sales and the said difference in the amount of coin in the coin holding means, and to store data as to the computed amount in the memory for retrieval.

97. An accountability system as set forth in claim 87 having means for preventing unauthorized access to cash in the cash box, said memory being adapted to store data as to access to the cash box, and means operable via the logic means to enable access to the cash box and to store data as to said access in the memory.

98. In an accountability system for a vendor having means for delivery of items to be vended, means for handling cash deposited, means for holding coins for delivery in change to a customer, and a cash box, said coin handling means being adapted to accept said coins and deliver them to the coin holding means if needed, otherwise to deliver them to the cash box, said system comprising:

a memory for storing data;

logic means for controlling input of data to the memory;

means operable via the logic means for testing by a service person of the change delivery means and the delivery means for said items, said testing means being operable upon the deposit of an amount of cash at least equal to the vend price of an item and actuation of the respective delivery means to return an amount equal to the amount deposited from the change holding means.

99. In an accountability system as set forth in claim 98, said means operable via the logic means being operable to prevent the dispensing action of the delivery means for said item while permitting an amount equal to the amount deposited to be returned from the change holding means.

100. In an accountability system as set forth in claim 98, said testing means being operable via the logic means to cause the coin holding means to dispense one amount of change equal to the difference between the amount of cash deposited and the vend price of said item and a second amount of change equal to the vend price of said item with a time delay between the dispensing of the two amounts when the amount deposited exceeds the vend price of said item.

101. In an accountability system as set forth in claim 98, means operable via the logic means to prevent initiation of said testing means if the amount of cash deposited exceeds the vend price of said item and there is insufficient change in the change holding means to cover the difference.

102. In an accountability system as set forth in claim 98, said means operable via the logic means for testing the change delivery means and the delivery means of the vendor being operable to switch the vendor from a normal vending mode to a testing mode.

103. In an accountability system as set forth in claim 98, said memory also retaining the amount of test vends made by the vendor and said logic means controlling the retrieval of said retained data from the memory.

104. In an accountability system as set forth in claim 98, means for controlling access to the testing function by first requiring the acceptance of a coded input.

105. In an accountability system as set forth in claim 103, means for controlling access to the data by first requiring the acceptance of a coded input.

106. In an accountability system as set forth in claim 105, means for retaining a coded input in the memory and for retrieval thereof.

107. In an accountability system for a vendor having means for handling cash deposited, means for holding coins for delivery in change to a customer, and a cash box, said coin handling means being adapted to accept said coins and deliver them to the coin holding means if needed, otherwise to deliver them to the cash box, said system comprising:

a memory for storing data for an accounting for cash which should be turned in by one who collects cash from the vendor;

logic means for controlling input of data to and retrieval of data from the memory; and means for preventing unauthorized access to cash in the cash box, said memory being adapted to store data as to access to the cash box, and means operable via the logic means to enable access to the cash box and to store data as to said access in the memory.

108. An accountability system as set forth in claim 107 including control means for supplying a code to the logic means.

109. An accountability system as set forth in claim 108 wherein the means for supplying a code to the logic means comprises a reader for reading a coded key constituting a service key containing cash box access information.

110. An accountability system as set forth in claim 107 having means operable via the logic means to effect delivery of coin from the coin holding means for making refunds, said memory being adapted to store data as to the amount of such refunds, said logic means being responsive to operation of the refund means to update the refund data in the memory, and being operable to retrieve the refund data from the memory, whereby the amount of refunds made since the last collection may be determined and factored into the computation to determine the cash which should be turned in.

111. An accountability system as set forth in claim 107 having means operable via the logic means for testing by a service person of the cash handling means and a delivery means of the vendor, the service person depositing an appropriate amount of cash for the testing, said memory being adapted to store data as to the monetary amount of a delivery if the delivery means is tested, said logic means being responsive to the testing to effect delivery of coin from the coin holding means to reimburse the service person for the amount deposited, and to update in the memory the monetary amount of test deliveries.

112. An accountability system as set forth in claim 111 wherein said testing means is operable via the logic means, without deposit of cash, to operate the delivery means, and to update in the memory the monetary amount of test deliveries.

113. An accountability system as set forth in claim 107 having means operable for addition of coins to the coin holding means, the logic means being operable on operation of said addition means to store in the memory data as to amount added.

114. An accountability system as set forth in claim 107 having means operable via the logic means to effect delivery of coin from the coin holding means for making refunds, said memory being adapted to store data as to the amount of such refunds, said logic means being responsive to operation of the refund means to update the refund data in the memory, and being operable to retrieve the refund data from the memory, whereby the amount of refunds made since the last collection may be determined and factored into the computation to determine the cash which should be turned in.

115. An accountability system as set forth in claim 107 having means operable via the logic means for testing by a service person of the cash handling means and a delivery means of the vendor, the service person depositing an appropriate amount of cash for the testing, said memory being adapted to store data as to the monetary amount of a delivery if the delivery means is tested, said logic means being responsive to the testing to effect delivery of coin from the coin holding means to reimburse the service person for the amount deposited, and to update in the memory the monetary amount of test deliveries.

116. An accountability system as set forth in claim 115 wherein said testing means is operable via the logic means, without deposit of cash, to operate the delivery means, and to update in the memory the monetary amount of test deliveries.

117. An accountability system as set forth in claim 107 wherein the coin holding means is adapted to hold coins of different denominations, further including means operable via the logic means to effect payout of coins from the coin holding means comprising a manually operable payout mode selector for setting the system in a payout mode, and a set of manually operable switches operable in said payout mode to effect said payout of coins.

118. An accountability system as set forth in claim 107 wherein the memory is for storing data on a plurality of transactions in additon to said deposit of cash and delivery of coin, the logic means controls input of data to and retrieval of data from the memory on said additional transactions as well as on said deposit of cash and delivery of coin, and is responsive to said additional transactions as well as said deposit of cash and delivery of coin to update the data in the memory, and wherein means is provided for effecting programming of the system for controlling retrieval of data from the memory.

119. In an accountability system for a vendor having means for handling cash deposited, means for holding coins for delivery in change to a customer, and a cash box, said coin handling means being adapted to accept said coins and deliver them to the coin holding means if needed, otherwise to deliver them to the cash box, said system comprising:

a memory for storing data for an accounting for cash which should be turned in by one who collects cash fom the cash box;

logic means for controlling input of data to and retrieval of data from the memory; and means operable via the logic means for enabling free deliveries by the vendor, said memory being adapted to store data on the monetary amount of free deliveries, and the logic means being responsive to a free delivery to update in the memory the data on the monetary amount of free deliveries.

120. An accountability system as set forth in claim 119 wherein the means for enabling free deliveries comprises first means operable via the logic means for enabling free deliveries by the vendor to service persons, second means operable via the logic means for free deliveries by the vendor to anyone, said memory being adapted separately to store data on the respective monetary amounts of each of the first and second types of free deliveries, and the logic means being responsive to each delivery to update in the memory the respective data on the respective monetary amounts of free deliveries of the first and second types.

121. In an accountability system for a vendor having means for handling cash deposited, means for holding coins for delivery in change to a customer, and a cash box, said coin handling means being adapted to accept said coins and deliver them to the coin holding means if needed otherwise to deliver them to the cash box, said system comprising:

a memory for storing data for an accounting for cash which should be turned in by one who collects cash from the cash box;

logic means for controlling input of data to and retrieval of data from the memory; and first means operable via the logic means for enabling free deliveries by the vendor to service persons, second means operable via the logic means for enabling free deliveries by the vendor to anyone, said memory being adapted separately to store data on the respective monetary amounts of each of the first and second types of free deliveries, and the logic means being responsive to each delivery to update in the memory the respective data on the respective monetary amounts of free deliveries of the first and second types.

122. In an accountability system for a vendor having means for handling cash deposited, means for holding coins for delivery in change to a customer, and a cash box, said coin handling means being adapted to accept said coins and deliver them to the coin holding means if needed, otherwise to deliver them to the cash box, said system comprising:

a memory for storing data for an accounting for cash which should be turned in by one who collects cash from the cash box;

logic means for controlling input of data to and retrieval of data from the memory; and means operable via the logic means to effect payout of coins from the coin holding means, said memory being adapted to store data as to the amount of payout, said logic means being responsive to operation of the payout means to update the payout data in the memory.

* * * * *